US007798240B2

(12) United States Patent
Arai et al.

(10) Patent No.: US 7,798,240 B2
(45) Date of Patent: Sep. 21, 2010

(54) WASTE RECOVERY STATION STRUCTURE FOR BEACH CLEANER AND BEACH CLEANER STRUCTURE

(75) Inventors: Shokichi Arai, Saitama (JP); Hidekazu Sakai, Saitama (JP); Tadashi Oshima, Saitama (JP); Tetsuro Hosoda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 685 days.

(21) Appl. No.: 11/730,519

(22) Filed: Apr. 2, 2007

(65) Prior Publication Data

US 2007/0227960 A1 Oct. 4, 2007

(30) Foreign Application Priority Data

Apr. 3, 2006 (JP) ..... 2006-101617
Apr. 3, 2006 (JP) ..... 2006-101618
May 9, 2006 (JP) ..... 2006-130255

(51) Int. Cl.
*A01D 33/00* (2006.01)

(52) U.S. Cl. ..... 171/143; 209/412; 209/420; 414/572; 414/373

(58) Field of Classification Search ..... 171/143, 171/102, 106; 37/268; 414/572, 373, 376, 414/389, 573, 576, 401, 574, 381, 382; 209/409, 209/372, 370, 373, 410, 412, 420, 421
See application file for complete search history.

(56) References Cited

U.S. PATENT DOCUMENTS 5,297,914 A * 3/1994 Ash ..... 414/574
6,540,030 B2 * 4/2003 Ohzeki et al. ..... 171/1
6,763,949 B2 * 7/2004 Ohzeki et al. ..... 209/409
6,899,185 B2 * 5/2005 Yagisawa et al. ..... 171/143
2002/0040790 A1 * 4/2002 Ohzeki et al. ..... 171/1
2002/0043373 A1 4/2002 Ohzeki et al.
2002/0178623 A1 12/2002 Yagisawa et al.
2007/0227749 A1 * 10/2007 Arai et al. ..... 171/111
2007/0227750 A1 * 10/2007 Ari et al. ..... 171/111

FOREIGN PATENT DOCUMENTS

JP 2002-356827 A 12/2002

* cited by examiner

*Primary Examiner*—Robert E Pezzuto
*Assistant Examiner*—Matthew D Troutman
(74) *Attorney, Agent, or Firm*—Birch, Stewart, Kolasch & Birch, LLP

(57) ABSTRACT

To provide a waste recovery station for a beach cleaner which is less liable to be bulky after being divided and can facilitate installing work, and which can easily load and unload a beach cleaner and a waste recovery station on and from a trailer. A waste recovery station includes a pair of left and right grounded members, guide members formed like a mountain as viewed from the side and attached to the grounded members, and bar-like connecting members integrally connecting the grounded members. The waste recovery station can recover the waste collected by the beach cleaner towed by the towing vehicle to run on the sand area by allowing the beach cleaner to ride on the waste recovery station. The waste recovery station includes a connecting pipe which removably connect an end of the connecting member to the grounded member.

10 Claims, 43 Drawing Sheets

WASTE RECOVERY STATION STRUCTURE FOR BEACH CLEANER AND BEACH CLEANER STRUCTURE

CROSS-REFERENCE TO RELATED APPLICATIONS

This nonprovisional application claims priority under 35 U.S.C. §119(a) on Patent Application Nos. 2006-130255, 2006-101616 and 2006-101618, filed in Japan on May 9, 2006, Apr. 3, 2006 and Apr. 3, 2006, respectively. The entirety of each of these documents is incorporated herein by reference.

FIELD OF THE INVENTION

The present invention relates to a waste recovery station structure for a beach cleaner which collects various waste scattered on a sand area such as a bathing beach. The present invention also relates to a structure of a beach cleaner which collects various waste scattered on a sand area such as a bathing beach.

DESCRIPTION OF BACKGROUND ART

Examples of a known beach cleaner will be described below. While being towed by a towing vehicle, the known beach cleaner travels on a sand area to collect waste scattered thereon. Thereafter, the beach cleaner rides on a waste recovery station installed at a predetermined site on the sand area. Thus, the waste can be recovered from the beach cleaner. (See Japanese Patent Laid-Open No. 2002-356827, for example).

The waste recovery station described above is configured as below. Guide members each shaped like a gentle mountain are respectively attached to a pair of left and right grounded members. Connecting members extending in the leftward and rightward direction integrally connects the grounded members. Foot members are attached to the grounded members so as to project downward therefrom. The waste recovery station is installed at a predetermined site by digging the foot members in a sand area. Both side portions of the beach cleaner ride on the respective guide members of the waste recovery station. In this state, the waste that has been scraped up and collected from the sand area is recovered.

Beach cleaners are broadly classified into two types: a sand rake and a sand screen. The sand rake is adapted to rake up relatively large waste using sand pins projecting downward from the lower surface of the main body thereof, The sand screen is adapted to scrape up relatively small waste with sand and capture the waste with a net.

The sand rake enables recovery of waste by allowing the waste raked up and collected in the waste recovery station to drop on the ground. On the other hand, the sand screen enables discharge of waste captured, by turning the net while being lifted up on the waste recovery station.

Incidentally, the beach cleaner and the waste recovery station are carried to a predetermined working site while being loaded on a trailer. Since the beach cleaner and the waste recovery station are large-sized and are heavy loads, there is a problem in that they are liable to take effort to be loaded and unloaded on and from the trailer. It is desirable, therefore, that a relatively large sized waste recovery station be configured to be dividable. It has also been desirable, therefore, that the beach cleaner and the waste recovery station can be carried without the necessity of a dedicated trailer.

In the conventional configuration mentioned above, the left-right intermediate portion of the connecting member or the front-rear intermediate portion of each of the grounded member and the guide member is constructed as a connecting portion. That is to say, the sterically large-sized waste recovery station is merely configured to be dividable back and forth or right and left. Thus, each of the divided bodies is liable to be bulky, which poses problems in that it is hard to carry or load and unload the divided bodies on and from a trailer. In addition, it is difficult to assemble the divided bodies.

SUMMARY OF THE INVENTION

Accordingly, the present invention provides a waste recovery station for a beach cleaner that is less bulky after being divided and that can be installed with ease. The present invention also provides a beach cleaner structure capable of carrying a beach cleaner and a waste recovery station without the necessity of a designated trailer.

According to the present invention, a waste recovery station (e.g. the waste recovery station 40 in the embodiment) for a beach cleaner includes a pair of grounded members (e.g., the grounded members 43 in the embodiment), mountain-shaped guide members (e.g., the guide members 44 in the embodiment) attached to the respective grounded members and a connecting member (e.g., the connecting member 42 in the embodiment) integrally connecting the grounded members and enabling recovery of waste by allowing the beach cleaner (e.g. the beach cleaners 20, 50 in the embodiment) to ride thereon, the waste being collected by the beach cleaner towed by a towing vehicle (e.g., the vehicle 1 in the embodiment) to run on the sand area, a connecting portion (e.g. the connecting pipe 46 in the embodiment) is provided to detachably connect an end of the connecting member with the grounded member.

According to the present invention, the connecting portion is cylindrical so as to insertably receive the end of the connecting member thereinto. While the connecting member is inserted into the connecting portion, a retaining member (e.g., the retaining pin 47 in the embodiment) to be passed through the connecting member and the connecting portion is inserted thereinto and is dug into the sand.

According to the present invention, since the structure mainly including the grounded member and the guide member, and the connecting member are dividable, each of the divided bodies is planar. Since each of the divided bodies after being divided is less liable to be bulky, it is easy to carry the divided bodies, to load and unload them on and from the trailer, and to assemble them, thereby facilitating installing work, According to the present invention, while the retaining member detachably connects the connecting member to the connecting portion, the retaining portions suppress movement of the waste recovery station with respective to the sand area.

The present invention also provides a waste recovery station structure for a beach cleaner which facilitates loading and unloading a beach cleaner and a waste recovery station on and from a trailer.

According to the present invention, a structure of a waste recovery station structure (e.g. the waste recovery station 40 in the embodiment) in which a beach cleaner (e.g. first and second beach cleaners 20, 50 in the embodiment) which runs on a sand area to collect waste while being towed by a towing vehicle (e.g. the vehicle 1 in the embodiment) is allowed to ride on the waste recovery station for enabling recovery of the waste, includes a trapezoid structure (e.g., the left and right side structures 41L, 41R in the embodiment) formed by providing, on a grounded member (e.g. the grounded member 43 in the embodiment), a mountain-shaped guide member (e.g., the guide member 44 in the embodiment) on which the beach cleaner rides, and a portion of a trailer (e.g. the trailer 13) on which the beach cleaner and the waste recovery station are loaded constitutes at least an upper side section (e.g. the upper side section 44*c* of the embodiment) of the structure.

According to the present invention, the structure is composed of a plurality of divided bodies (e.g. the divided bodies 41*a*, 41*b*, 41*c*, 41*d* of the embodiment) attachable to and detachable from each other, and the trailer constitutes at least one of the divided bodies.

According to the present invention, the waste recovery station includes a pair of the structures and a loading part (e.g. the loading part 16 in the embodiment) of the trailer constitutes at least an upper side section of one of the structures.

According to the present invention, the beach cleaner includes a net (e.g. the net 56 in the embodiment) adapted to capture waste and the net is provided to be turnable so that the waste collected can be thrown into the loading part of the trailer when the beach cleaner rides on the waste recovery station.

According to the present invention, the waste recovery station includes connecting members (e.g., the connecting members 42 in the embodiment) adapted to connect the pair of structures and the connecting members are provided to be spanned between divided bodies of the structures except a portion corresponding to the trailer.

According to the present invention, when the beach cleaner and the waste recovery station loaded on the trailer are unloaded on the ground, the waste recovery station including the trailer are assembled and brought into an installation state at a predetermined site and then the beach cleaner on the trailer can be unloaded along the guide members of the waste recovery station on the ground. When the beach cleaner and the waste recovery station are loaded on the trailer, the beach cleaner is first lifted up along the guide members of the waste recovery station and then loaded on the trailer, and thereafter the waste recovery station disassembled can be loaded on the trailer As described above, the trailer constitutes a portion of the guide members of the waste recovery station; therefore, loading and unloading the beach cleaner and the waste recovery station on and from the trailer can be facilitated to reduce the number of man-hours.

According to the present invention, the waste recovery station can be loaded and unloaded by being disassembled into a plurality of divided bodies. Therefore, the loading and unloading work can be facilitated.

According to the present invention, the waste recovery station can be installed while the trailer is made to be adjacent to one of the structures. Therefore, the installing work can be facilitated.

According to the present invention, turning the net can discharge the waste collected and the waste recovery station for the waste discharging work lifts the beach cleaner up. Thus, the waste can be directly thrown into the loading part of the trailer. The loading part can be effectively used as a waste recovery container and work for recovering waste on the sand area can be eliminated, which can facilitate waste recovery work.

According to the present invention, the pair of structures can be connected by the connecting members while avoiding a portion constituting the trailer. Therefore, rigidity of the waste recovery station can be enhanced.

According to the present invention, a structure of a beach cleaner (e.g., the third beach cleaner 100 in the embodiment) towed by a towing vehicle (e g, the vehicle 1 in the embodiment) to run on a sand area for collecting waste scattered, includes: a frame (e.g. the frame 103 in the embodiment) composed of longitudinal members {e.g. the longitudinal members 101 in the embodiment) extending in a traveling direction and a lateral member (e.g. the lateral member 102 in the embodiment) extending in a widthwise direction; a plurality of sand pins (e.g. the sand pins 107 in the embodiment) attached to the lateral member; and a towing portion (e.g., the hitch coupler 17*a* in the embodiment) located at an front end of the frame; wheels (e.g. the wheels 105 in the embodiment) are attachable to and detachable from both side portions of the frame, and when the wheels are attached, the beach cleaner acts as a trailer with the sand pins on one side face of the frame serving as a positioning portion.

According to the present invention, a flat portion (e.g. the flat portion 109 in the embodiment) is provided on the frame.

According to the present invention, a net section (e.g. the net section 109*a* in the embodiment) is provided at the flat portion.

According to the present invention, the wheels are attached to both the sides of the frame with the sand pins facing the upside and the beach cleaner is towed by the towing vehicle using the towing portion located at the front end of the frame. Therefore, the beach cleaner can be used as a trailer. Thus, another beach cleaner and a waste recovery station can be carried without the necessity of a dedicated trailer. In this case, component parts loaded on the frame can be positioned using the sand pins facing the upside. In addition, the frame can be provided so as to make its lower surface planar, thereby making it easy to ensure the minimum ground height for the trailer.

According to the present invention, when the beach cleaner is used as the trailer as described above, loading the component parts on the frame can be facilitated.

According to the present invention, while loading performance of the component parts on the frame can be enhanced, sand or the like can be prevented from collecting on the flat portion, thereby enhancing maintenance performance.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1(*a*) illustrates a state where beach cleaners and the like according to a second embodiment of the invention loaded on a trailer are carried;

FIG. 2(*a*) is a side view of a first beach cleaner of the embodiment;

FIG. 3(*a*) is a plan view of FIG. 2(*a*);

FIGS. 4(*c*) and 4(*d*) are explanatory views of a second embodiment of a sand pin of the first beach cleaner, in which FIG. 4(*c*) is a side view and FIG. 4(*d*) is a view as viewed from arrow A of FIG. 4(*c*);

FIG. 13(*a*) is a left side view of a waste recovery station according to the embodiment;

FIG. 13(*b*) is a right side view of the waste recovery station;

FIG. 14(*a*) is a plan view of FIG. 13(*a*);

FIG. 25(*a*) is a side view illustrating a state where the first beach cleaner is towed by the vehicle according to a second embodiment;

FIG. 26(*a*) is a side view illustrating a state where the second beach cleaner is towed by the vehicle according to a second embodiment;

DETAILED DESCRIPTION OF THE PREFERRED EMBODIMENTS

Preferred embodiments of the present invention will be hereinafter described with reference to drawings.

Figure 1:
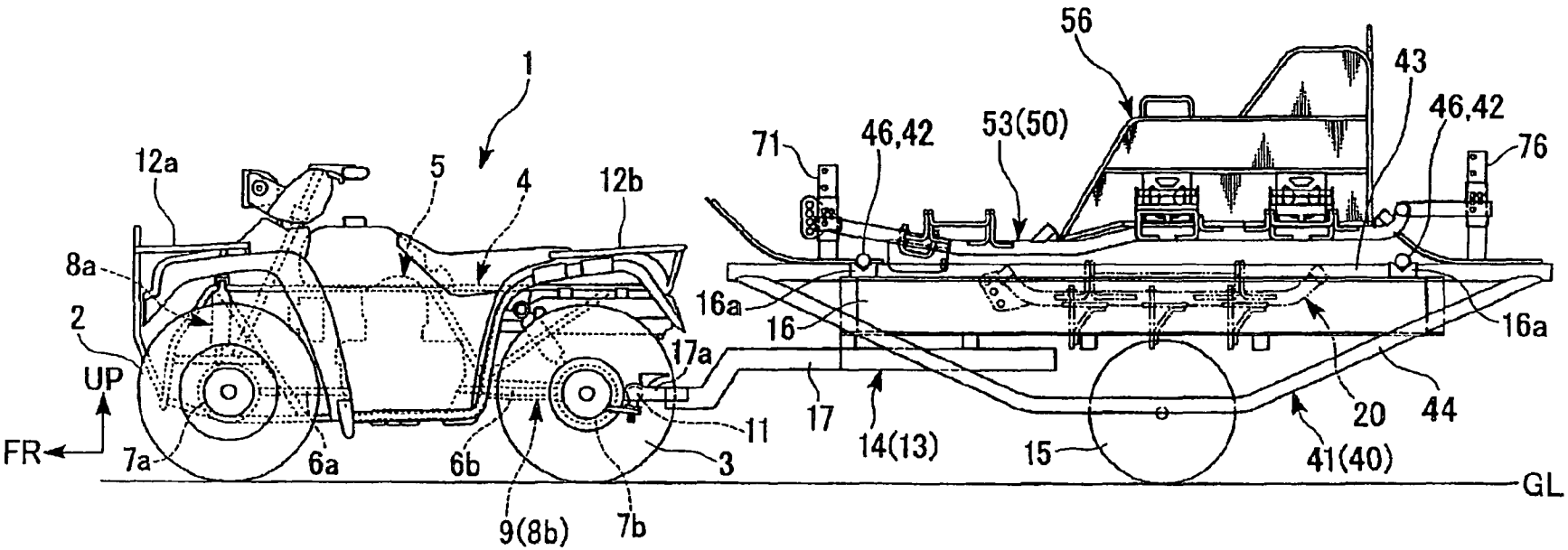
FIG. 1 illustrates a state where beach cleaners and the like according to a first embodiment of the invention loaded on a trailer are carried.
Figure 1A:
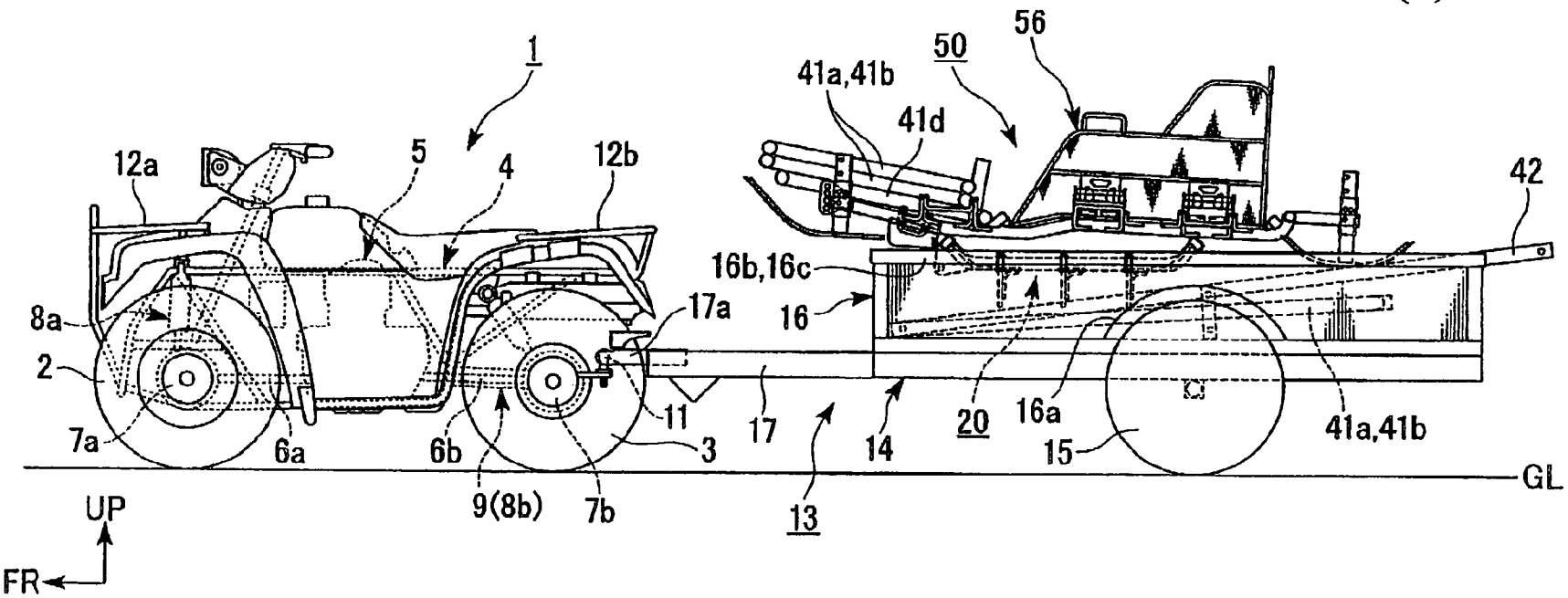

A vehicle 1 depicted in FIG. 1 is configured as a so-called ATV (All Terrain Vehicle). The vehicle 1 includes left and right front wheels 2 and rear wheels 3 disposed at the front portion and rear portion, respectively, of a vehicle body formed small in size and light in weight. The wheels are low-pressure balloon tires with a relatively large diameter. Thus, the vehicle 1 ensures a large minimum ground height, thereby enhancing traveling performance on, particularly, the irregular terrain. A body frame 4 of the vehicle body 1 is formed at the widthwise central portion to have a box structure long in the back and forth direction. An engine 5 as a prime mover for the vehicle 1 is mounted on the almost central portion of the body frame 4.

The engine 5 is a water-cooled single cylinder engine for example. The rotational power of a crankshaft is output to front and rear propeller shafts 6*a* and 6*b* via a gear-meshing type transmission. The rotational power output to the front and rear propeller shafts 6*a* and 6*b* are output to left and right front and rear wheels 2 and 3 via front and rear reduction gears 7*a* and 7*b*, respectively.

The vehicle 1 is a so-called semi-automatic vehicle, which is able to electrically change the gear ratio of the transmission. The gear ratio can be changed through, for example, a centrifugal clutch, by operating only a change button or the like without operating the clutch. Such a vehicle 1 is suitable for running with a large running load or at constant speed as compared with a vehicle equipped with a belt type transmission.

The left and right front wheels 2 are suspended by the front portion of the body frame 4 through front independent suspensions 8*a*. The left and right rear wheels 3 are suspended by the rear portion of the body frame 4 through, e.g. swing arm type rear suspensions 8*b*. Trailer hitches 11 for towing a trailer are provided at the rear ends of swing arms 9 of the rear suspensions 8*b*. In the figure, reference numeral 12*a* denotes a front carrier supported by the front portion of the body frame 4 and 12*b* denotes a rear carrier supported by the rear portion of the body frame 4. The vehicle 1 can tow a trailer 13, which carries a first and a second beach cleaner 20, 50 and a waste recovery station 40.

The trailer 13 includes a pair of left and right wheels 15, as well as a loading part 16 and a tow-arm 17. The wheels 15 are provided on both sides of the lower portion of a body frame 14 of the trailer 13 for instance. The loading part 16 is in a shallow box shape that opens upward and is provided on the body frame 14. The tow-arm 17 extends from the lower side of the front portion of the body frame 14 toward the forward. A hitch coupler 17*a* associated with the trailer hitch 11 is provided at the front end of the tow-arm 17.

Receiving members 16*a* adapted to support connecting pipes 46, described later, of a waste recovery station 40 are provided at upper edge portions, of a carrier 16, located on front and rear, left and right sides thereof. The receiving member 16*a* is formed with a V-shaped recess opening upward. The connecting pipe 46 is supportably received in the recess with the wasted recovery station 40 in the loaded state turned upside down. A second beach cleaner 50 is loaded on the waste recovery station 40 in the loaded state, while being engaged with, e.g. grounded members 43 described later so as to be restricted in movement. In addition, a first beach cleaner 20 is loaded on the waste recovery station 40 in the loaded state, while being received, e.g. in the carrier 16.

In the embodiment illustrated in FIG. 1(*a*), the body frame 14 is square shaped as viewed from above and the loading part 16 is provided so as to be substantially superposed on the body frame 14 as viewed from above. The loading portion 16 is configured such that plate members are attached to a frame to form front, rear, left and right wall portions and a bottom wall portion. Wheel houses 16*a* associated with the left and right wheels 15 are formed to protrude upwardly on both sides, left and right, of the bottom wall portion of the loading part 16.

In FIG. 1(*b*), a portion of divided bodies constituting the waste recovery station 40 is received in the loading part 16 and the first and second beach cleaners 20, 50 and another portion of the divided bodies are loaded on the loading part 16. The trailer 13 in such loading conditions is towed by the vehicle 1 so that the beach cleaners 20, 50 and the waste recovery station 40 can be carried to a predetermined working site. Left and right side portions 16*b* and 16*c* form the left and right upper edge portions, respectively, of the frame in the loading part 16.

Figure 2:
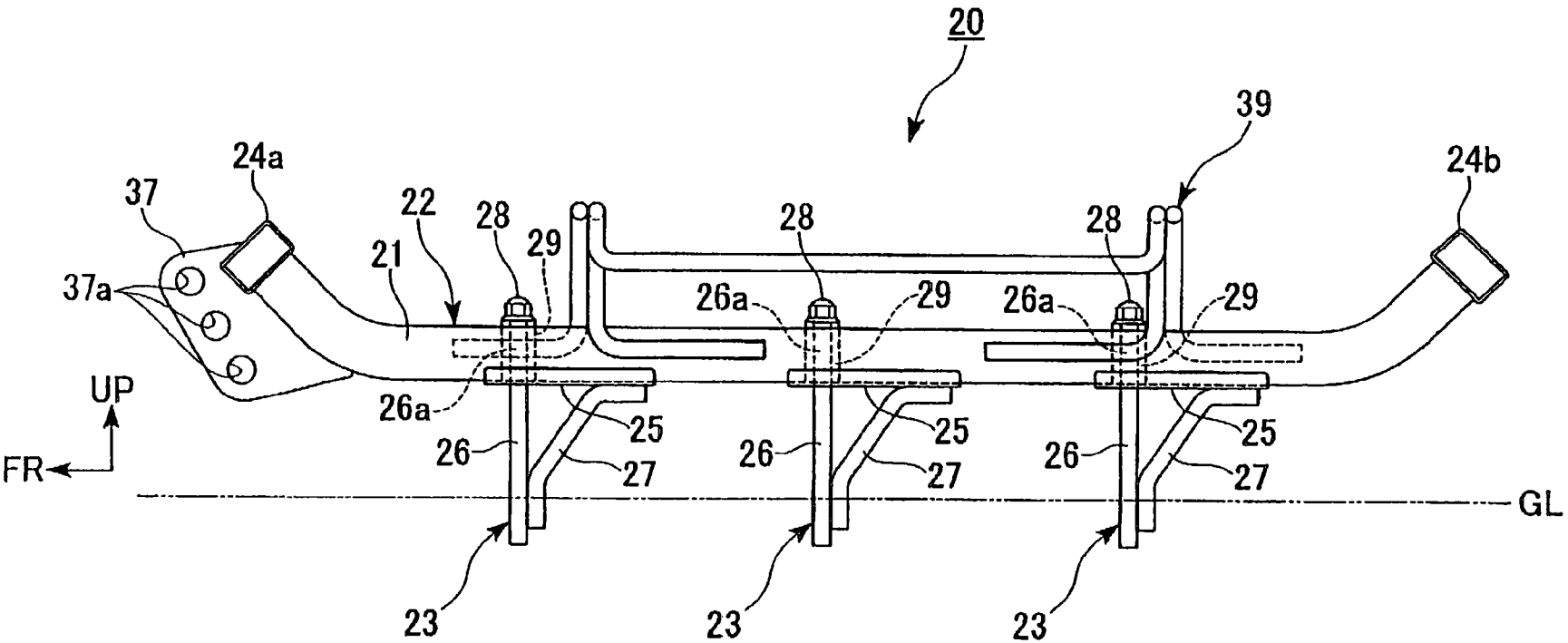
FIG. 2 is a side view of a first beach cleaner of the embodiment.
Figure 2A:
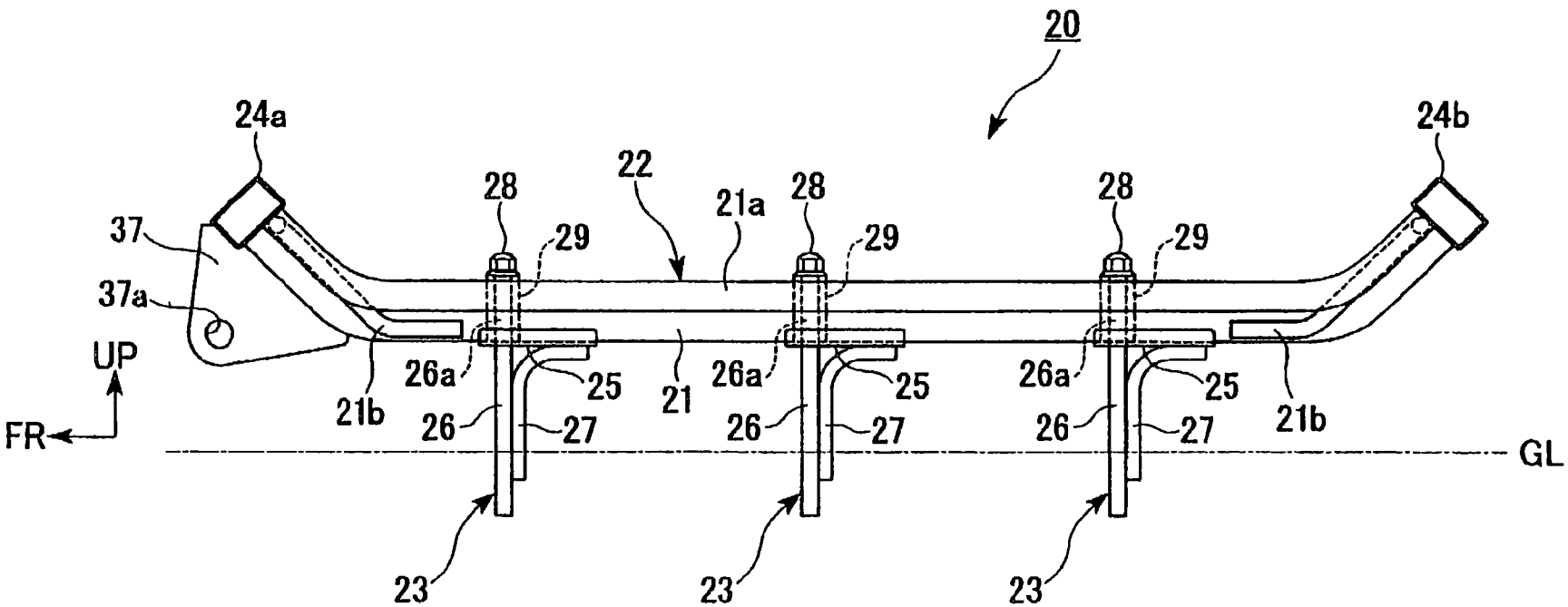

FIGS. 1 and 1(*a*) illustrate a state in which the beach cleaners 20, 50 and the waste recovery station 40 are loaded on the trailer 13. FIG. 2 and the subsequent figures illustrate a state in which the beach cleaners 20, 50 and the waste recovery station 40 are used on a sand area, unless otherwise specified. As shown in FIGS. 1 and 1(*a*), the loading part 16 is kept almost horizontally at a desired height while both the wheels 15 of the trailer 13 are placed on the ground. In the figures, line GL denotes the ground (the upper surface of the sand area) and line CL in the figure denotes the respective widthwise centers of the vehicle 1, the beach cleaners 20, 50 towed by the vehicle 1 and the waste recovery station 40 through which the beach cleaners 20, 50 pass (The vehicle 1, the beach cleaners 20, 50 and the waste recovery station 40 are hereinafter called the vehicle and the like.). Arrow FR denotes the forward in the running direction (the back and forth direction) of the vehicle or the like. Arrow UP denotes the upside in the upward and downward direction of the vehicle and the like. Arrow LH denotes the left in the leftward and rightward direction in the vehicle and the like.

While running on a sand area (a sandy beach) of a seashore, the beach cleaners 20, 50 collect various waste scattered on the sand area. The waste collected by the beach cleaners 20, 50 is collectively recovered by the waste recovery station 40 installed on the desired site on the sand area. The beach cleaners 20, 50 and the waste recovery station 40 are appropriately assembled by a plurality of kinds of steel materials such as stainless steel using joining means such as welding. Incidentally, the beach cleaners 20, 50 may be towed by a tractor.

Referring to FIGS. 2, 2(*a*), 3 and 3(*a*), the first beach cleaner 20 includes a plurality of (e.g. 15) longitudinal members 21 which extend in the running direction and are placed so as to be almost evenly spaced apart from each other in the widthwise direction (the leftward and rightward direction), thereby forming a floor grate-like frame 22. In addition, a plurality of sand pins 23 is detachably attached to the respective longitudinal members 21 so as to project downward. Incidentally, the first beach cleaner 20 is configured to be symmetrical.

The longitudinal member 21 is made of e.g. a circular steel tube (or rectangular steel tube). The longitudinal member 21 extends along the back and forth direction and has front and rear end portions, which bend upwardly forwardly and upwardly rearward, respectively. A plurality of the longitudinal members 21 are juxtaposed to each other right and left so as to be superposed as viewed from the side. The longitudinal member 21 is connected at its front end to a front lateral member 24*a* so as to be abutted against it from obliquely and downward-rearward. The front lateral member 24*a* is made of, e.g. a rectangular steel tube and extends in the leftward and rightward direction. In addition, the longitudinal member 21 is connected at its rear end to a rear lateral member 24*b* so as to be abutted against it from obliquely and downward-forwardly. The rear lateral member 24*b* is made of, e.g. a rectangular steel tube and extends in the leftward and rightward direction.

The frame 22 composed of the longitudinal members 21 and the lateral members 24*a*, 24*b* is formed in a horizontally long rectangle as viewed from above. The left-right width of the frame 22 is made equal to or slightly greater than that of the vehicle 1 and smaller than that between left and right side structures 41 of the waste recovery station 40 described later.

Referring to FIGS. 2(*a*) and 3(*a*), the front and rear lateral members 24*a* and 24*b* terminate at respective positions leftward and rightward outside the outermost longitudinal members 21. In addition, side longitudinal members 21*a* bending similarly to the longitudinal member 21 are spanned between the left ends of the front and rear lateral members 24*a*, 24*b* and between the right ends thereof. Orthogonal reinforcing members 21*b* are spanned between the front end and rear end of the outermost longitudinal member 21 and leftward and rightward outward extensions of the front and rear lateral members 24*a* and 24*b*, respectively.

In FIGS. 2(*a*) and 3(*a*), the frame 22 composed of the members described above is formed in a horizontally long rectangle as viewed from above. The width of the frame 22 is made greater than that of the vehicle and than that between left and right side structures 41L and 41R of the waste recovery station 40 described later. When the first beach cleaner 20 towed by the vehicle 1 enters between the left and right side structure 41L, 41R, the left and right side portions of the frame 22 ride on the left and right side structures 41L and 41R, respectively. Thus, the first beach cleaner 20 is lifted up to a desired height. Since the width between the left and right side structures 41L, 41R is greater than that of the vehicle 1, the vehicle 1 can pass between the left and right side structures 41R, 41L.

The sand pins 23 can be attached to the front portion, intermediate portion and rear portion of each longitudinal member 21. In other words, the sand pins 23 are arranged in three rows in the back and forth direction. This makes it possible to suppress travel resistance during low-speed travel and to further suppress travel resistance by reducing the number of the sand pins 23 according to the hardness of the sand area or the like. The length of the sand pin 23 that project from the lower surface of the frame 22 is set to 100 mm at most in order to suppress an effect on the ecological system in the sand area.

While the first beach cleaner 20 as described above travels on the sand area, relatively large scattered waste (ropes, nets, driftwood, etc.) is caught or tangled with and thus raked up by the sand pins 23.

Additionally referring to FIG. 4, the sand pin 23 includes a plate-like member 25, a pin main body 26 and a support member 27. The plate-like member 25 bends to conform to the lower outer surface of the longitudinal member 21. The pin main body 26 vertically passes through the plate-like member 25. The support member 27 bridges over the lower portion of the pin main body 26 and the rear portion of the plate-like member 25. The support member 27 is formed to be in a triangle, as viewed from the side, tapered toward the downside. The sand pin 23 is formed to be tapered toward the downside as viewed from the side. The pin main body 26 is formed at its upper portion with an external thread portion 26*a*. While this external thread portion 26*a* passes through the longitudinal member 21 from below and projects upward therefrom, the plate-like member 25 is abutted against the lower surface of the longitudinal member 21. In this state, a hexagon cap nut 28 is threaded and fastened onto the external thread portion 26*a*, whereby the sand pin 23 is fastened to the longitudinal member 21. A cylindrical collar 29 is fixedly inserted through a portion of the longitudinal member 21 through which the pin main body 26 passes.

Figure 5A:
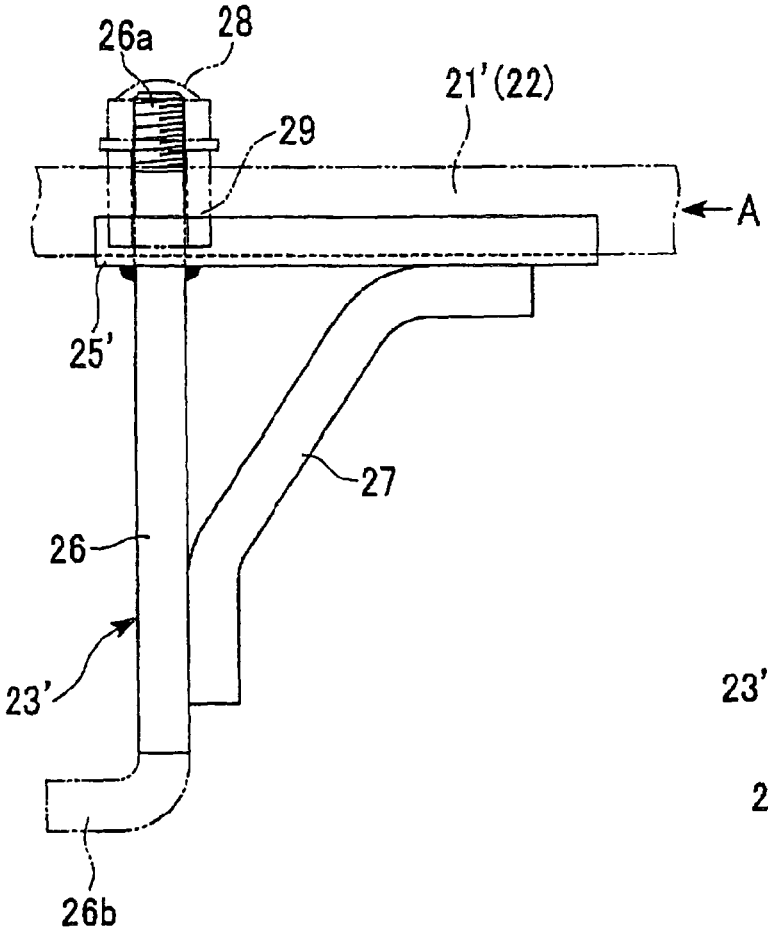
FIG. 5 includes explanatory views of a modified example of the sand pin, in which FIG. 5(*a*) is a side view and FIG. 5(*b*) is a view as viewed from arrow A of FIG. 5(*a*)
Figure 5B:
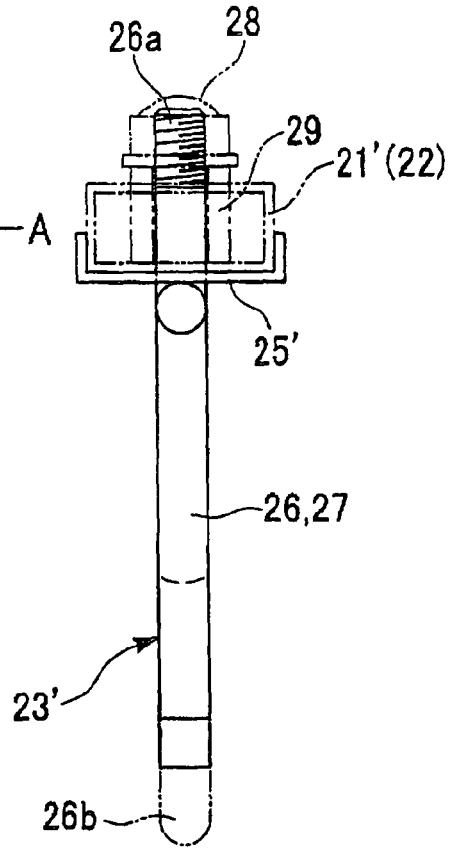

As shown in FIG. 5, if a longitudinal member 21' is made of a rectangular steel tube, a sand pin 23' designed to accommodate to the longitudinal member 21' may be used. Specifically, the sand pin 23' includes a plate-like member 25' which is U-shaped in section so as to conform to the lower outer surface of the longitudinal member 21'. In the state where the plate-like member 25' conforms to the lower portion of the longitudinal member 21, a hexagon cap nut 28 is threaded and fastened onto the external thread portion 26*a*, whereby the sand pin 23' is fastened to the longitudinal member 21', The longitudinal member 21' has a relatively broad left-right width in section. Use of such a longitudinal member 21' enhances glide performance of the first beach cleaner 20 relative to a sand area. If the lower end of the pin main body 26 is made to bend forward to form a folding back part 26*b*, waste recovery performance can be further enhanced.

Figure 6:
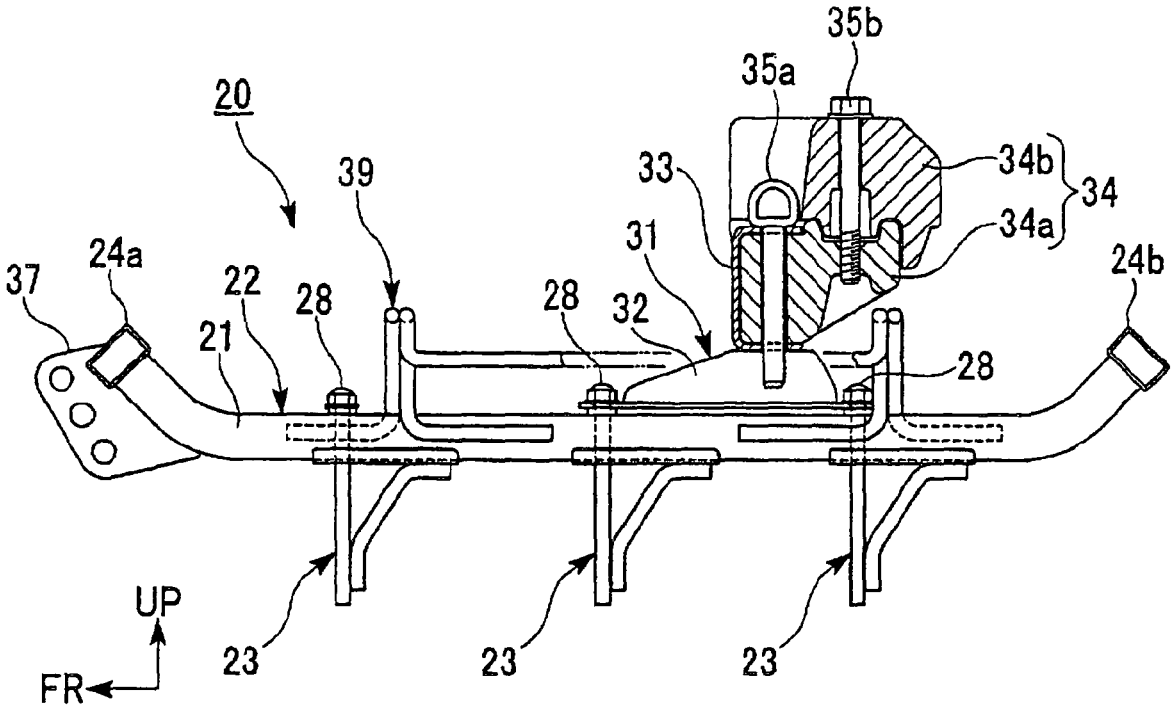
FIG. 6 is a side view illustrating a weight mount portion attached to the first beach cleaner.
Figure 7:
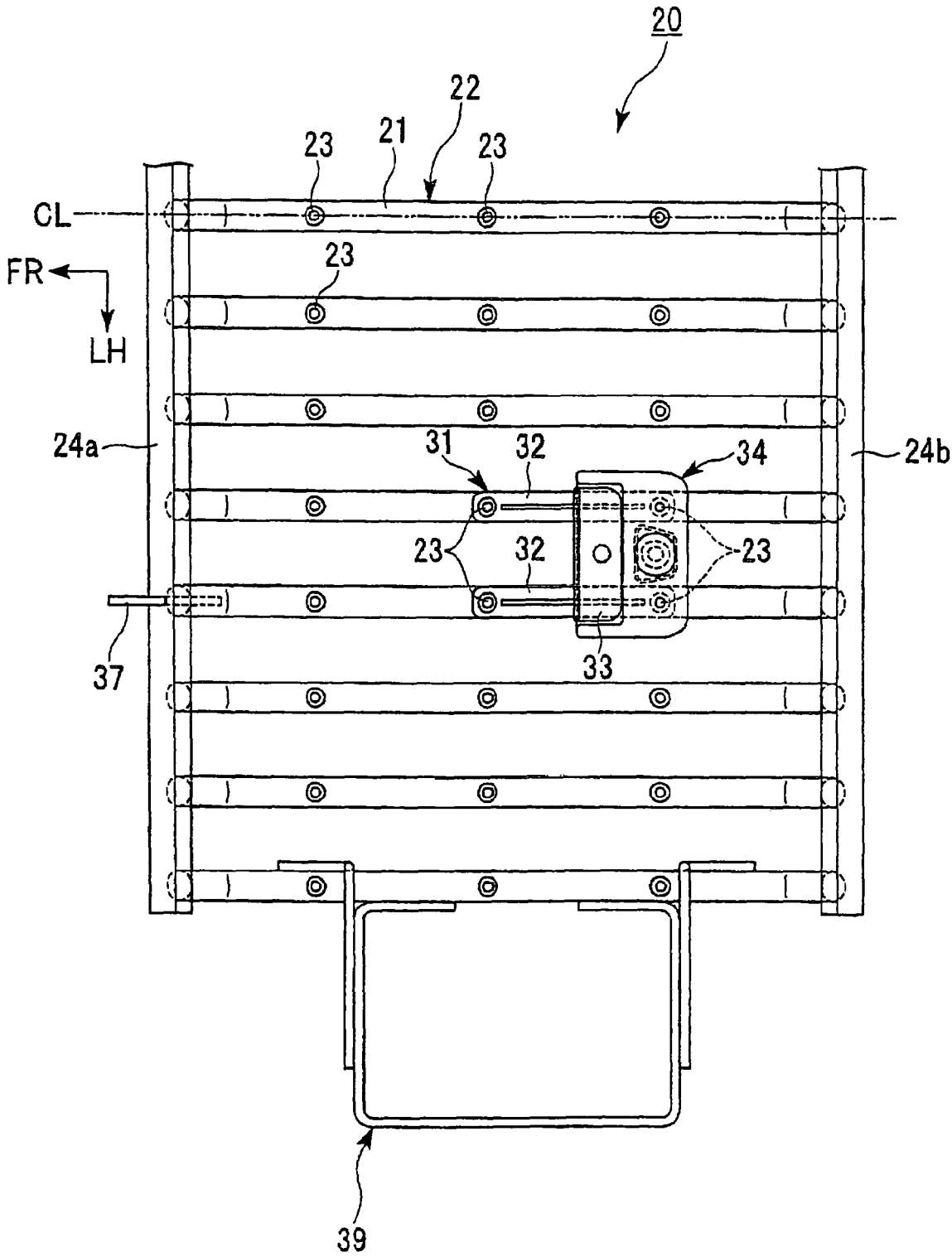
FIG. 7 is a plan view of FIG. 6.

Referring to FIGS. 6 and 7, a weight mount portion 31 adapted to adjust an amount of digging the sand pins 23 in the sand can be installed on the frame 22 of the first beach cleaner 20.

Figure 8A:
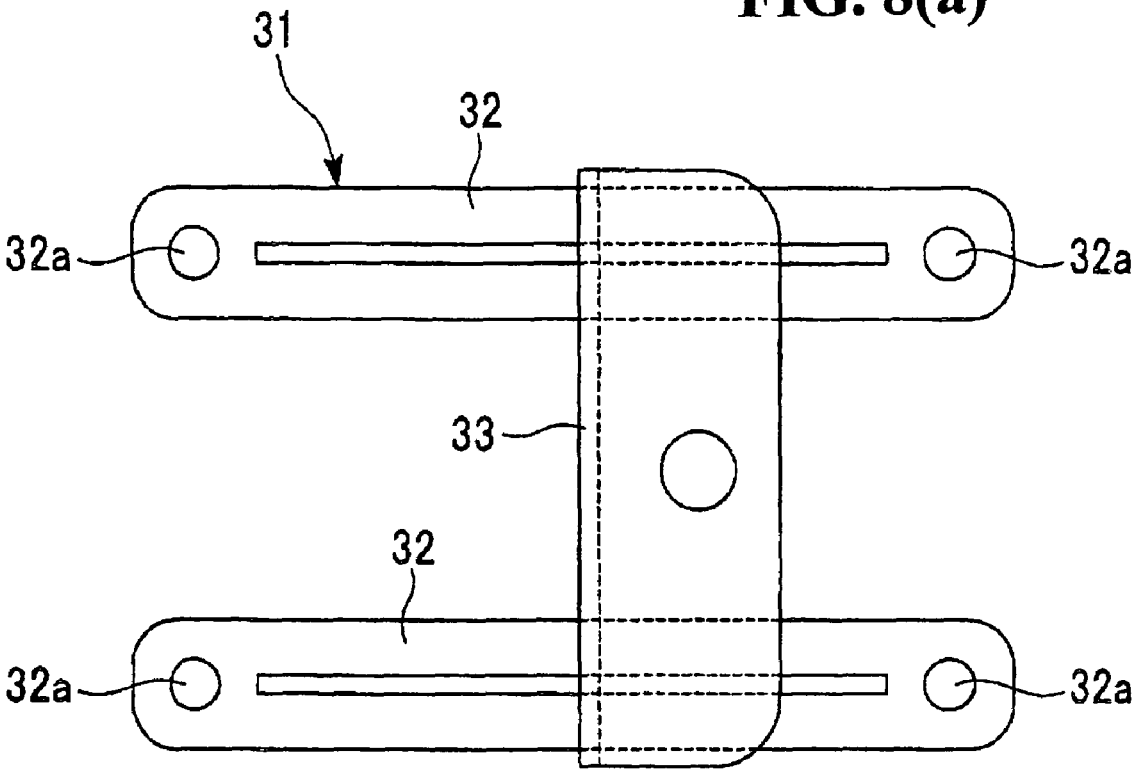
FIG. 8 includes explanatory views of the weight mount portion of FIG. 6, in which FIG. 8(*a*) is a plan view and FIG. 8(*b*) is a side view.
Figure 8B:
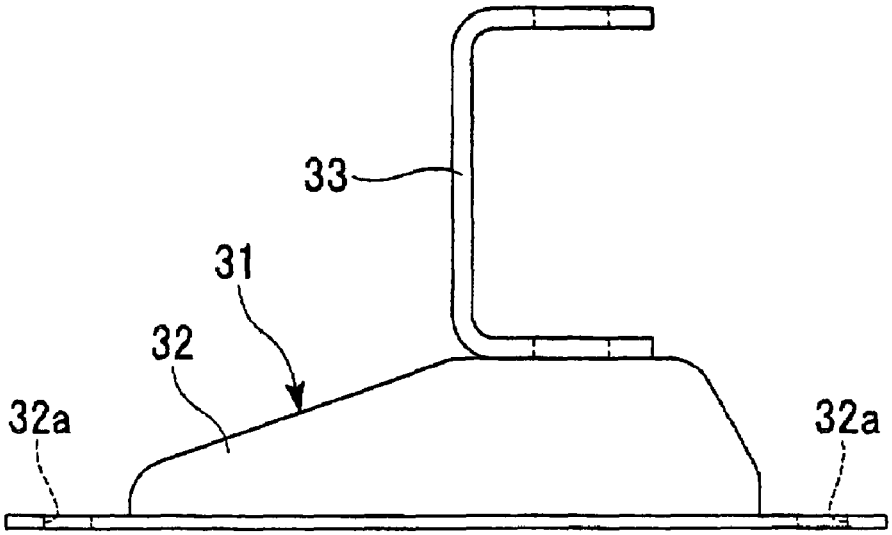

Additionally referring to FIG. 8, the weight mount portion 31 is configured by integrally connecting base parts 32 juxtaposed right and left using a support bracket 33. The base parts 32 are longitudinally long, that is, extend in the back and forth direction and are arranged to have the same left-right width as that of the adjacent longitudinal members 21 of the frame 22. Each base part 32 is formed at its front and rear edges with insertion holes 32*a* adapted to receive the external thread portions 26*a* of the sand pins 23 insertable therethrough. The sand pins 23 are attached to the frame 22 so as to be arranged in the back and forth direction. The support bracket 33 is provided to be mounted on the front-rear intermediate portions of the base parts 32. The support bracket 33 is formed in a U-shape in section opening rearward so as to extend right and left.

The weight mount portion 31 as described above can be attached to a portion of the frame 22 attached with the sand pins 23 by being co-fastened with the sand pins 23. In addition, the weight mount portion 31 can be attached to a portion of the frame 22 attached with no sand pin 23 by means of an associated bolt or the like. In short, the arbitrary number of the weight mount portions 31 can be installed at arbitrary places on the frame 22.

Figure 9:
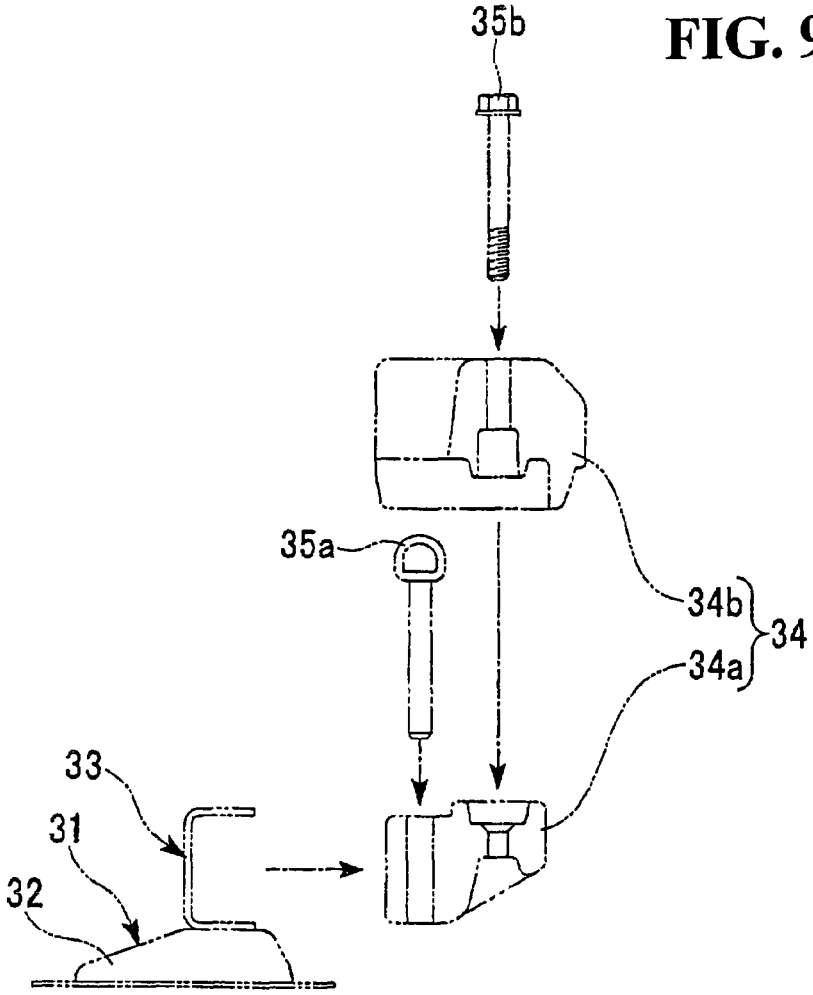
FIG. 9 is an exploded explanatory view of the weight mount portion of FIG. 6 and a weight attached thereto.

Additionally referring to FIG. 9, a weight 34 is configured to be dividable into a lower block 34*a* fitted to the support bracket 33 from the rearward and an upper block 34*b* fitted to the lower block 34*a* from above.

The lower block 34*a* is fixedly connected to the support bracket 33 by a retaining pin 35*a* passing up and down through the lower bracket 34*a* and the support bracket 33 with the front end portion of the lower block 34*a* fitted into the support bracket 33. The upper block 34*b* is fixedly connected to the lower block 34*a* by a connecting bolt 35 passing up and down through the upper block 34*b* and the lower block 34*a* with the lower portion of the upper block 34*b* conforming to the upper portion of the lower block 34*a*.

Figure 10:
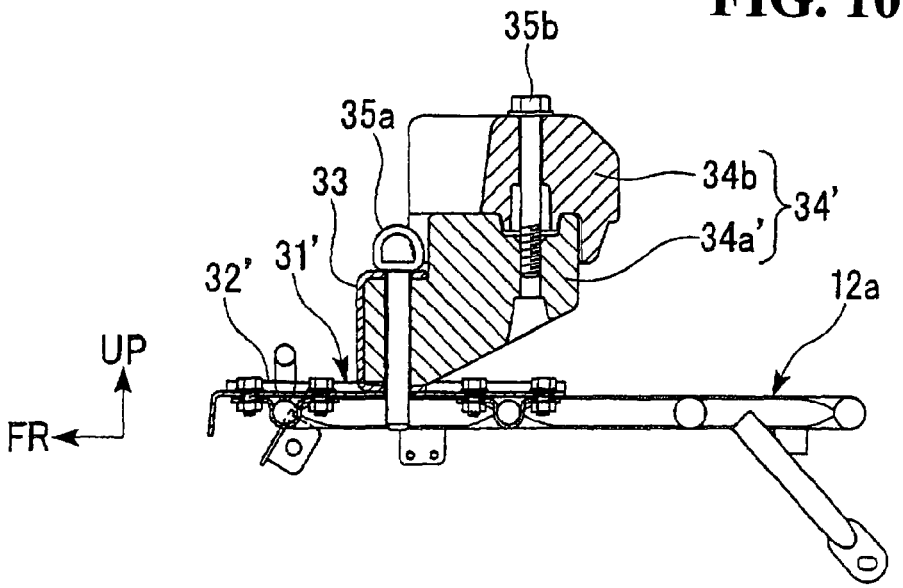
FIG. 10 is a side view of the weight mount portion attached to a front carrier of the towing vehicle.
Figure 11:
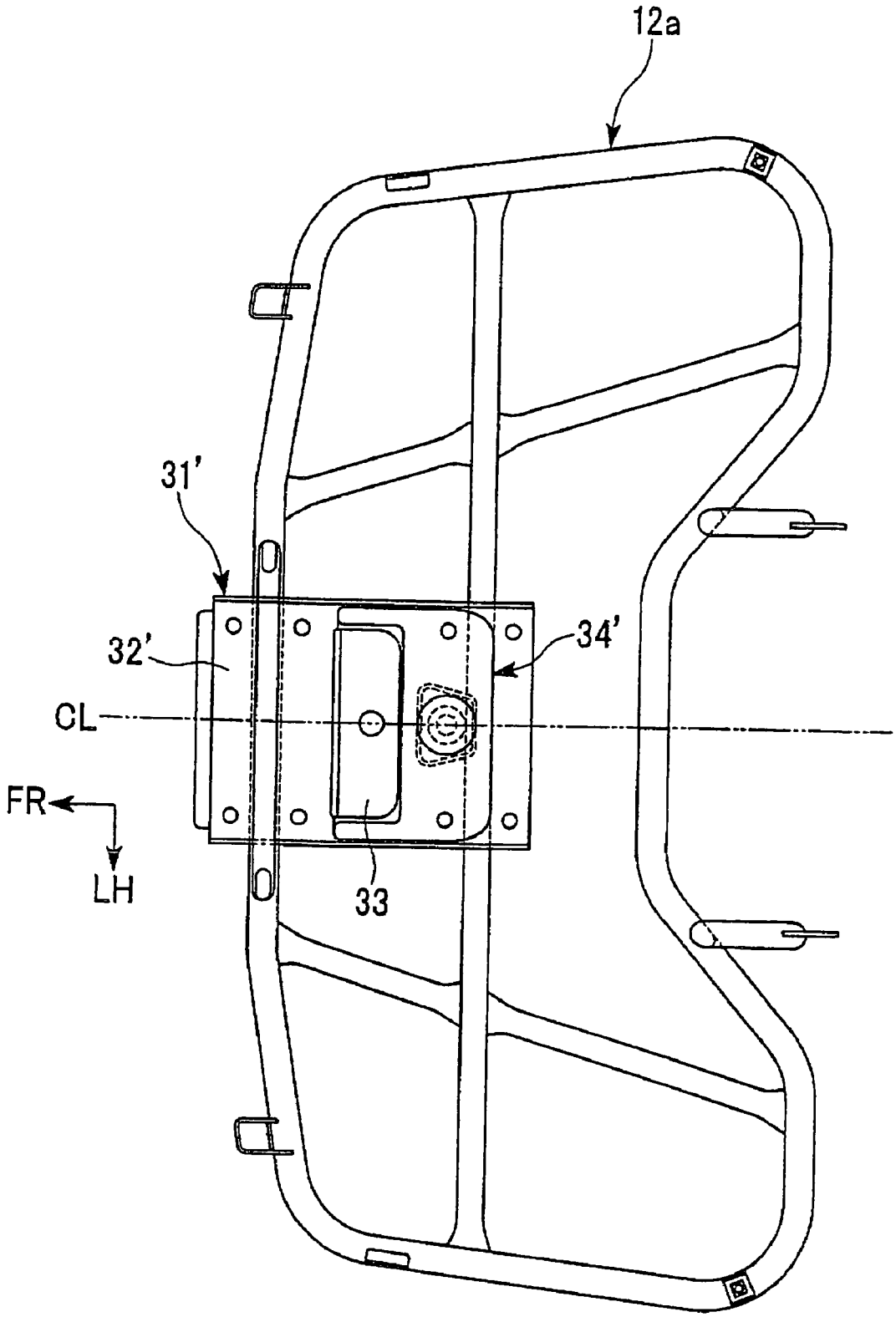
FIG. 11 is a plan view of FIG. 10.

Referring to FIGS. 10 and 11, a desired weight mount portion 31' can be installed on the front carrier 12*a* of the vehicle 1 in order to ensure a load is applied the front wheels for satisfactory driving force even if travel resistance is increased because of the weight 34 mounted on the first beach cleaner 20.

The weight mount portion 31' is integrally configured to include a base part 32' extending along the upper surface of the front carrier 12*a* and a support bracket 33, similar to that of the weight mount portion 31. The base part 32' is formed like a rectangular plate as viewed from above and is detachably attached to pipe members at its front and rear lower surfaces. The pipe members extend in the leftward and rightward direction so as to constitute the front carrier 12*a*.

Figure 12:
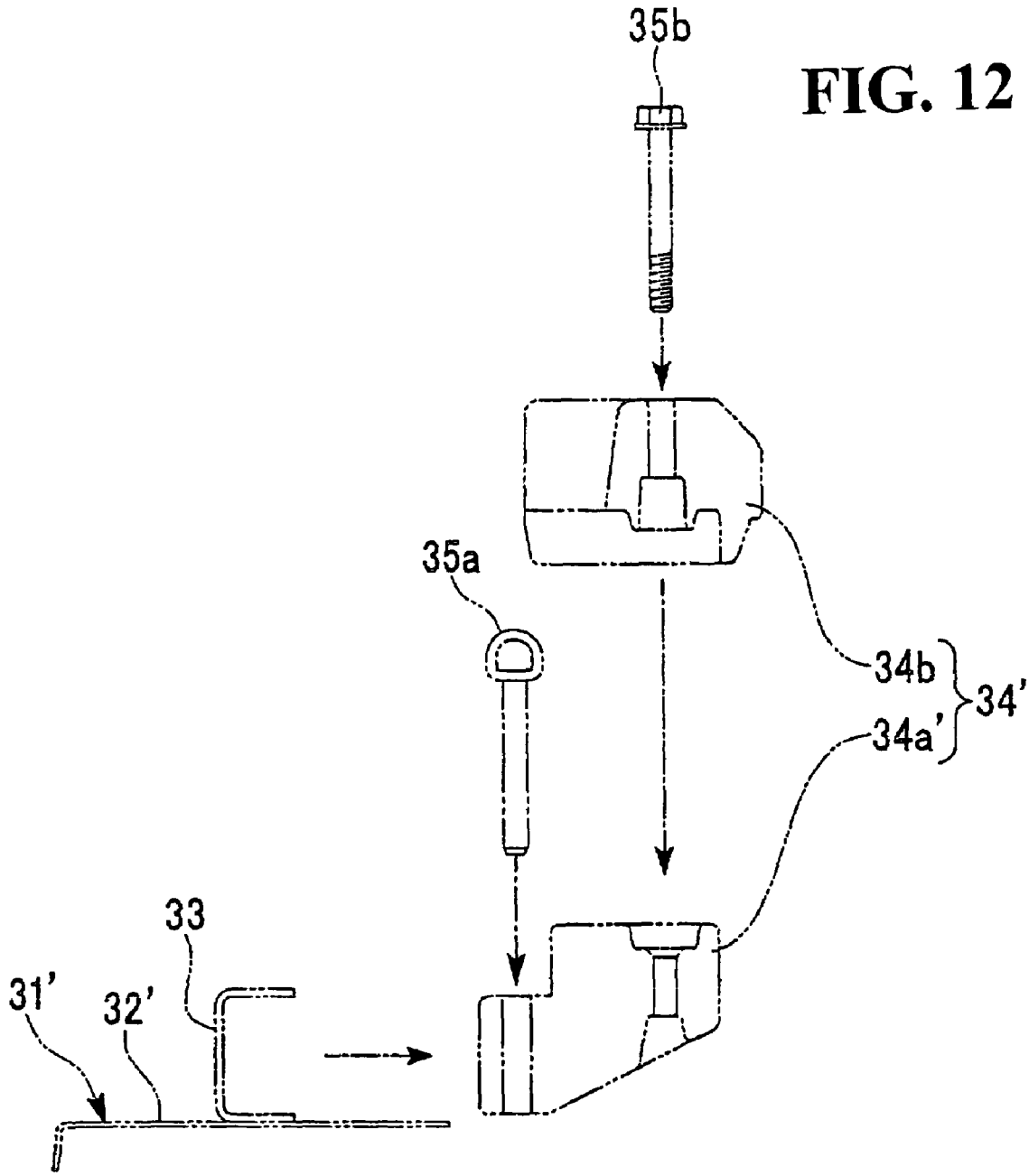
FIG. 12 is an exploded explanatory view of the weight mount portion of FIG. 10 and a weight attached thereto.

Additionally referring to FIG. 12, the weight 34' supported by the weight mount portion 31' is configured to be dividable into a lower block 34*a'* fitted into the support bracket 33 from the rearward and the upper block 34*b* fitted into the lower block 34*a'* from above.

The lower block 34*a'* has a slightly increased amount of rearward extension as compared with the lower block 34*a*. The front end portion of the lower block 34*a'* is fixedly connected to the support bracket 33 with the retaining pin 35*a*. While the lower portion of the upper block 34*b* conforms to the upper rear portion of the lower block 34*a'*, the upper and lower blocks 34*a'*, 34*b* are fixedly connected to each other with the connecting bolt 35*b*. The weight 34' is set in weight to a level greater than the weight 34. When the wheels spin free with respect to the sand, tire chains may be attached to the wheels.

Figure 3:
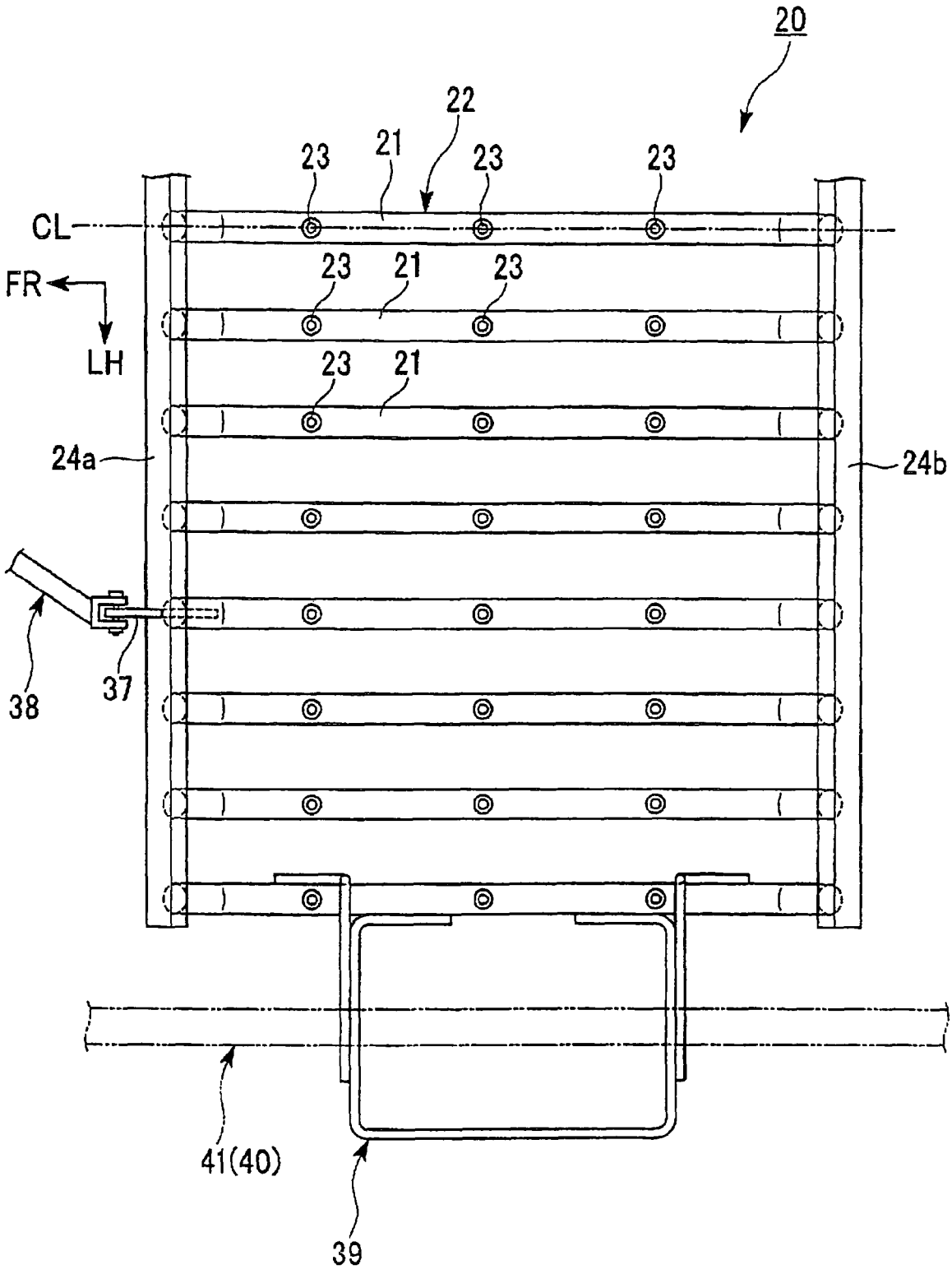
FIG. 3 is a plan view of FIG. 2.
Figure 3A:
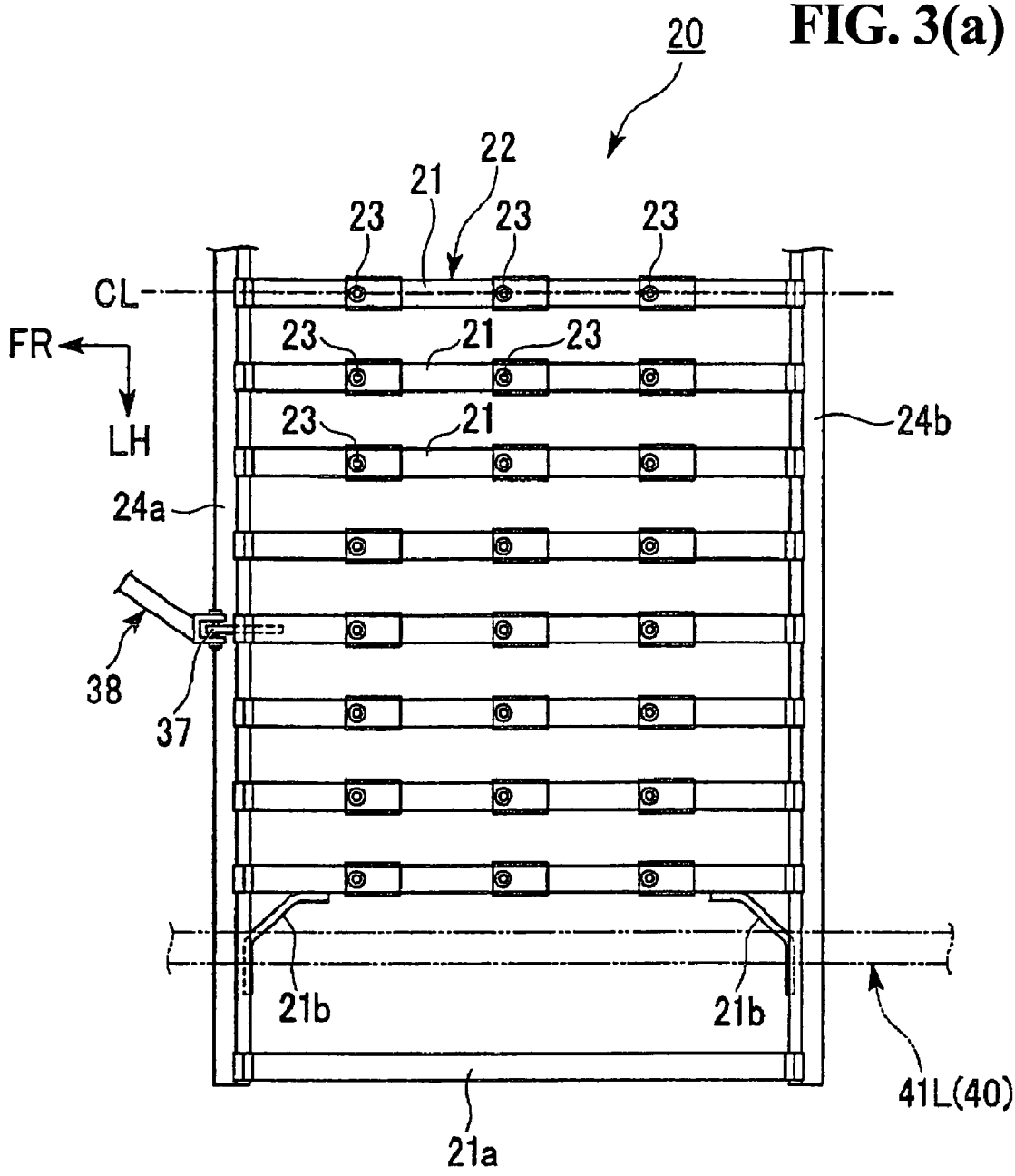
Figure 4A:
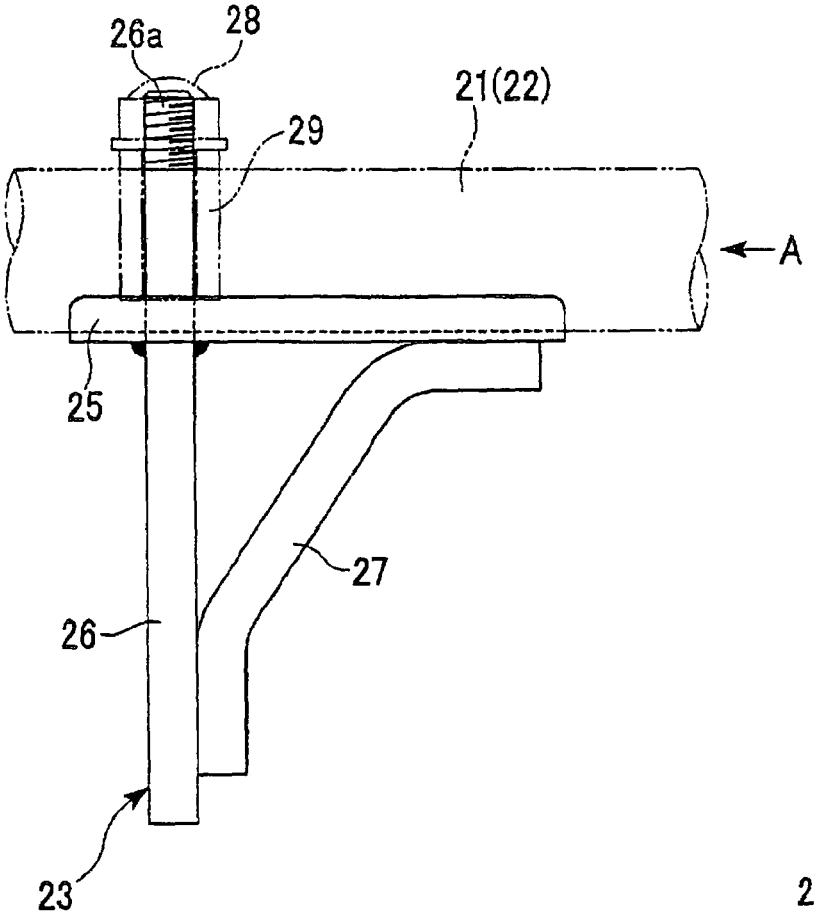
FIG. 4 includes explanatory views of a sand pin of the first beach cleaner, in which FIG. 4(*a*) is a side view and FIG. 4(*b*) is a view as viewed from arrow A of FIG. 4(*a*)
Figure 4B:
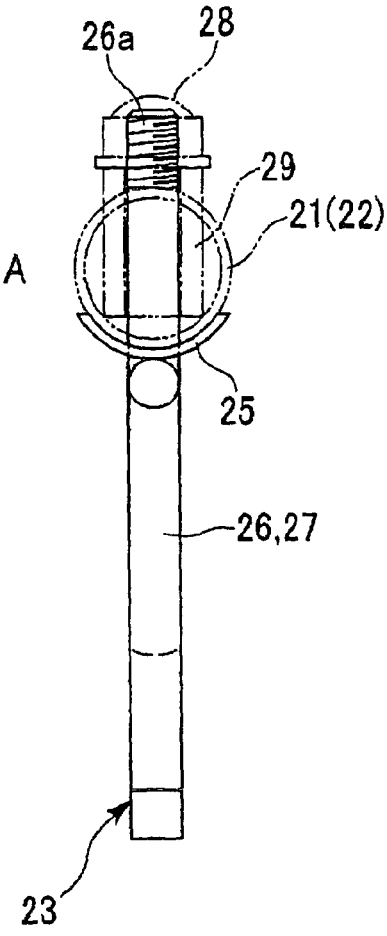
Figure 4C:
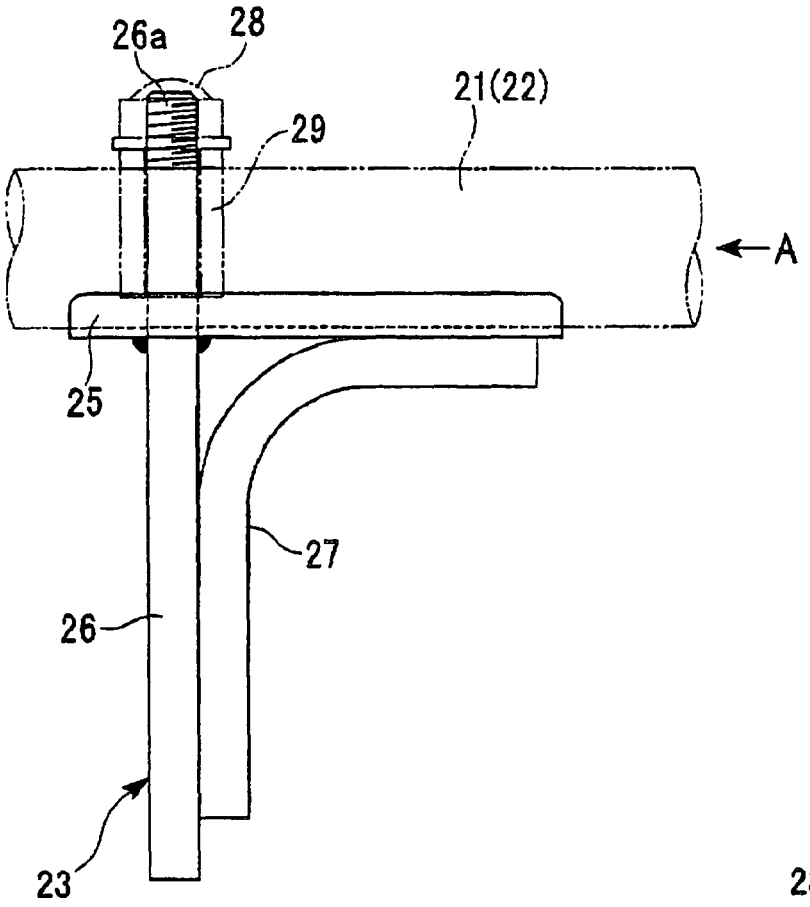
Figure 4D:
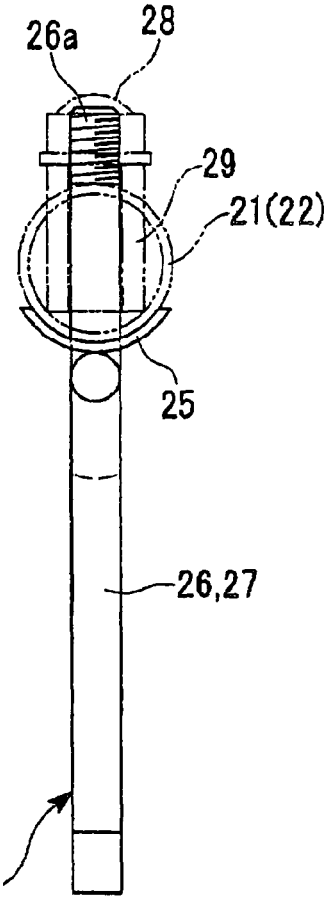
Figure 25:
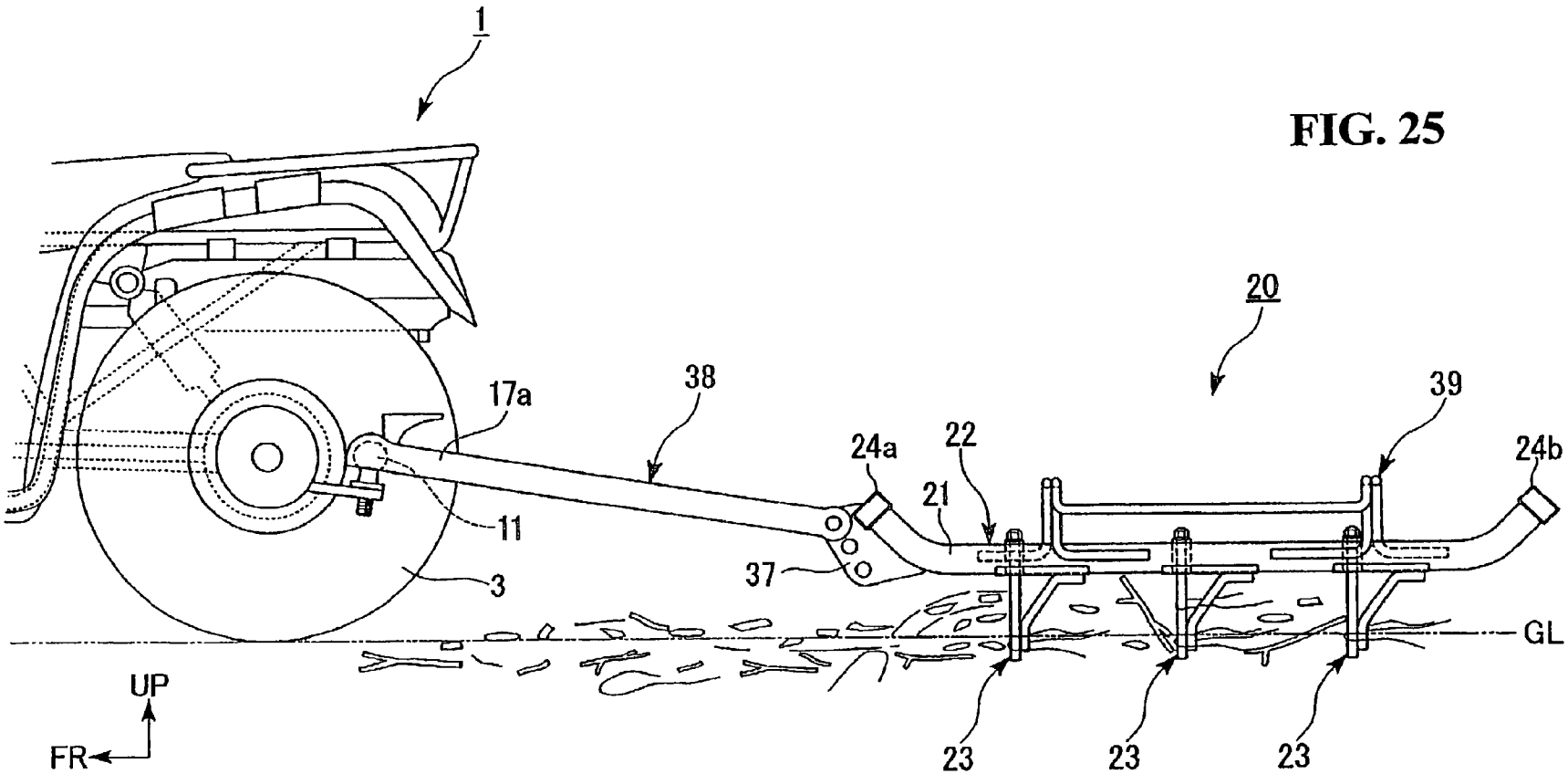
FIG. 25 is a side view illustrating a state where the first beach cleaner is towed by the vehicle.
Figure 25A:
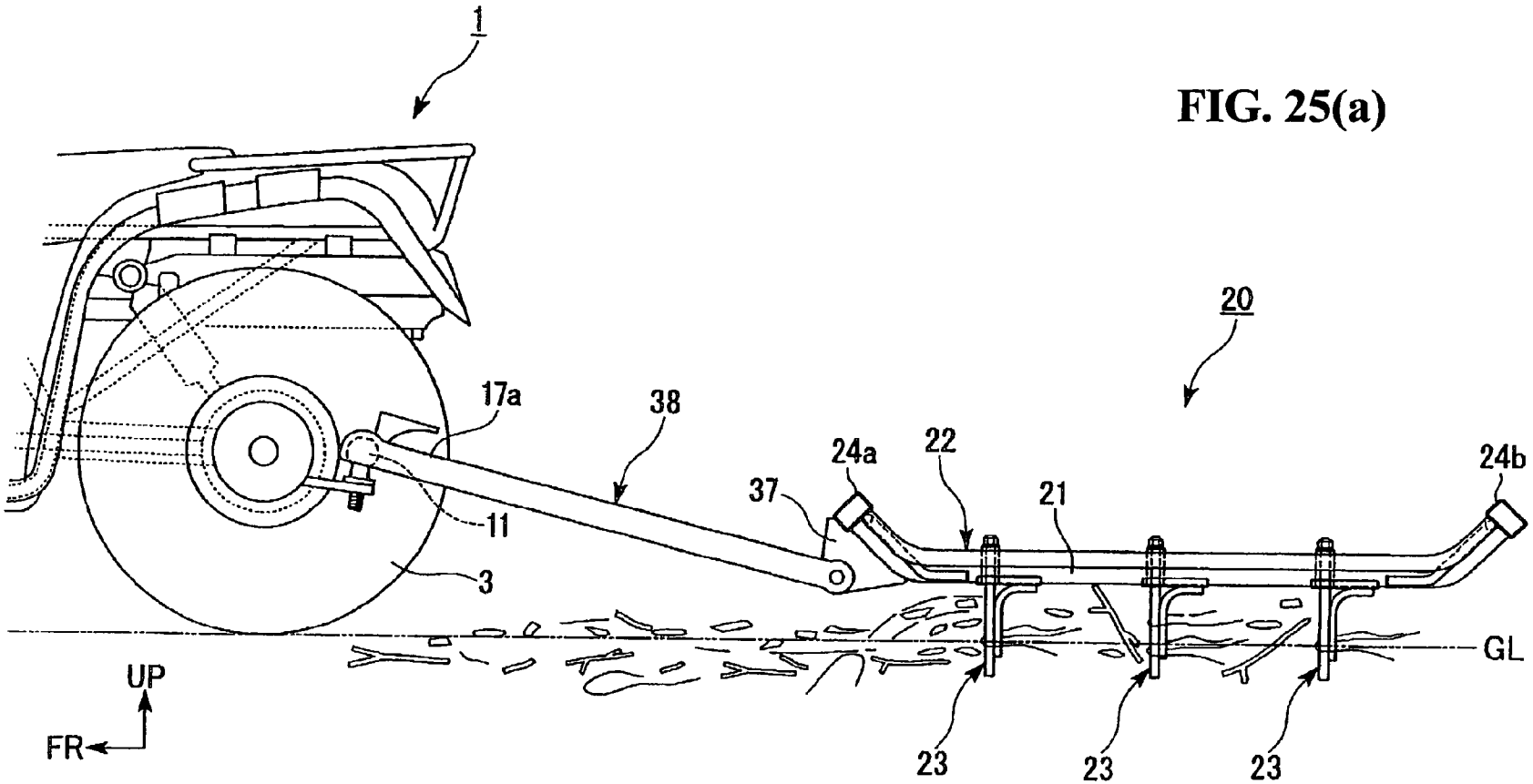

With reference to FIGS. 2 and 3, a tow portion 37 used to by the vehicle 1 to pull the first beach cleaner 20 is provided in front of e.g. a third longitudinal member 21 from each of the left and right outside ends of the frame 22. The tow portion 37 is made of a thick plate extending perpendicular to the leftward and rightward direction and is formed with a plurality of (e.g. three) connecting holes 37*a* so as to be aligned along the inclination of the front end of the longitudinal member 21. One end of the tow rod 38 is connected to any one of the connecting holes 37*a*. The other end of the tow rod 38 is connected to the trailer hitch 11 of the vehicle 1. Thus, the first beach cleaner 20 is towed by the vehicle 1 via the tow rod 38 (see FIG. 25).

In this case, the optimum towing position according to the digging of the first beach cleaner 20 into the sand can be set by connecting one end of the tow rod 38 to one of the connecting holes 37*a*. Additionally referring to FIG. 14, the tow rod 38 extends from the one end side coupled to the trailer hitch 11 toward the left and right tow portions 37 so as to be V- or Y-shaped as viewed from above. The hitch coupler 17*a* associated with the trailer hitch 11 is provided at the one end side.

Lift arms 39 are provided on the left and right outside of the frame 22 so as to protrude leftward and rightward, respectively, from the outside end of the frame 22. The lift arm 39 is formed like a horizontally long rectangular frame, for instance, as viewed from above. In the lift arm, the left-right intermediate portion is formed almost horizontally, the left-right inside portion is formed to bend obliquely downward and inward, and the left-right outside portion is formed to bend obliquely downward and outwardly. The left-right width between the outside ends of the left and right lift arms 39 is greater than the left-right width of the left and right side structures 41 of the waste recovery station 40. When the first beach cleaner 20 towed by the vehicle 1 enters between the left and right side structures 41, the left and right lift arms 39 ride on the left and right side structures 41, respectively, whereby the first beach cleaner 20 is lifted up at a desired amount. Incidentally, the distance between the left and right side structures 41 is greater than the left-right width of the vehicle 1, so that the vehicle 1 can pass between the left and right side structures 41.

Referring to FIGS. 2(*a*) and 3(*a*), a tow portion 37 used by the vehicle 1 to pull the first beach cleaner 20 is provided forward of, e.g. each of third longitudinal members 21 from the leftward and rightward external side ends of the frame 22. The tow portion 37 is formed like a thick plate disposed to extend in a direction perpendicular to the leftward and rightward direction and formed with a coupling hole 37*a* at its front end. A tow rod 38 has one end coupled to the trailer hitch 11 of the vehicle 1 and the other end coupled to the coupling hole 37*a*. Thus, the first beach cleaner 20 is towed by the vehicle 1 through the tow rod 38 (See FIG. 25(*a*)).

A plurality of the coupling holes 37*a* is formed to be arranged up and down. This makes it possible to set an optimum tow position according to sinking of the first beach cleaner 20 into the sand soil by coupling the other end of the tow rod 38 to which one of the coupling holes 37*a*. Additionally referring to FIG. 14(*b*), the tow rod 38 extends from the one end side coupled to the trailer hitch 11 toward the left and right tow portions 37 so as to be V- or Y-shaped as viewed from above. The hitch coupler 17*a* associated with the trailer hitch 11 is provided at the one end side.

Figure 13:
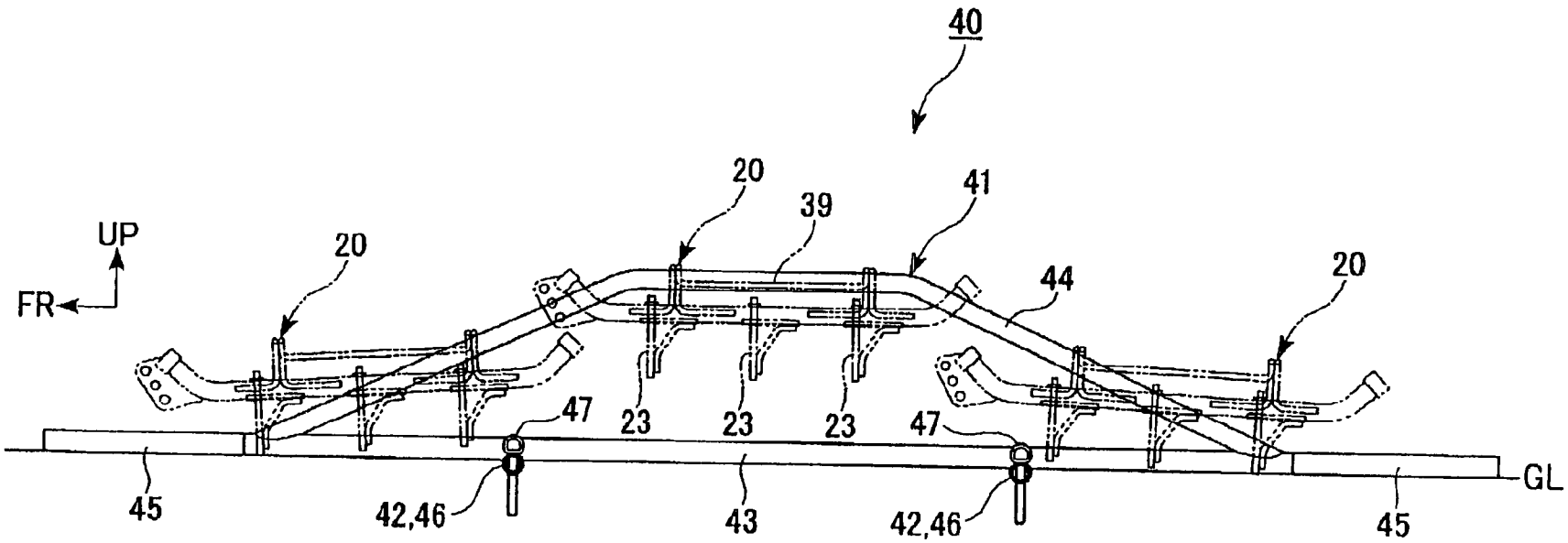
FIG. 13 is a side view of a waste recovery station according to the embodiment.
Figure 13A:
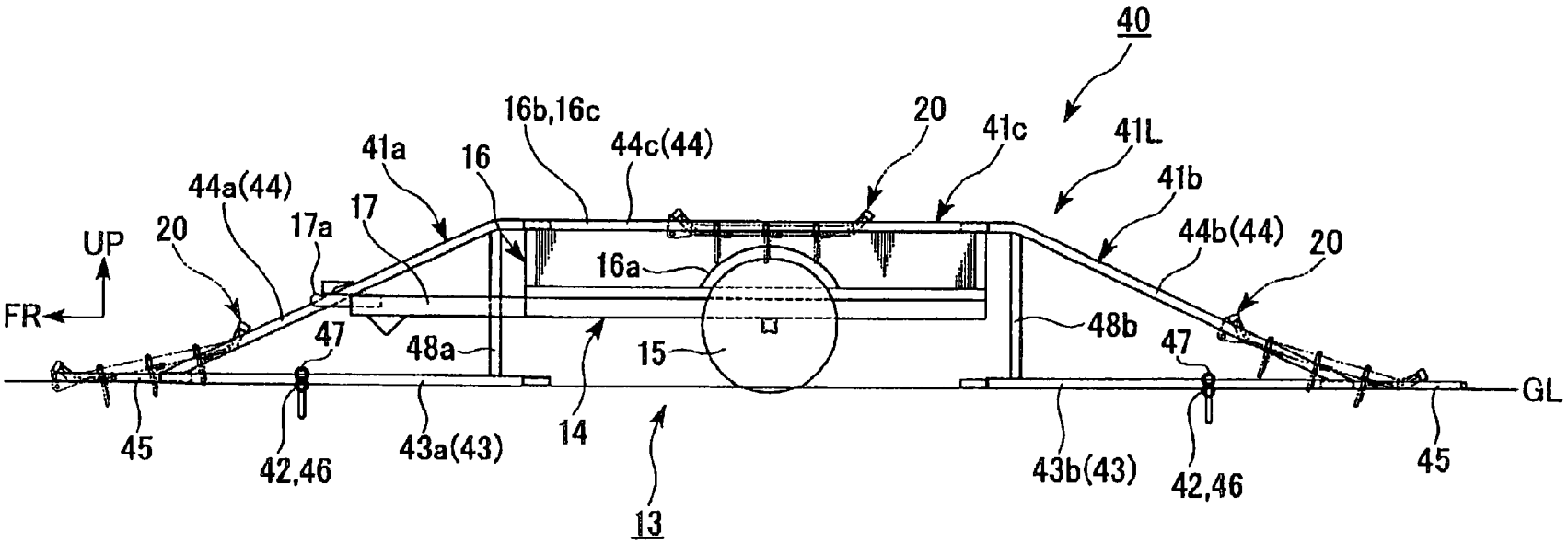
Figure 13B:
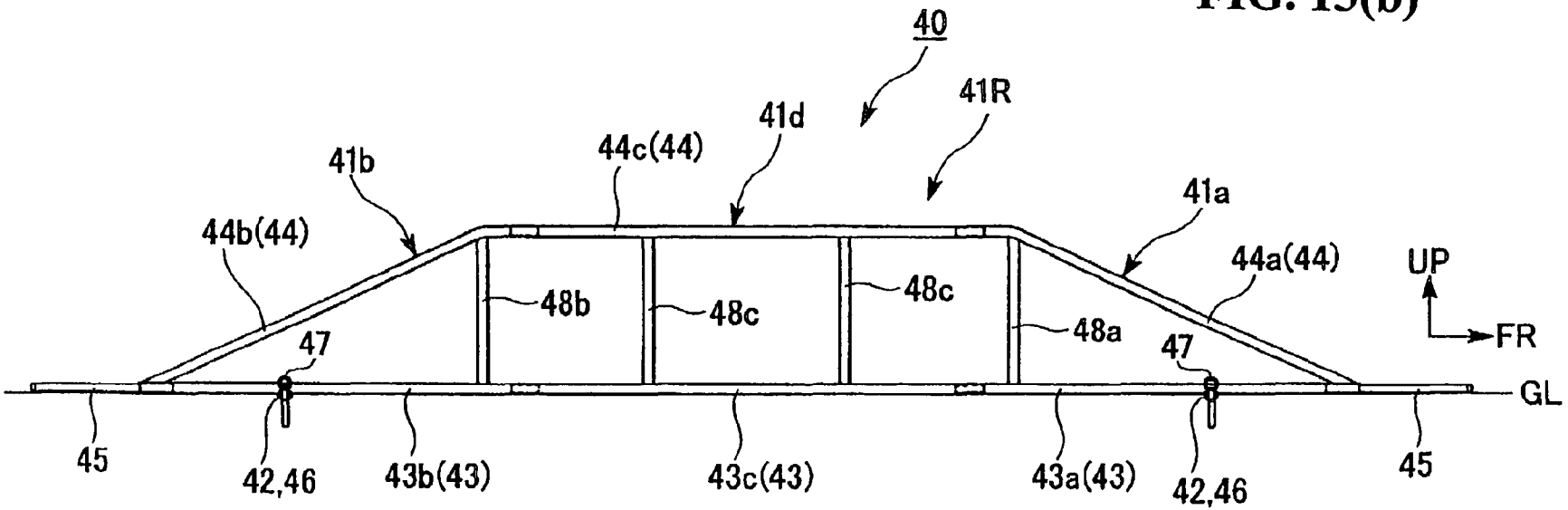

Referring to FIGS. 13, 13(*a*) and 14, when the first beach cleaner 20 is lifted up on the waste recovery station 40, the sand pins 23 are sufficiently spaced apart from the upper surface of the sand area and the waste raked up by the sand pins 23 can be allowed to drop. Thus, the waste can be collectively recovered.

The waste recovery station 40 is configured by integrally connecting the left and right side structures 41 with a pair of front and rear connecting members 42. The waste recovery station 40 is configured to be symmetrical with respect to the front and rear thereof and to the left and right thereof for instance.

The left and right side structures 41 are each formed such that a guide member 44 is attached on a bar-like grounded member 43 and the front and rear ends of both the members 43, 44 are integrally coupled to each other. The guide member 44 is made of, e.g. a circular steel tube and formed like a gentle mountain, which is symmetrical with respect to the front and rear thereof as viewed from the side. The grounded member 43 is made of, e.g. a circular steel tube and extends in the back and forth direction.

Referring to FIGS. 13(*b*) and 14(*a*), the waste recovery station 40 is configured by integrally connecting the left and right side structures 41L and 41R with a pair of front and rear connecting members 42. The waste recovery station 40 is configured to be symmetrical with respect to the front and rear thereof and to the left and right thereof except the structures of the intermediate portions of the side structures 41R, 41L.

Each of the left and right side structures 41L, 41R is formed in a trapezoid as viewed from the side such that a guide member 44 is attached on a grounded member 43 and the front and rear ends of both the members 43, 44 are integrally coupled to each other. The guide member 44 is made of, e.g., a circular steel tube and is formed like a gentle mountain as viewed from the side. The grounded member 43 is made of, e.g. a circular steel tube and extends in the back and forth direction.

Foot members 45 are detachably attached to the front and rear ends of each of the left and right grounded members 45 so as to bend so that they are located further leftward or rightward outward as going forward or rearward as viewed from above. The foot members 45 are placed on the sand area together with the grounded members 43, whereby the waste recovery station 40 is stably installed while increasing its installation area.

Figure 14:
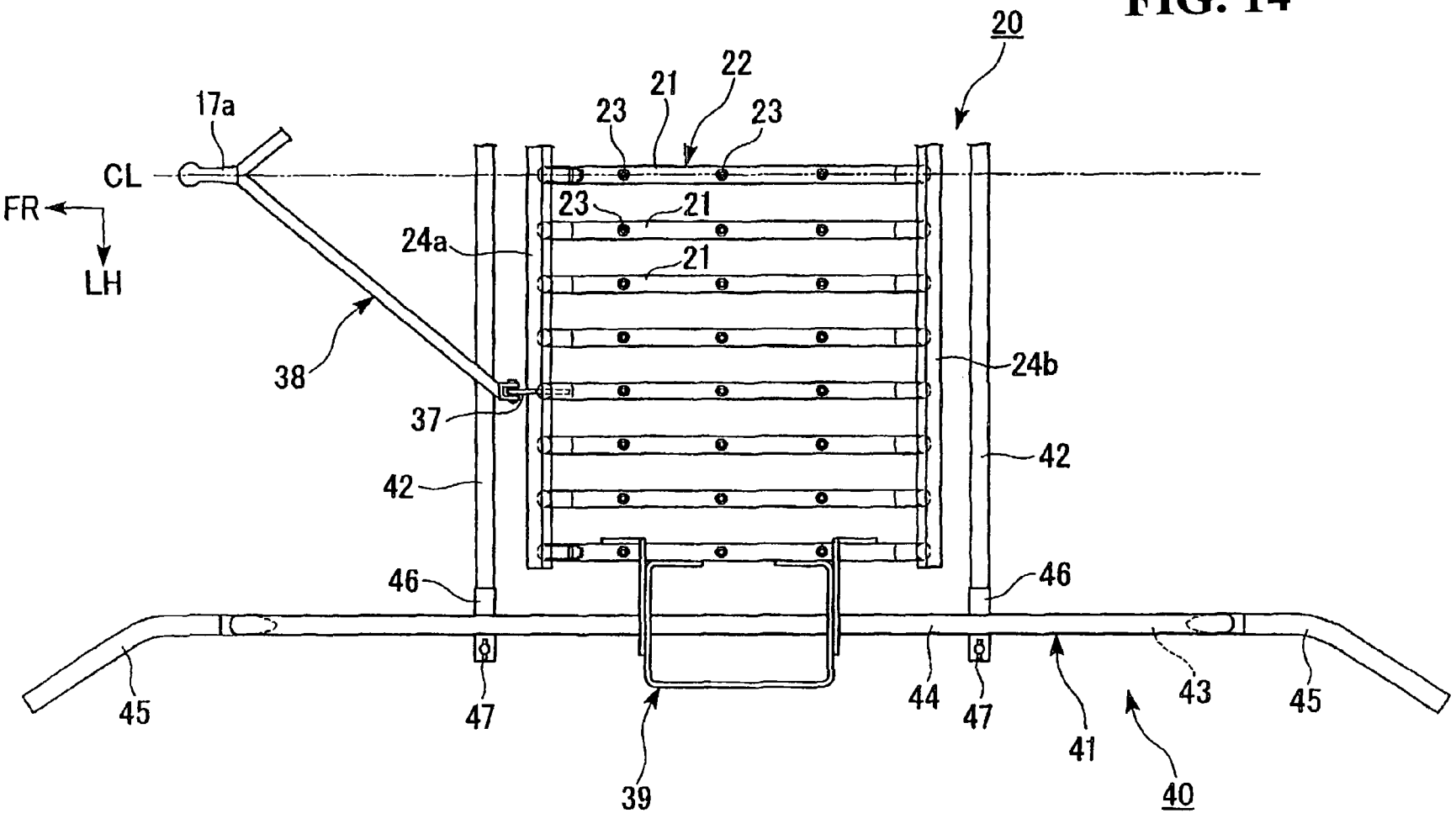
FIG. 14 is a plan view of FIG. 13.
Figure 14A:
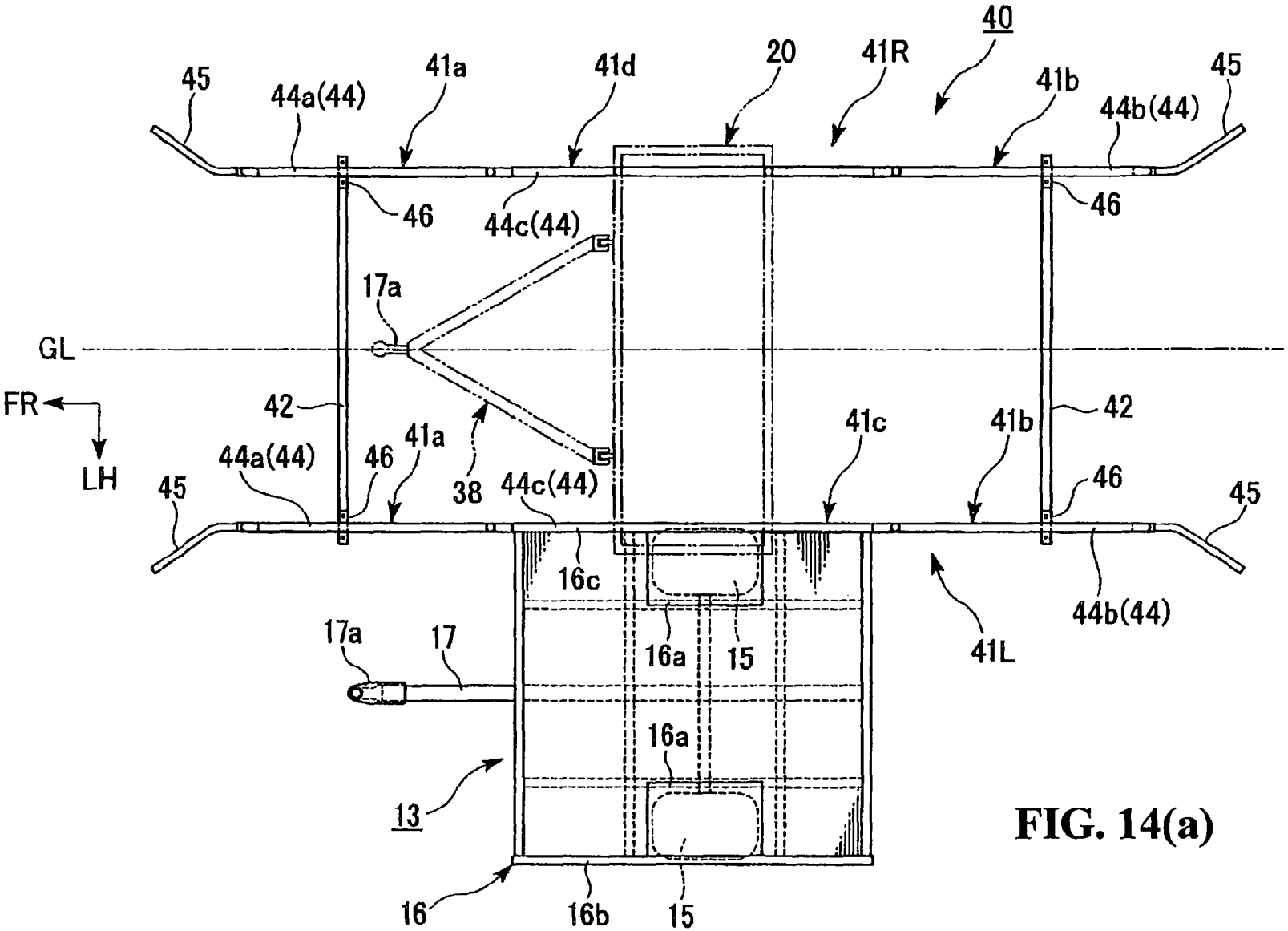
Figure 15:
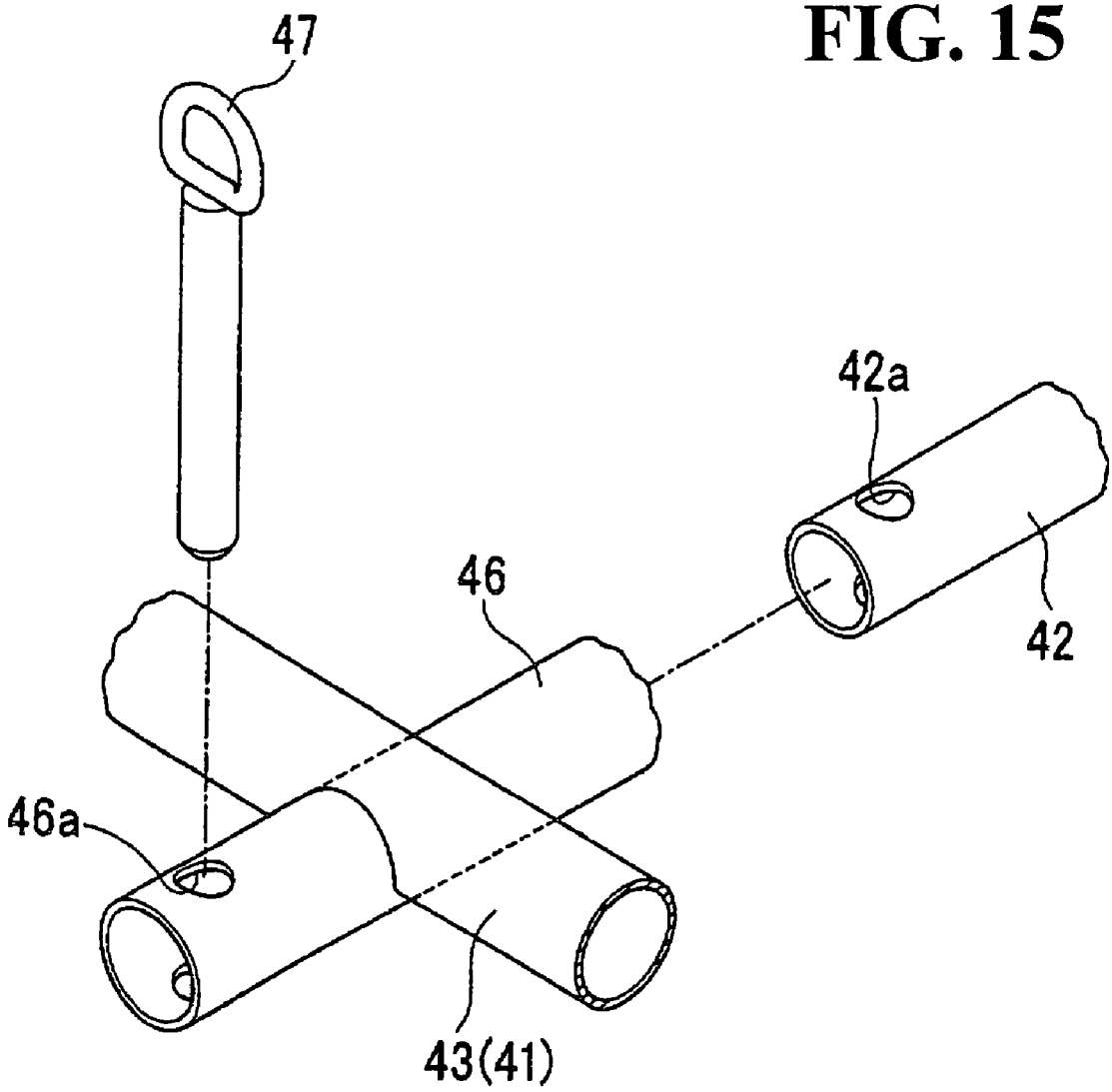
FIG. 15 is a perspective view for assistance in explaining the dividing structure portion of the waste recovery station.

Additionally referring to FIG. 15, the connecting member 42 is made of, e.g. a circular steel tube and extends in the leftward and rightward direction. An end of the connecting member 42 is detachably inserted into a connection pipe 46 disposed under each of the front or rear portions of the grounded member 43. In this state, the left and right side structures 41 (41R and 41L in FIG. 14(*a*)) are integrally connected to each other. In other words, since the waste recovery station 40 has a relatively large size, it is made dividable into a plurality of divided bodies (the left and right side bodies 41 and the front and rear connecting members 42). In FIG. 14(*a*), the left and right side structures 41R, 41L are each made dividable into three divided bodies in the back and forth direction. More specifically, the left side structure 41L is dividable into a front divided body, a left intermediate divided body 41*c* and a rear divided body 41*b* and the right side structure 41R is dividable into the front divided body 41*a*, a right intermediate divided body 41*d* and the rear divided body 41*b*.

The connecting pipe 46 associated with the grounded member 43 is made of a relatively short circular steel tube and extends in the leftward and rightward direction. The connecting pipe 46 is integrally connected to the grounded member 43 in such a manner that its upper external circumference conforms to the lower notch of the grounded member 43. In other words, the connecting pipe 46 projects downwardly from the lower surface of the grounded member 43. When the waste recovery station 40 is installed on the sand area, the connecting pipes 46 dig into sand to suppress movement of the waste recovery station 40.

An end of the connecting member 42 is inserted into the connecting pipe 46 at a predetermined amount, thereby providing an assembled state (for example, a state where the outer edge of the connecting pipe 46 is made to coincide with the outer edge of the connecting member 42). In this state, upper and lower through-holes 46*a* formed in the connecting pipe 46 are respectively superposed on upper and lower through-holes 42*a* formed in the connecting member 42 at positions on the leftward and rightward oust side of the grounded member 43, for example. A desired retaining pin 47 is inserted into the upper and lower through-holes 42*a*, 46*a* to unremovably connect the connecting member 42 with the grounded member 43 in the assembled state.

The retaining pin 47 passes through the connecting member 42 and the connecting pipe 46, further projecting downwardly, and is dug into sand at a desired amount. Thus, the retaining pins 47 suppress movement of the waste recovery station 40 from the predetermined installation site. If the retaining pins 47 are removed and the connecting members 42 are detached from the connecting pipes 46, the waste recovery station 40 can be divided into the left and right side structures 41 (41L and 41R in FIG. 14(*a*)) and the front and rear connecting members 42.

Referring to FIGS. 13(*a*), 13(*b*) and 14(*a*), the front divided body 41*a* of each of the left and right side structures 41L, 41R mainly includes a front slant section 44*a* of the guide member 44; a front horizontal section 43*a* of the grounded member 43 located below the front slant section 44*a*; and a front support member 48*a* extending almost vertically so as to be spanned between the respective rear ends of the front slant section 44*a* and the front horizontal section 43*a*.

The rear divided body 41*b* mainly includes a rear slant section 44*b* of the guide member 44; a rear horizontal section 43*b* of the grounded member 43 located below the rear slant section 44*b*; and a rear support member 48*b* extending almost vertically so as to be spanned between the respective front ends of the rear slant section 44*b* and the rear horizontal section 43*b*. In this embodiment, the front and rear divided bodies 41*a*, 41*b* have the same shape, so that they can be reversed.

In the embodiment, the left intermediate divided body 41*c* is constituted of a portion of the trailer 13, which is being towed. Specifically, the right side portion 16*c* of the loading part 16 in the trailer 13 being towed is a single almost-horizontal bar and forms an almost-horizontal upper section 44*c* of the guide member 44. In the trailer 13 which is being towed, the right side portion 16*c* which is a right upper edge portion of the loading part 16 has a height approximately equal to that of the upper side section 44*c* of the guide member 44 in the state where the waste recovery station 40 is installed on the sand area (usage state). The trailer 13 can be self-sustained by support legs, not shown, in the towed state.

The rear end of the front slant section 44*a* of the front divided body 41*a* is removably connected to the front end of the right side portion 16*c*. The front end of the rear slant section 44*b* of the rear divided body 41*b* is removably connected to the rear end of the right side portion 16*c*. The front and rear ends of the right side portion 16*c* can be unremovably connected to the rear end of the front slant section 44*a* and to the front end of the rear slant section 44*b*, respectively, by providing desired locking devices. If the locking devices are released, the right side portion 16*c* and the front and rear slant sections 44*a*, 44*b* can be divided.

In this way, the right side portion 16*c* of the trailer 13 constitutes a portion of the left side structure 41L. In the installation state of the waste recovery station 40, the trailer 13 will be located on the left side thereof so as to be directly adjacent thereto.

The right intermediate divided body 41*d* mainly includes the almost horizontal upper side section 44*c* of the guide member 44; an intermediate horizontal section 43*c* of the grounded member 43 located below the upper side section 44*c*; and a plurality of (a pair in the embodiment) of intermediate support members 48*c* which extend almost vertically so as to be spanned between the upper side section 44*c* and the intermediate horizontal sections 43*c*. The right intermediate divided body 41*d* is formed like a ladder as viewed from the side. The rear end of the front slant section 44*a* of the front divided body 41*a* can be removably connected to the front end of the upper side section 44*c*. The front end of the rear slant section 44*b* of the rear divided body 41*b* is removably connected to the upper side section 44*c*. The rear end of the front horizontal section 43*a* of the front divided body 41*a* is removably connected to the front end of the intermediate horizontal section 43*c*. The front end of the rear horizontal section 43*b* of the rear divided body 41*b* is removably connected to the rear end of the intermediate horizontal section 43*c*.

The front and rear ends of the upper side section 44*c* can be unremovably connected to the rear end of the front slant section 44*a* and to the front end of the rear slant section 44*b*, respectively, by providing desired locking devices. If the locking devices are released, the upper side section 44*c* and the front and rear slant sections 44*a*, 44*b* can be divided. Similarly, the front and rear ends of the intermediate horizontal sections 43*c* can be unremovably connected to the rear end of the front horizontal section 43*a* and to the front end of the rear horizontal section 43*b*, respectively, by providing desired locking devices. If the locking devices are released, the intermediate horizontal section 43*c* and the front and rear horizontal sections 43*a*, 43*b* can be divided. A member corresponding to the intermediate horizontal section 43*c* may be provided for the left side structure 41L.

Similarly to the right side portion 16*c*, the almost-horizontal left side portion 16*b* in the loading part 16 of the trailer 13 can be used as the upper side section 44*c* of the guide member 44. The left-right width between the left and right side portions 16*b*, 16*c* is approximately equal to the left-right width between the left and right side structures 41L, 41R. The front ends of the rear slant sections 44*b* of the rear divided bodies 41*b* are connected to the rear ends of the left and right side portions 16*b*, 16*c* of the loading part 16. This makes it possible to reproduce the configuration of the rear half portion of the installed waste recovery station 40 (see FIGS. 34 and 35). In this case, the left and right rear divided bodies 41*b* may be connected by the connecting member 42.

In this way, the first beach cleaner 20 (and the second beach cleaner 50) loaded on the loading part 16 can be unloaded on a sand area along the upper side sections 44*c* and rear slant sections 44*b* of the left and right guide members 44. In addition, the first beach cleaner 20 (and the second beach cleaner 50) on the sand area can lifted up on the loading part 16 along the rear slant sections 44*b* and upper side sections 44*c* of the left and right guide members 44. The state where the rear divided bodies 41*b* are connected to the left and right side portions 16*b*, 16*c* as described above may be referred to as loading and unloading state of the trailer 13.

Figure 16:
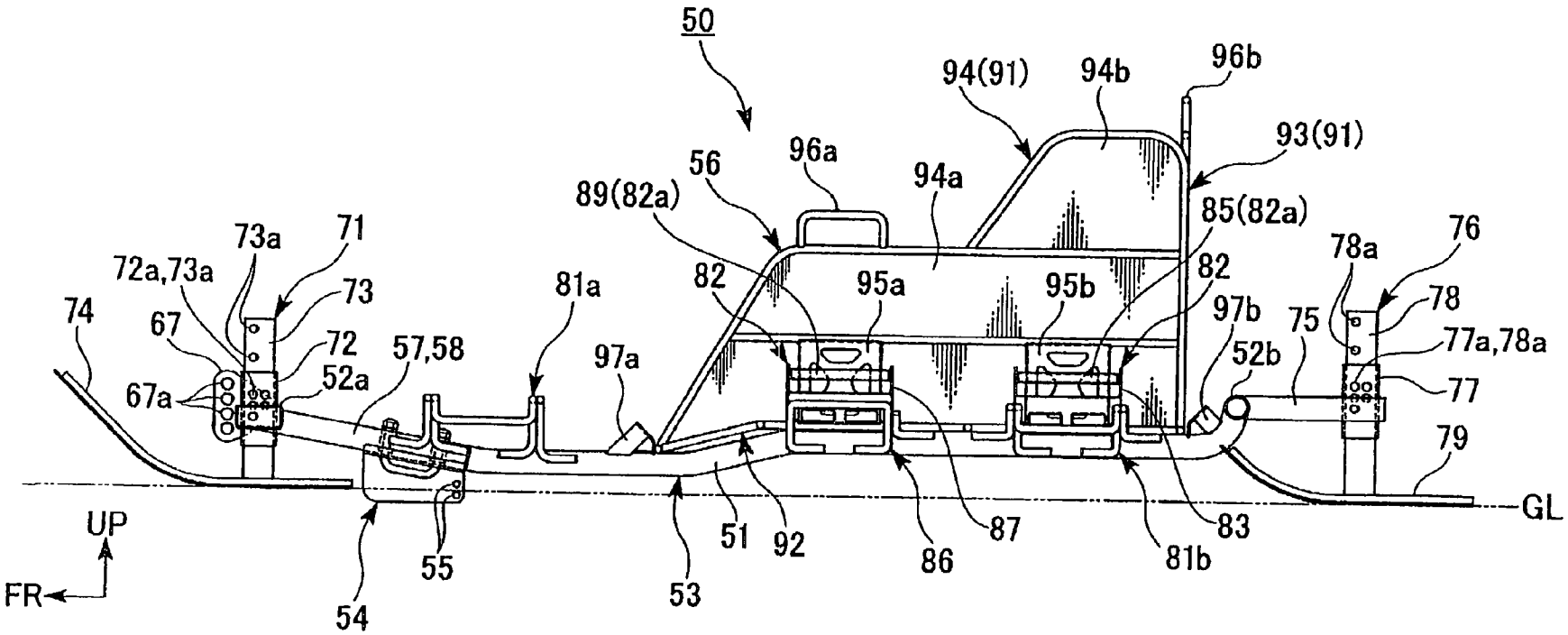
FIG. 16 is a side view of a second beach cleaner according to the embodiment.
Figure 17:
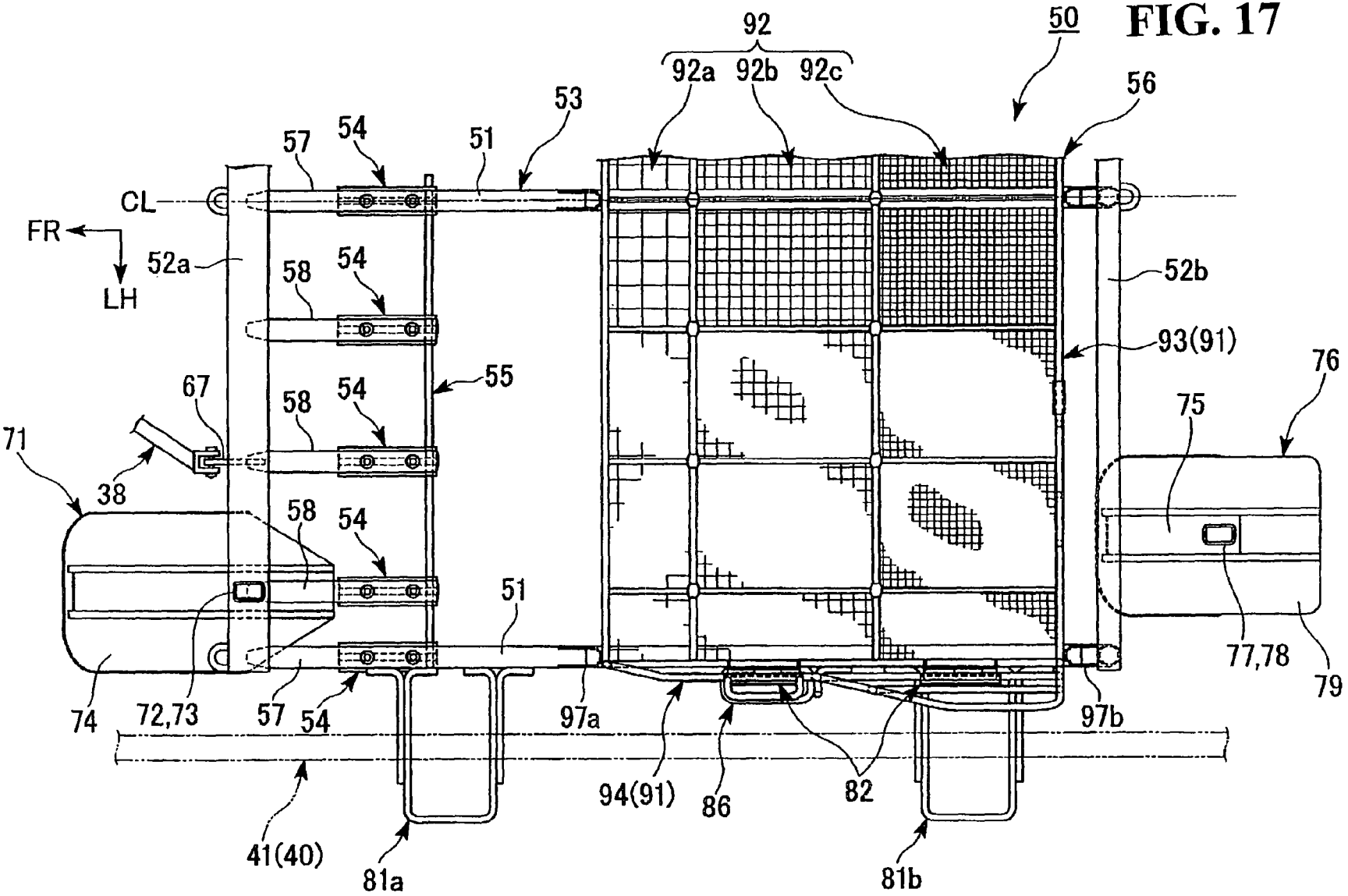
FIG. 17 is a plan view of FIG. 16.

Referring to FIGS. 16 and 17, the second beach cleaner 50 (sand screen) mainly includes a plurality of (e.g. three) longitudinal members 51 extending in the traveling direction of the vehicle; and front and rear lateral members 52*a*, 52*b* extending in the widthwise direction (the leftward and rightward direction) so as to be perpendicular to the longitudinal members 51. The longitudinal members 51 and the lateral members 52*a*, 52*b* form a frame 53. The frame 53 is provided at its front portion with keels 54 and scrapers 55 described later and at its rear portion with a net 56 described later. The second beach cleaner 50 is also configured to be symmetrical, The longitudinal member 51 is made of, e.g. a circular steel tube and extends in the back and forth direction. The longitudinal member 51 is moderately cranked at its intermediate portion as viewed from the side so that its rear portion is shifted slightly upward from the front portion thereof. A central portion of the front portion of the longitudinal member 51 moderately bends so that a front half portion of the front portion is provided to slant forwardly and slightly upwardly. The front half portion of the front portion of the longitudinal member 51 is hereinafter referred to as the front slant portion 57. On the other hand, the rear end of the longitudinal member 51 is provided to bend upwardly. The longitudinal member 51 may be made of a rectangle steel tube.

A plurality of the longitudinal members 51 are juxtaposed left and right so as to be superposed as viewed from the side.

The longitudinal member 51 is abutted at its front end against the front lateral member 52*a* from the rearward for connection therewith. The front lateral member 52*a* is made of, e.g. a rectangular steel tube and extends in the leftward and rightward direction. In addition, the longitudinal member 51 is abutted its rear end against the rear lateral member 52*b* from below for connection therewith. The rear lateral member 52*b* is made of, e.g. a circular steep tube and extends in the leftward and rightward direction. The frame 53 mainly including the longitudinal members 51 and the lateral members 52*a*, 52*b* is formed in an almost-square as viewed from above. Incidentally, the frame 53 has a left-right width approximately equal to that of the frame 22 of the first beach cleaner 20. In the second embodiment, the frame 53 has a left-right width smaller than that between the left and right side structures 41L, 41R of the waste recovery station 40.

A plurality of (e.g. three) scraper frames 58 are juxtaposed left and right between a central longitudinal member 51 and each of left-end and right-end longitudinal members 51 so as to be superposed on the front slant portions 57 as viewed from the side. The scraper frame 58 is made of a circular steel tube (which may be a rectangular steel tube) having the same diameter as that of the longitudinal member 51. The scraper frame 58 is abutted at its front end against the front lateral member 52*a* from the rearward for connection therewith. On the other hand, the rear end of the scraper frame 58 is not connected to any members, that is, serves as a free end.

The scraper frames 58 and the central longitudinal member 51 are spaced equally apart from each other. The outermost left scraper frame 58 and the left longitudinal member 51, and the outermost right scraper frame 5B and the right longitudinal member 51, are each arranged to have narrow spacing therebetween.

The keels 54 and scrapers 55 are attached to the front slant portions 57 of the longitudinal members 51 and to the scraper frames 58. The keels 54 and scrapers 55 serve as a raking-up portion which rakes up sand and relatively small waste (drink boxes, paper scraps, cigarette butts, etc.) while the second beach cleaner 50 travels, being towed.

Figure 19:
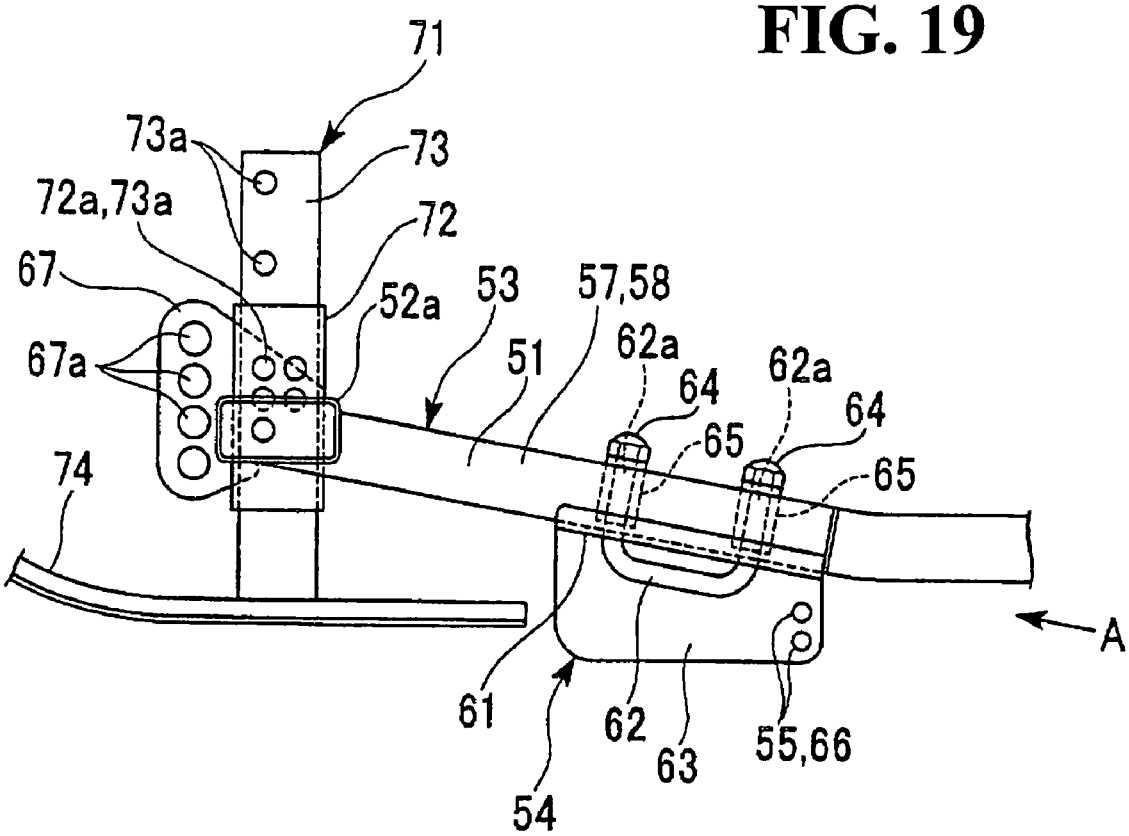
FIG. 19 is a side view of the front portion of the frame of the second beach cleaner.
Figure 20:
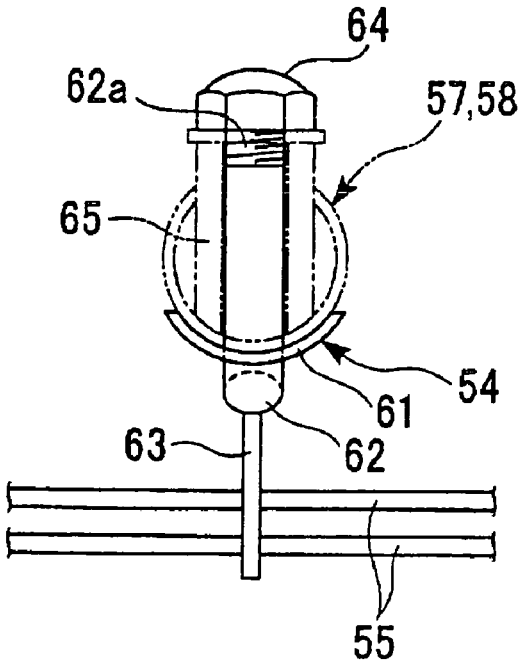
FIG. 20 is a view as viewed from arrow A of FIG. 19.

Additionally referring to FIGS. 19 and 20, the keel 54 is detachably attached to the rear portion of the front slant portion 57 of the longitudinal member 51 and to the rear portion of the scraper frame 58. The keel 54 includes a plate-like member 61, a U-shaped pin 62 and a keel main body 63. The plate-like member 61 bends to conform to the lower outer surface of the front slant portion 57 or the scraper frame 58. The U-shaped pin 62 is formed in a U-shape opening upward and has both side portions passing through the plate-like member 61. The keel main body 63 is formed like a plate to extend almost perpendicularly to the leftward and rightward direction and extends downward from the lower edge of the plate-like member 61.

The upper parts of both side portions of the U-shaped pin 62 are formed as external thread parts 62*a*. The external thread parts 62*a* pass through the front slant portion 57 or the scraper frame 58 from below to project upward therefrom. In this state, the plate-like member 61 abuts against the lower surface of the front slant portion 57 or the scraper frame 58. In this state, a hexagon cap nut 64 is threaded on each of the external thread parts 62*a* and fastened thereto, whereby the keel 54 is fastened to the front slant portion 57 or the scraper frame 58. A cylindrical collar 65 is fixedly inserted through a portion, of the front slant portion 57 or the scraper frame 58, through which each of the side portions of the U-shaped pin 62 passes.

The keel 54 (the keel main body 63) is formed at its rear end with a plurality of scraper support holes 66, by which the scrapers 55 are insertably supported. The scraper 55 is formed like a bar circular in section for instance and extends in the leftward and rightward direction. The scrapers 55 extend across the keels 54 while insertably supported by the upper and lower support holes 66. The scrapers 55 can be selectively supported according to the conditions of the sandy beach and waste and the plurality of scrapers can be supported. To prevent the scrapers 55 from falling from the respective keels 54, the scrapers 55 are provided at their ends with locking devices such as desired retaining pins inserted thereto. The sectional shape of the scraper 55 is not limited to a circle but may be of a semicircle with an upper surface extending forwardly downwardly. The scraper 55 may be one, three or more. In addition, the scrapers may be arranged not above and below but right and left or obliquely.

The keels 54 and the scrapers 55 are set so as to be dug into sand at an appropriate depth. While the second beach cleaner 50 runs in this state, the keels 54 push aside sand and waste and the scrapers 55 scrape up them. In this way, the sand and waste thus scraped up are thrown into the net 56 provided at the rear portion of the frame 53.

Figure 26:
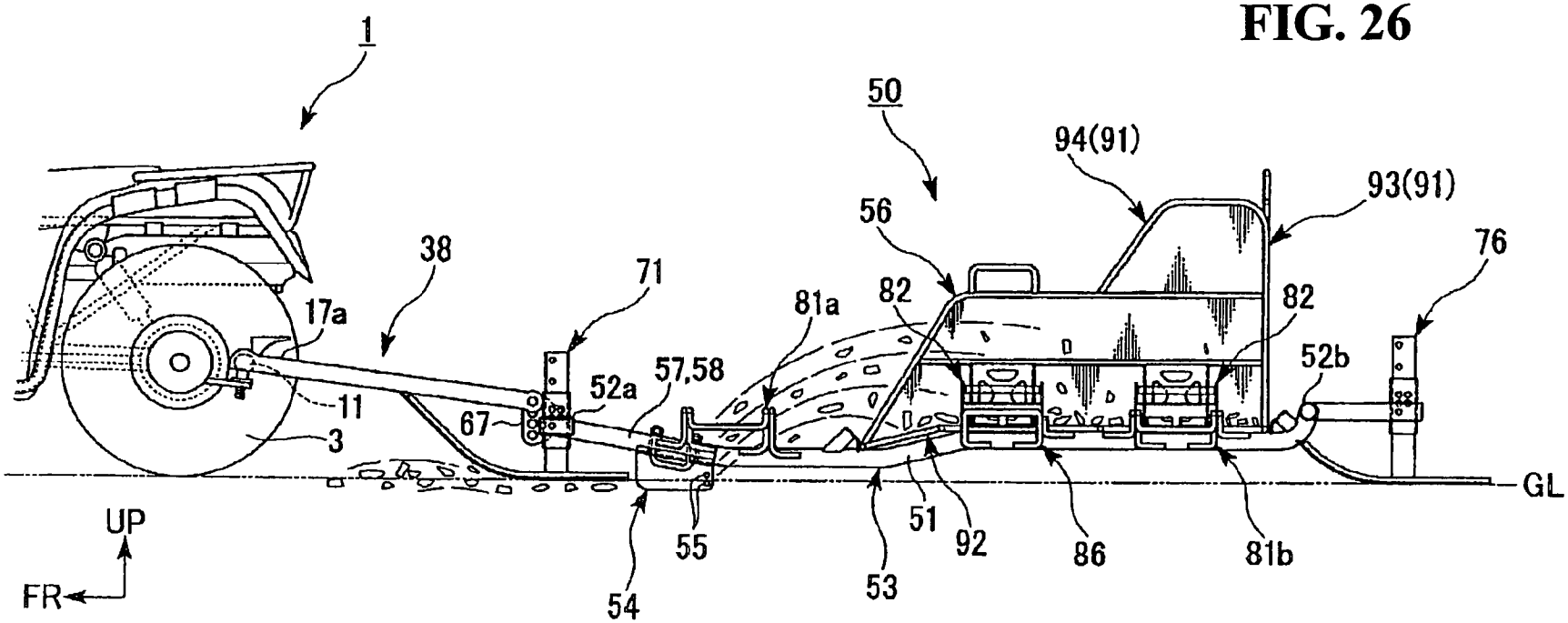
FIG. 26 is a side view illustrating a state where the second beach cleaner is towed by the vehicle.
Figure 26A:
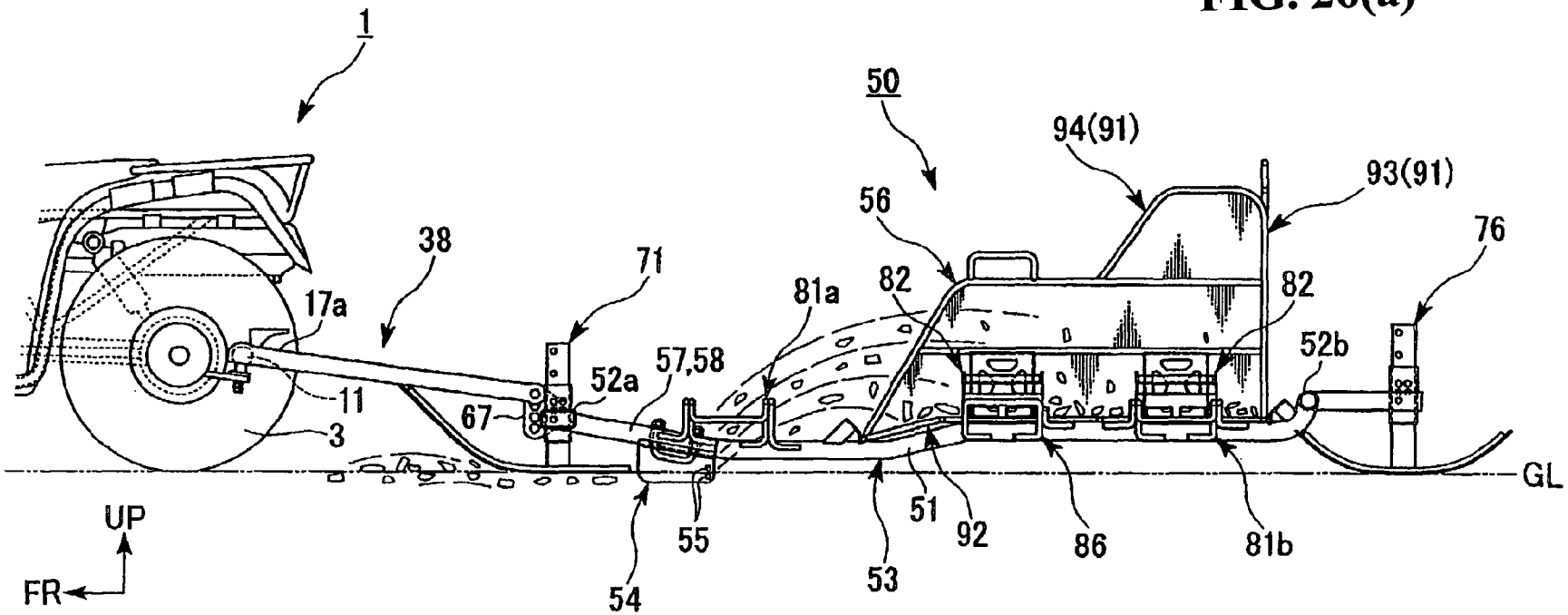

With reference to FIGS. 16 and 17, a tow portion 67 is provided in front of, e.g. a second scraper frame 58 from each of the left and right outside ends of the frame 53. The tow portion 67 is used by the vehicle 1 to pull the second beach cleaner 50. The tow portion 67 is made of a thick plate extending perpendicular to the leftward and rightward direction and is formed with a plurality of (e.g. four) connecting holes 67*a* arranged up and down. One end of the tow rod 38 is connected to any one of the connecting holes 67*a*. The other end of the tow rod 38 is connected to the trailer hitch 11 of the vehicle 1. Thus the second beach cleaner 50 is towed by the vehicle 1 via the tow rod 38 (see FIG. 26).

In this case, the optimum towing position according to the ground height of the second beach cleaner 50 can be set by connecting the one end of the tow rod 38 with which one of the connecting holes 67*a*. The left-right distance between the left and right tow portions 67 is approximately equal to that between the left and right tow portions 37.

A front ski support pipe 72 supporting a front ski leg 71 is provided, for instance, forward of each of the left and right outermost scraper frames 58 included in the frame 53. The front ski support pipe 72 is made of, e.g. a rectangular steel tube and passes through the front lateral member 52*a* vertically. The front ski support pipe 72 can supportably pass a leg member 73 of the front ski leg 71 therethrough. The leg member 73 is also made of a rectangular steel tube. The front ski leg 71 is adapted to set the ground height (the height from the upper surface of the sand area) of the front portion of the second beach cleaner 50 and to enhance glide performance relative to the sand area. The front ski leg 71 includes a front ski plate 74 with a predetermined width having a front portion bending forwardly upwardly and the leg member 73 provided on the front ski plate 74 so as to extend upright.

The front ski support pipe 72 is formed with left and right through-holes 72*a*. The leg member 73 is formed with a plurality of (e.g. four) left and right through-holes 73*a* arranged up and down so as to correspond to the left and right through-holes 72*a*. Any one of the left and right through-holes 73*a* is superposed on one of the left and right through-holes 72*a* of the front ski support pipe 72 and a predetermined retaining pin or the like is inserted into the through-holes thus superposed. This determines the height of the front portion of the frame 53 relative to the front ski leg 71, whereby the ground height of the front portion of the second beach cleaner 50 is set at a desired level. In other words, the ground height of the front portion of the second beach cleaner 50 can be adjusted by inserting the retaining pin or the like into one of the left and right through-holes 73*a* of the leg member 73. Thus, the amount of digging the keels 54 and the scrapers 55 into sand can be adjusted.

An extension frame 75 made of, e.g. a rectangular steel tube extends from a rear portion, on each of both sides, of the rear lateral member 52*b*. A rear ski support pipe 77 is provided at the rear end of the extension frame 75 so as to support a rear ski leg 76. The rear ski support pipe 77 is made of, e.g. a rectangular steel tube and passes through the extension frame 75 upwardly and downwardly. The rear ski support pipe 77 can supportably pass a leg member 78 of the rear ski leg 76 therethrough. The leg member 78 is also made of a rectangular steel tube. The rear ski leg 76 has the same configuration and function as the front ski leg 71. That is to say, the rear ski leg 76 is provided on a rear ski plate 79 so as to extend the leg member 78 upright. The rear ski plate 79 is provided with a rear portion bending rearward upwardly taking into account the case where similarly to the first beach cleaner 20 the second beach cleaner 50 is loaded and unloaded to and from the loading part 16 of the trailer 13 along the left and right guide members 44 (see FIG. 34).

The rear ski support pipe 77 is formed with a single left-right through-hole 77*a*. The leg member 78 is formed with a plurality of (e.g., four) left-right through-holes 78*a* arranged up and down so as to correspond to the left-right through-hole 77*a*. Any one of the left-right through-holes 78*a* is superposed on the left-right through-hole 77*a* of the rear ski support pipe 77 and a predetermined retaining pin or the like is inserted into the through-holes thus superposed. This determines the height of the rear portion of the frame 53 relative to the rear ski leg 76, whereby the ground height of the rear portion of the second beach cleaner 50 is set at a desired level (In other words, the ground height of the rear portion of the second beach cleaner 50 can be adjusted.). The left-right width between the outer ends of the front ski plates 74 of the left-right front ski legs 71 is made approximately equal to the left-right width of the frame 53. The left-right width between the outer ends of the rear ski plates 79 of the left and right rear ski legs 76 is made smaller than the left-right width of the frame 53.

Front lift arms 81*a* are provided on the left and right outside of the front portion of the frame 53 so as to protrude leftward and rightward, respectively. Rear lift arms 81*b* are provided on the left and right outside of the rear portion of the frame 53 so as to protrude leftward and rightward, respectively. The lift arms 81*a*, 81*b* are each formed like a horizontally long rectangular frame, for instance, as viewed from above. In each lift arm, the left-right intermediate portion is formed almost horizontally, the left-right inside portion is formed to bend obliquely downward and inward, and the left-right outside portion is formed to bend obliquely downward and outwardly. The left-right width between the outside ends of each of the lift arms 81*a*, 81*b* is greater than the left-right width between the left and right side structures 41R, 41L of the waste recovery station 40 (that is, is approximately equal to the left-right width of the frame 22 of the first beach cleaner 20). When the second beach cleaner 50 enters between the left and right side structures 41L, 41R, the lift arms 81*a* and 81*b* ride on the left and right side structures 41, respectively, whereby the second beach cleaner 50 is lifted up at a desired amount.

Figure 18:
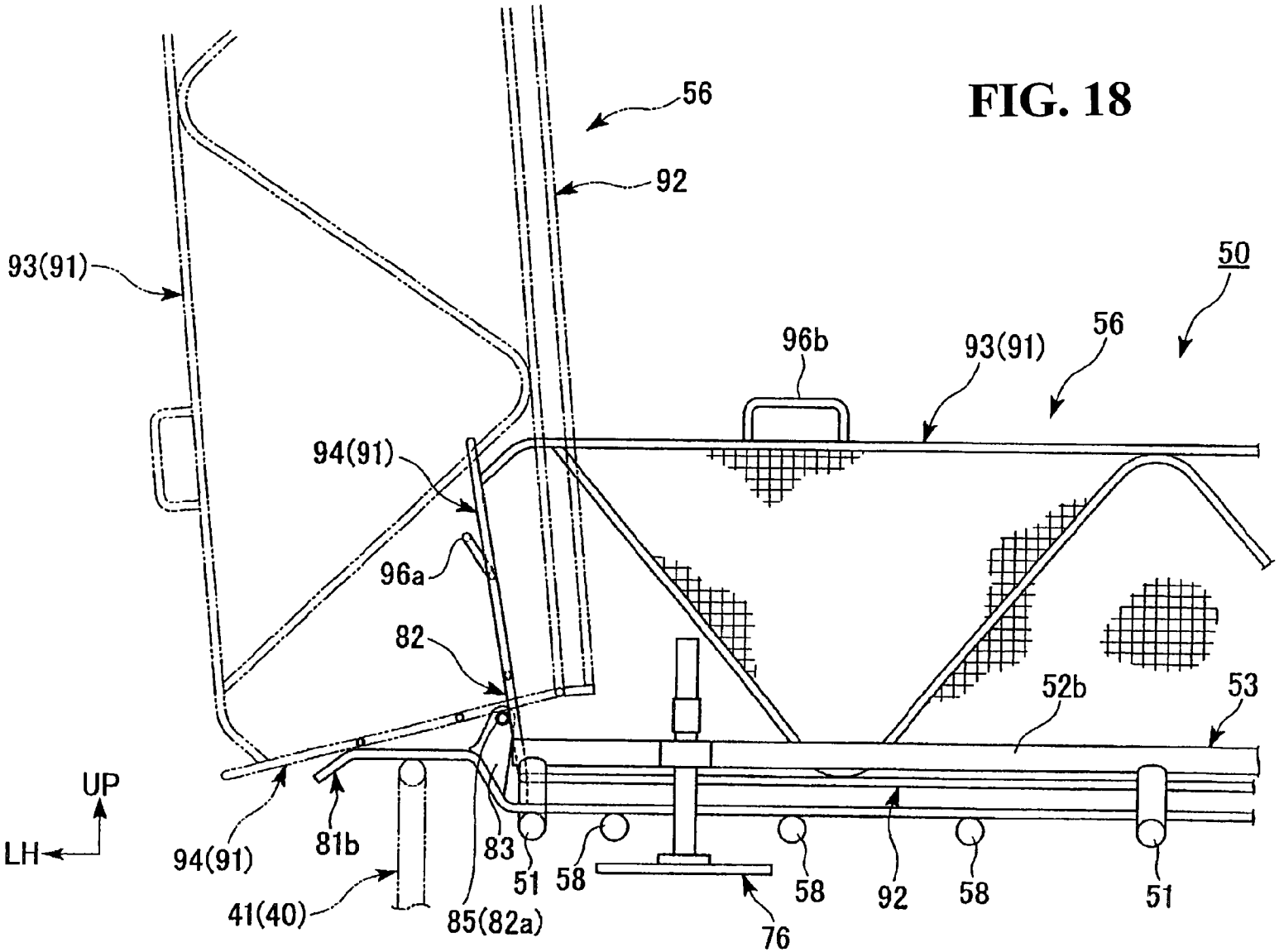
FIGS. 18 and 18(*a*) are rear views of FIG. 16.
Figure 18A:
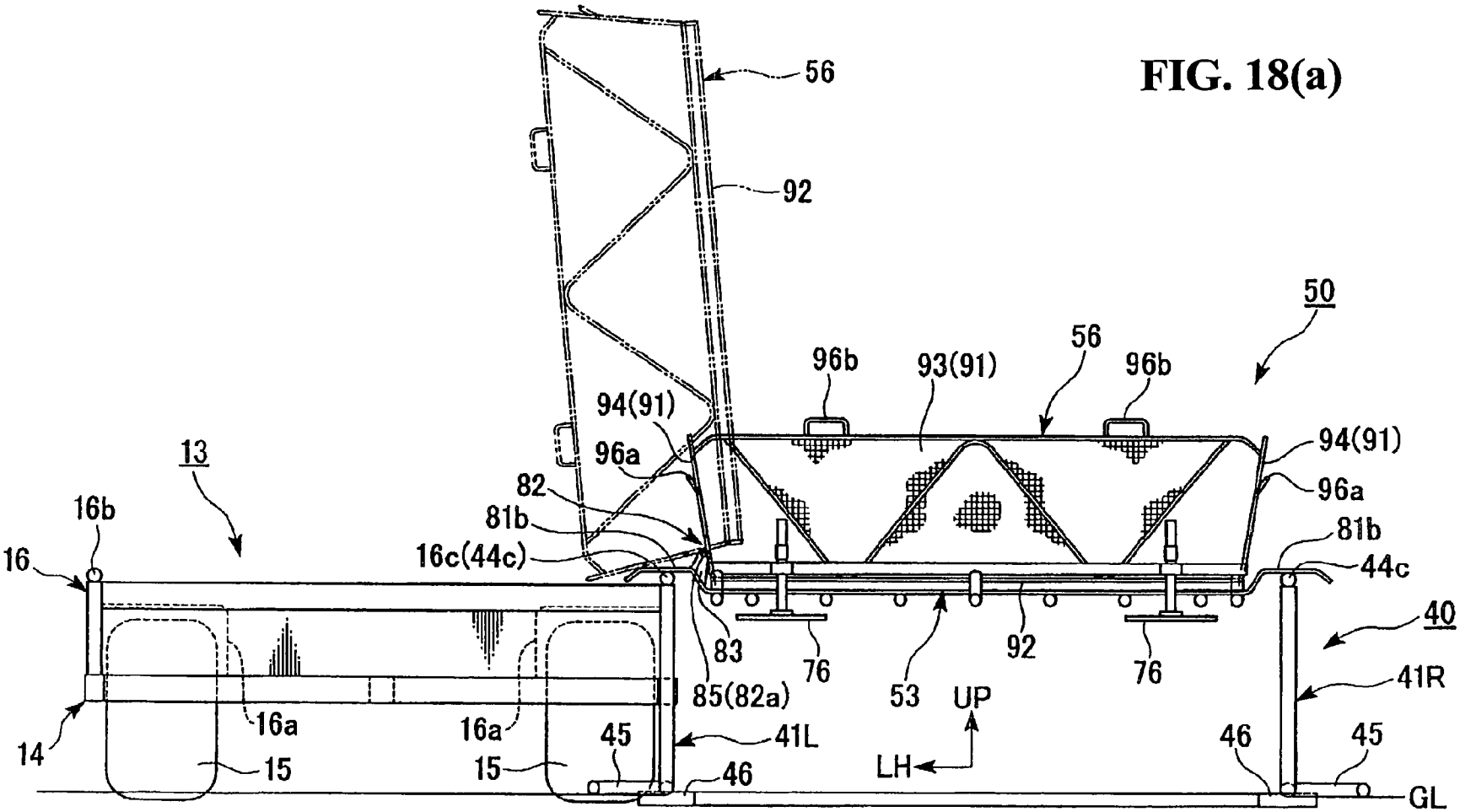

When the second beach cleaner 50 is lifted up as described above in the waste recovery station 40, the net 56 provided at the rear portion of the frame 53 is elevated to a desired height. The net 56 is made to be turned around a hinge 82 located on the left side thereof (see FIGS. 18 and 18(*a*)). Thus, the recovery work of the waste gathered in the net 56 can be facilitated. Incidentally, for the second beach cleaner 50, the waste recovery work can be carried out with the second beach cleaner 50 not lifted up, that is, placed on the ground. In FIG. 18(*a*), the trailer 13 is located adjacently to and leftward of the waste recovery station 40. Therefore, the waste can be directly thrown into the loading part 16 of the trailer 13.

Figure 21:
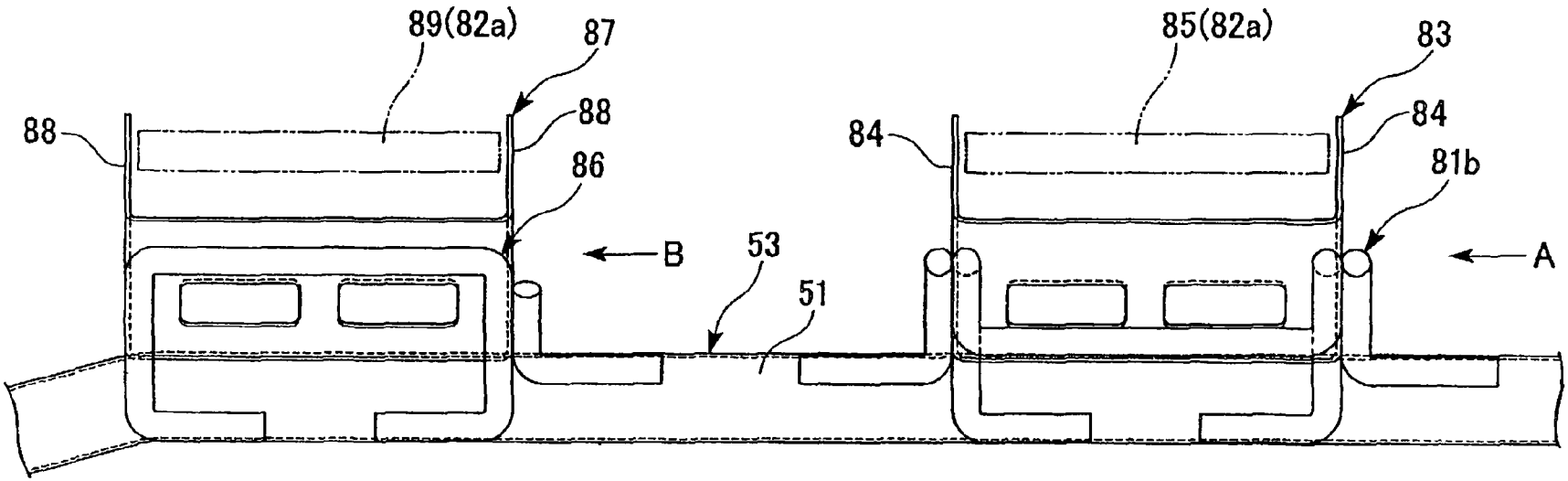
FIG. 21 is a side view illustrating the periphery of hinges for a net of the second beach cleaner.
Figure 22A:
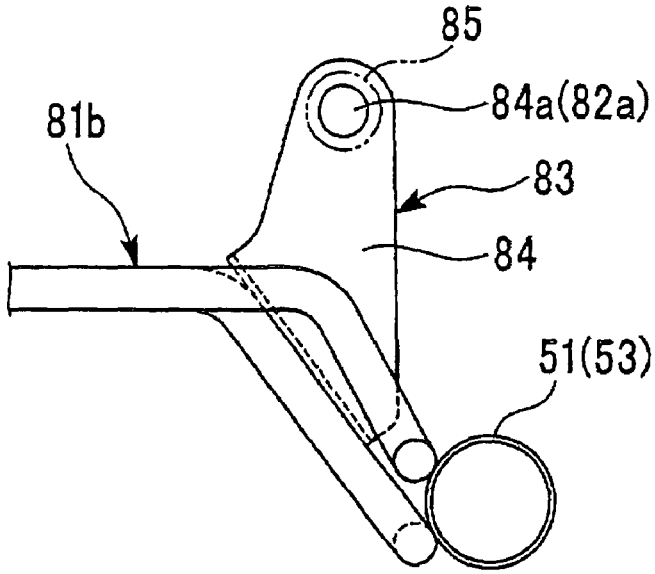
FIG. 22(*a*) is a view as viewed from arrow A of FIG. 21 and FIG. 22(*b*) is a view as viewed from arrow B of FIG. 21.
Figure 22B:
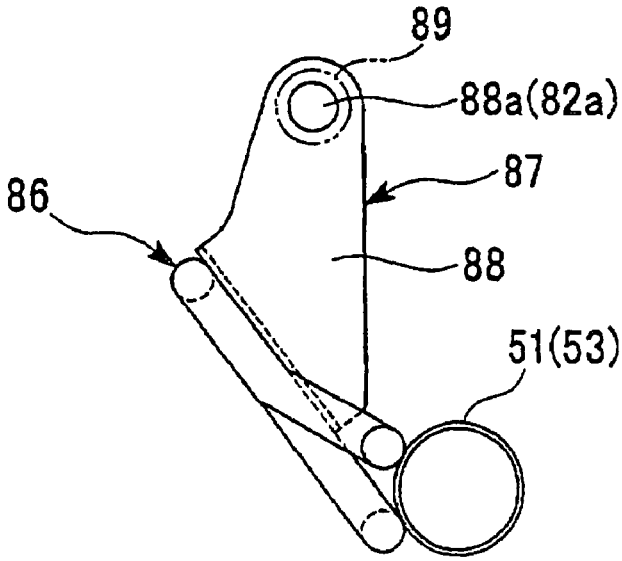

Additionally referring to FIGS. 21 and 22, a rear hinge bracket 83 is attached to the rear lift arm 81*b* located on the left side portion of the frame 53. The rear hinge bracket 83 constitutes part of a hinge 82 pivotally supporting the left side of the net 56. The rear hinge bracket 83 extends across the front and rear of the rear lift arm 81*b* on the proximal end thereof. The rear hinge bracket 83 is formed at its front and rear ends with front and rear walls 84, respectively, which extend upward. The front and rear walls 84 are formed on the leading end side with front and rear through-holes 84*a*, respectively, adapted to receive a hinge shaft 82*a*. A rear hinge pipe 85 provided on the left side of the net 56 so as to be associated with the rear hinge bracket 83 is disposed between the front and rear walls 84. The rear hinge pipe 85 is pivotally supported by the rear hinge bracket 83 via the hinge shaft 82*a* extending in the back and forth direction.

A frame-like support arm 86 is provided slightly forward of the rear lift arm 81*b*. The support arm 86 has a slightly smaller left-right width than the lift arm 81*b*. A front hinge bracket 87 having the same configuration as the rear hinge bracket 83 is supported by the support arm 86. Front and rear walls 88 of the front hinge bracket 87 are formed with front and rear through-holes 88*a*, respectively, adapted to receive a hinge shaft 82*a*. A front hinge pipe 89 provided on the left side of the net 56 so as to be associated with the front hinge bracket 87 is disposed between the front and rear walls 88. The front hinge pipe 89 is pivotally supported by the front hinge bracket 87 via the hinge shaft 82*a* extending in the back and forth direction. The hinge pipes 85, 89 and the hinge shaft 82*a* are provided coaxially with each other.

Referring to FIGS. 16 and 17, the net 56 is formed in a box shape opening forward and upward and includes a frame mainly made of e.g. steel pipes and wire meshes with meshes of desired sizes attached to the steel pipes. This net 56 is provided so as to extend from a position slightly forward of the center of the frame 53 to the vicinity of the rear end of the frame 53 in the back and forth direction. In addition, the net 56 is provided to have the left-right width approximately equal to that of the frame 53 in the leftward and rightward direction. The front end of the net 56 is spaced apart about 100 to 300 mm from the vicinity of the rear ends of the keels 54, namely, the vicinity of the scrapers 55 in order to make it possible to satisfactorily capture the sand and waste scraped up by the keels 54 and the scrapers 55. The front end of the net 56 is more preferably spaced apart about 250 mm from the vicinity of the rear ends of the keels 54 rearward.

Additionally referring to FIGS. 18 and 18(*a*), the net 56 includes a bottom wall section 92, a rear wall section 93 and left and right side wall sections 94. The bottom wall section 92 is formed in a horizontally long rectangle as viewed from above. The rear wall section 93 is formed to rise almost upright from the rear edge of the bottom wall section 92. The left and right side wall sections 94 slightly obliquely rise from both side edges of the bottom wall section 92 so as to be located leftward and rightward outwardly, respectively, as they go upward. The rear wall section 93 and the left and right side wall sections 94 form a surrounding section 91 which surrounds the circumference of the bottom wall section 92 except the front thereof in order to make it possible to collect the waste scraped by the keels 54 and the scrapers 55.

The front portion of the bottom wall section 92 is a slant section 92*a*, which slants slightly forwardly downwardly. A portion rearward of the slant section 92*a* is a horizontal portion extending almost horizontally. The horizontal portion is divided into a front horizontal section 92*b* and a rear horizontal section 92*c* by a lateral member extending in the leftward and rightward direction.

A wire mesh with a mesh size of 25 mm is attached to the slant section 92*a* of the bottom wall section 92. A wire mesh with a mesh size of 12 mm is attached to the front horizontal section 92*b*. A wire mesh with a mesh size of 8 mm is attached to the rear horizontal section 92*c*.

As described above, the wire mesh of the bottom wall section 92 is set larger in mesh size as it goes forward. The relatively heavy damp sand of the sand scraped by the keels 54 and the scrapers 55 does not reach the rear portion of the bottom wall section 92. Thus, the relatively heavy damp sand is satisfactorily eliminated, without occurrence of clogging, through the wire mesh with large meshes at the front portion of the slant section 92*a* of the bottom wall section 92. On the other hand, relatively lightweight dry sand and the like reach the horizontal section of the rear side portion of the bottom wall section 92, where they are eliminated through the wire meshes with middle and small meshes attached thereto but the waste is satisfactorily captured without being eliminated through the wire meshes. Incidentally, the wire meshes may be arbitrarily replaceable in the mesh sizes of about 6, 8, 10, 12 and 25 mm.

A side wall section 94 of the net 56 includes a side wall main body 94*a* and a rear projecting section 94*b*. The side wall main body 94*a* is formed on each of side edges of the bottom wall section 92 so as to be in a rectangle long in the back and forth direction as viewed from the side. The rear projecting section 94*b* is formed on the rear side portion of the side wall main body 94*a* so as to be in a trapezoid as viewed from the side. The respective rear side portions of the side wall main body 94*a* and the rear projecting section 94*b* are extend vertically as viewed from the side so as to be linearly contiguous to each other. The rear wall section 93 of the net 56 is provided such that the rear side portions serve as its lateral side portions. The upper side portion of the side wall section 94 (rear projecting section 94*b*) is approximately equal in height to the upper side portion of the rear wall section 93.

Front and rear hinge plates 95*a*, 95*b* are provided at front and rear portions, respectively, of the left side wall section 94 of the net 56 so as to be spanned between the intermediate and lower frame members of the side wall main body 94*a*. Each of the hinge plates 95*a*, 95*b* is formed like a plate shaped in an almost square as viewed from the side. Each of the hinge plates is appropriately cut out to leave its outer edge portion and orthogonal portions. In addition, the front and rear edge portions of each of the hinge plates 95*a*, 95*b* are bent leftward and rearward inwardly to form reinforcing flanges. The front and rear hinge pipes 85 and 89 are integrally joined to the outer side surfaces of the hinge plates 95*a* and 95*b*, respectively.

A grip 96*a* is provided at a front upper side (above the front hinge plate 95*a* in the left side wall section 94) of each of the left and right side wall sections 94 so as to project upward from the upper edge thereof. The grip 96*a* is formed in a U-shape opening downward as viewed from the side, The grip 96*a* is provided to have an upper side portion extending in the back and forth direction and to be inclined so as to be protrude slightly outwardly from the side wall section 94 corresponding thereto. Grips 96*b* are provided at left and right upper portions of the rear wall sections 93 so as to project upward from the upper edge thereof. The grip 96*b* is formed in a U-shaped opening downward as viewed from the rearward. The grip 96*b* is provided to have a upper side portion extending in the leftward and rightward direction and to extend almost vertically so as to be located flush with the rear wall section 93.

The left side portion of the net 56 is pivotally and supportably connected to the left side portion of the frame 53 via the hinge 82 as described above. The net 56 is turned via the hinge 82 so as to lift the right side portion of the net 56 configured as above upward, bringing the bottom wall section 92 into an almost upright state. In this state, the waste collected in the net 56 drops on the left side wall section. 94 and is discharged along the left side wall section 94 to the outside of the net 56.

Since the grips 96*a*, 96*b* are attached to the appropriate portions (at least a portion opposite to the hinge 82) of the surrounding section 91 of the net 56, the recovery work of the waste by turning the net 56 can be facilitated. The hinges 82 are arranged on one short side (left side) of the horizontally long net 56. Therefore, when the net 56 is raised, the length from a pivotal shaft (the hinge shaft 82*a*) to the operating part (the right grips 96*a*, 96*b*) can be ensured to facilitate the turning operation of the net 56.

The left side wall section 94 (namely, the wall section close to the hinge 82 of the surrounding portion 91) of the net 56 is a wall portion to which a plate member is attached to satisfactorily discharge the waste. The upper edge portion of the left side wall section 94 of the net 56 is set to protrude leftward relative to the outside of the waste recovery station 40 (relative to the left side structure 41L in the second embodiment) in the upright state of the bottom wall section 92 (see FIG. 18). If a waste collection container is disposed leftward adjacent to the waste recovery station 40, the waste collected in the net 56 is directly thrown into the container with the left side wall section 94 sloped. In the second embodiment, the waste collected in the net 56 is directly thrown into the loading part 16 of the trailer 13 leftward adjacent to the waste recovery station 40 with the left side wall section 94 sloped. The right side wall section 94 and rear wall section 93 of the net 56 serve as net portions to which wire meshes with large meshes are attached in order to prevent the waste thrown in the net 56 from dropping.

Left front and rear end stoppers 97*a*, 97*b* are respectively provided on the left longitudinal member 51 of the frame 53 so as to position the left front and rear ends of the net 56. Similarly, right front and rear end stoppers 97*a*, 97*b* are respectively provided on the right longitudinal member 51 of the frame 53 so as to position the right front and rear ends of the net 56. Each of the stoppers 97*a*, 97*b* includes an almost vertical position-restriction surface in abutment against the front or rear end of the net 56. A turn guide surface is contiguous to the position restriction surface from above so as to be inclined upward. The stoppers are each detachably attached to the longitudinal member 51 using, e.g. bolts or the like.

The front ends of both sides of the net 56 in the usage state (the state where the bottom wall section 92 is almost horizontally abutted against the frame 53) are abutted against the position restriction surfaces of the left and right front end stoppers 97*a*. In addition, the rear ends of both sides of the net 56 in the usage state are abutted against the position restriction surface of the left and right rear end stoppers 97*b*. Thus, the net 56 can be positioned with respect to the frame of the net 56 in the back and forth direction. When the net 56 is turned to be brought from the upright state into the usage state, the front and rear ends of both sides of the net 56 are guided by the guide surfaces of the stoppers 97*a*, 97*b* and the net 56 is smoothly returned to a predetermined position on the frame 53.

Figure 23A:
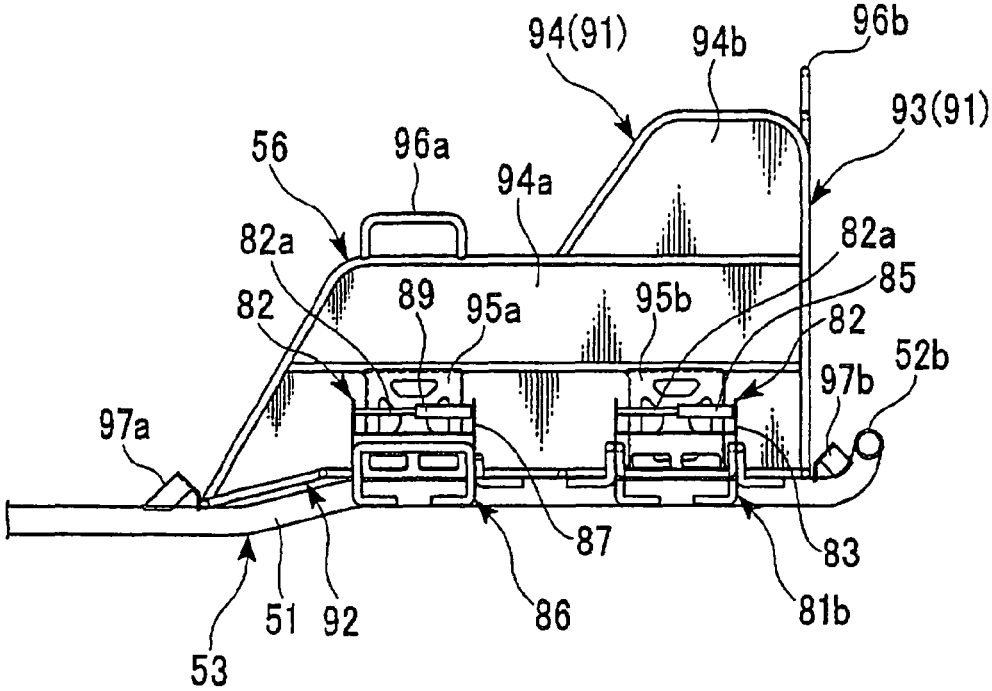
FIG. 23 illustrates an example where the net of the second beach cleaner is made movable forwardly and backwardly, in which FIG. 23(*a*) is a side view of the net located at its withdrawal position and FIG. 23(*b*) is a side view of the net located at its forward position.
Figure 23B:
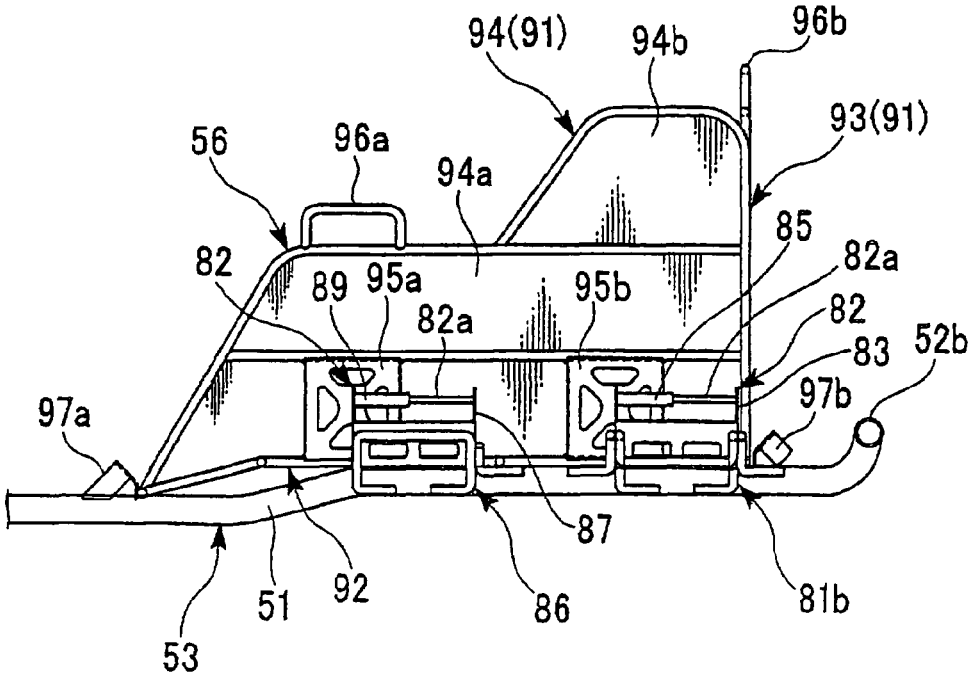

Referring to FIG. 23, the attachment positions of the stoppers 97*a*, 97*b* to the longitudinal members 51 may be made movable forwardly and backwardly. In this case, the lengths of the hinge pipes 85, 89 on the left side of the net 56 are each made shorter than the distance between the front and rear walls 84 of the front hinge bracket 87 and between the front and rear walls 88 of the rear hinge bracket 83. This makes it possible to shift the net 56 back and forth in response to the shift of the stoppers 97*a*, 97*b*. In this way, the front end position of the net 56 can be easily changeable according to the conditions of the sand area. This makes it possible to enhance the waste capture performance of the second beach cleaner 50.

Next, a description is made of a schematic procedure for cleaning a sandy beach using the beach cleaners 20, 50.

The waste recovery station 40, which has been loaded on the trailer 13 as shown in FIG. 1 and carried to a predetermined site on the sandy beach is installed thereat. In FIG. 1, the waste recovery station 40, which has been integrally assembled, is loaded on the trailer 13. However, needless to say, the waste recovery station 40 may be loaded on the trailer 13, while being divided into the side structures 41 and the connecting members 42 as described above. In this case, the work for installing the waster recovery station 40, including loading and unloading it on and from the trailer 13, can be facilitated. Incidentally, in the waste recovery station 40 in FIG. 1, only the foot members 45 are removed therefrom.

The hardness of the sandy beach is next measured. The hardness is a criterion for determining the number of the sand pins 23 of the first beach cleaner 20, the amount of digging the keels 54 and scrapers 55 of the second beach cleaner 50 and the like into the sand. This measurement is performed by allowing e.g. an iron pile with a predetermined size to freely fall on a sandy beach. The hardness of the sandy beach is evaluated at three levels (soft, standard and hard) on the basis of the average of the measurements. The number of the sand pins 23, the weight of the weight 34, the attachment height of the ski legs, the positions of connecting the connecting rod 38 to the tow portions 37, 67 and the like are determined in accordance with the hardness of the sandy beach thus measured and the condition of scattered waste or the like.

As shown in FIGS. 1(*a*) and 31, the beach cleaners 20, 50 and the waste recovery station 40 are first loaded on the trailer 13 and carried to a predetermined cleaning site. The beach cleaners 20, 50 are loaded on the trailer 13, each being integrally assembled. On the other hand, the waste recovery station 40 is loaded on the trailer 13, being divided into the left and right front and rear divided bodies 41*a*, 41*b*, the right intermediate divided body 41*d*, the front and rear connecting members 42 and the foot members 45.

Figure 32:
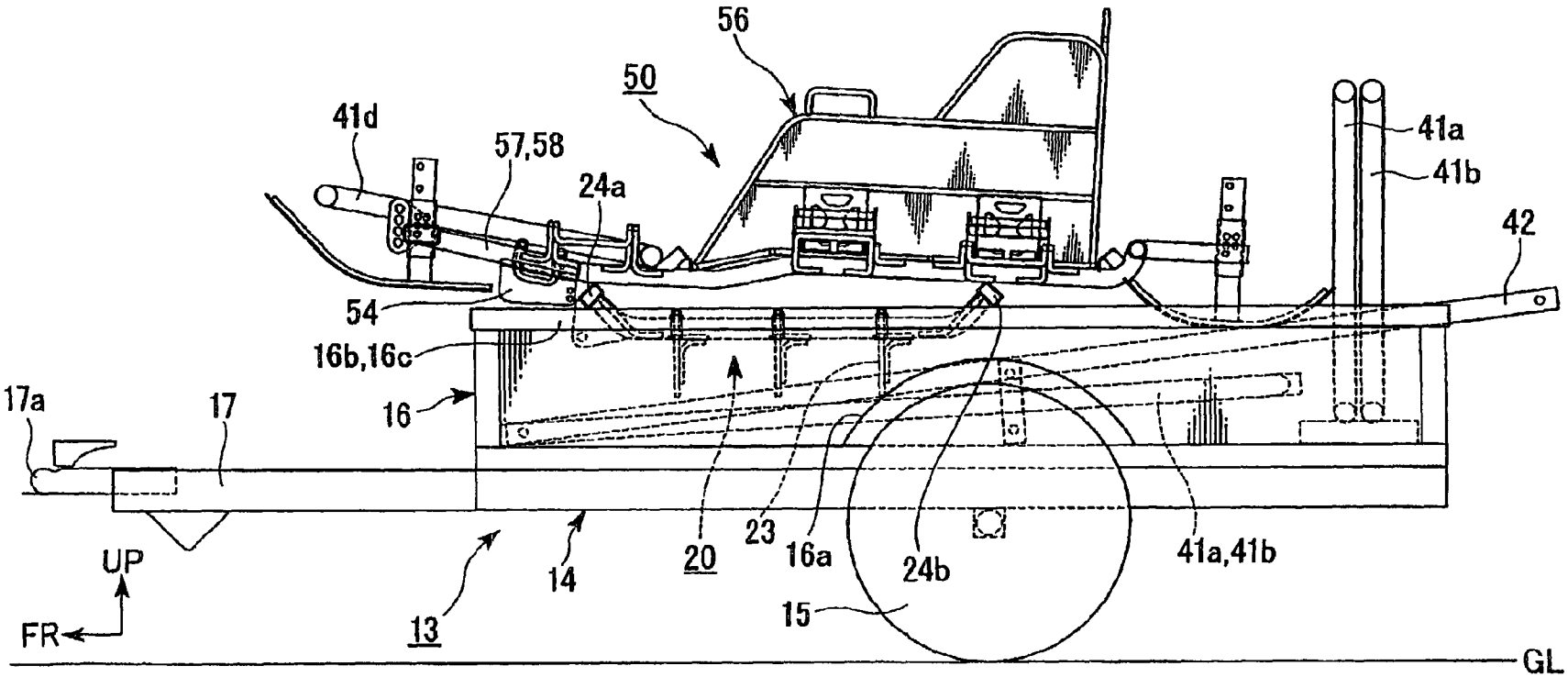
FIG. 32 is a side view illustrating another loading state of the trailer.
Figure 33:
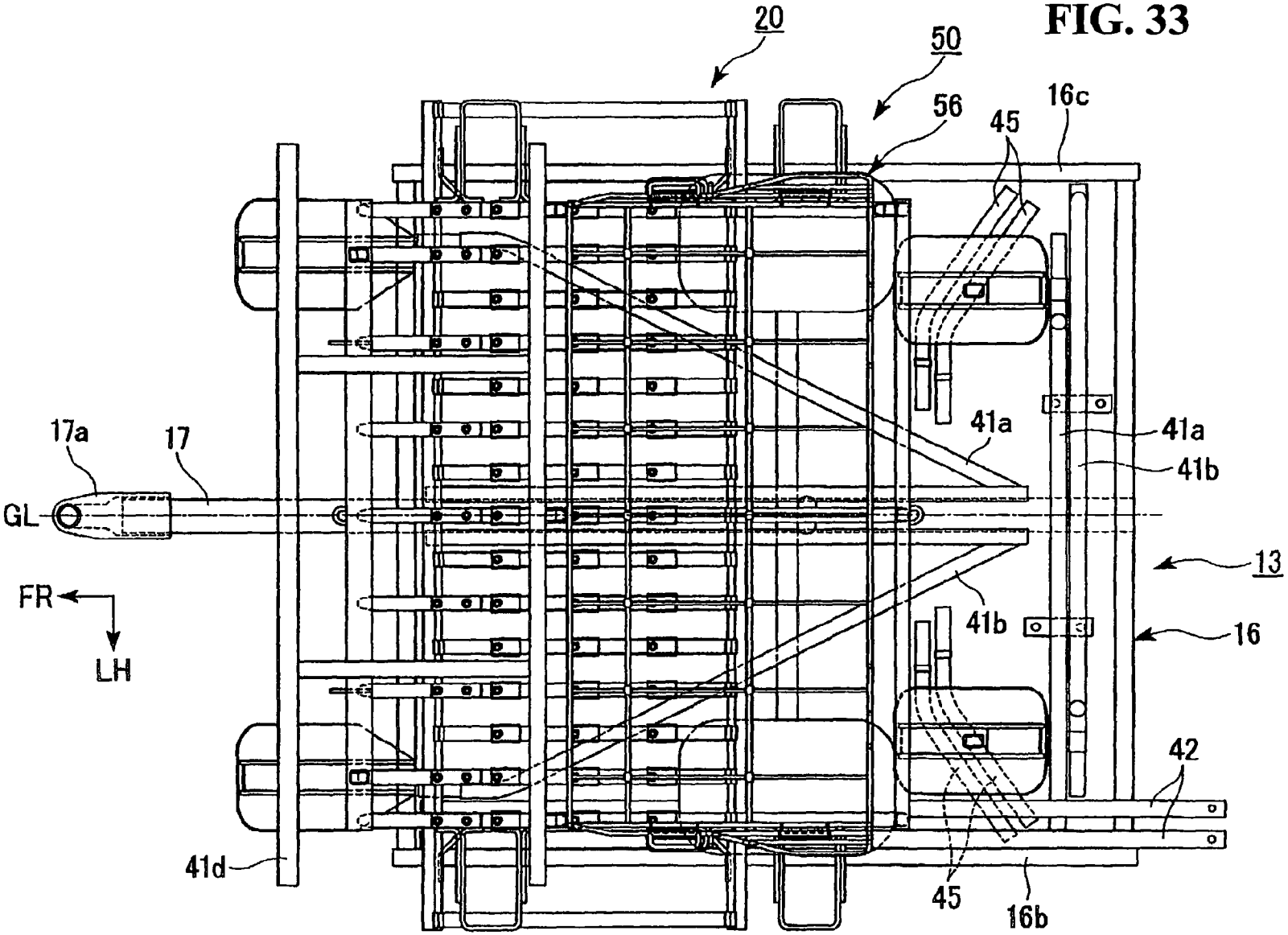
FIG. 33 is a plan view of FIG. 32.

More specifically, the pair of front and rear divided bodies 41*a*, 41*b* (or a pair of front or rear divided bodies) are first loaded on the trailer 13 (received in the loading part 16). Then, the beach cleaners 20, 50 are loaded on the trailer 13. In this case, the first beach cleaner 20 is loaded while both side portions of the front and rear lateral members 24*a*, 24*b* are respectively put on the left and right side portions 16*b*, 16*c* (the upper side section 44*c* of the guide member 44 of the waste recovery station 40) of the loading part 16. In addition, the sand pins 23 on both sides of the end of the row are abutted against the outer surface of the wheel houses 16*a* from the front, whereby the rearward movement of the first beach cleaner 20 is restricted (see FIG. 32).

The second beach cleaner 50 is loaded slightly rearward downwardly while the longitudinal member 51 of the frame 53 is put on the front and rear lateral members 24*a*, 24*b* of the first beach cleaner 20 in the loaded state. In addition, the keels 54 are abutted against the front lateral member 24*a* of the first beach cleaner 20 from the front, whereby the rearward movement of the second beach cleaner 50 is restricted (see FIG. 34).

In the waste recovery station 40, the other pair of front and rear divided bodies 41*a*, 41*b* (or a pair of front or rear divided bodies) and the right intermediate divided body 41*d* are loaded so as to be put on the front slant portions 57 and scraper frame 58 of the second beach cleaner 50 in the loaded state. The connecting members 42 are loaded, extending forward downwardly, for example, on the right side of the loading part 16. The foot members 45 are received, for example, in the rear left side portion of the loading part 16.

The loaded state of the waste recovery station 40 is not limited to the above. For instance, as shown in FIGS. 20 and 21, only the right intermediate divided body 41*d* may be loaded on the front slant portions 57 and scraper frames 58 of the second beach cleaner 50 in the loaded state. For example, a pair of front and rear divided bodies 41*a*, 41*b* may be loaded so as to be juxtaposed to each other and extend in the leftward and rightward direction at a position rearward of the second beach cleaner 50. In addition, the other front and rear divided bodies 41*a*, 41*b* may be loaded in the loading part 16. In this case, the foot members 45 may be received in the rear portion of the loading part 16 so as to be appropriately divided right and left.

The beach cleaners 20, 50 in the loaded state are then unloaded on the ground. In this case, the rear divided bodies 41*b* are connected to the left and right side portions 16*b*, 16*c* of the loading part 16 of the trailer 13, which is called the unloading state (see FIGS. 34 and 35). If the beach cleaners 20, 50 are unloaded on the ground along the left and right guide members 44 (see FIGS. 13(*a*) and 34), they can be unloaded on the ground relatively easily and move to the waste recovery work quickly even in the case where each of the beach cleaners 20, 50 is integrally assembled.

The waste recovery station 40 is next installed at a predetermined site on a sandy beach. One of the rear divided body 41*b* is first removed from the left side portion 16*b* of the loading part 16 of the trailer 13 in the unloading state described above. This rear divided body 41*b*, the right intermediate divided body 41*d* and the front divided body 41*a* are connected to constitute the right side structure 41R. On the other hand, the front divided structure 41*a* is connected to the right side portion 16*c* of the loading part 16 of the trailer 13 to constitute the left side structure 41L.

The left and right side structures 41L, 41R are connected to each other via the front and rear connecting members 42 and the foot members 45 are attached to desired positions, whereby the waste recovery station 40 is assembled in the installation state. In this case, the relatively large waste recovery station 40 is loaded in the loading part 16, being divided into a plurality of divided bodies. Therefore, unloading of the waste recovery station 40 from the trailer 13 can be facilitated.

Figure 24:
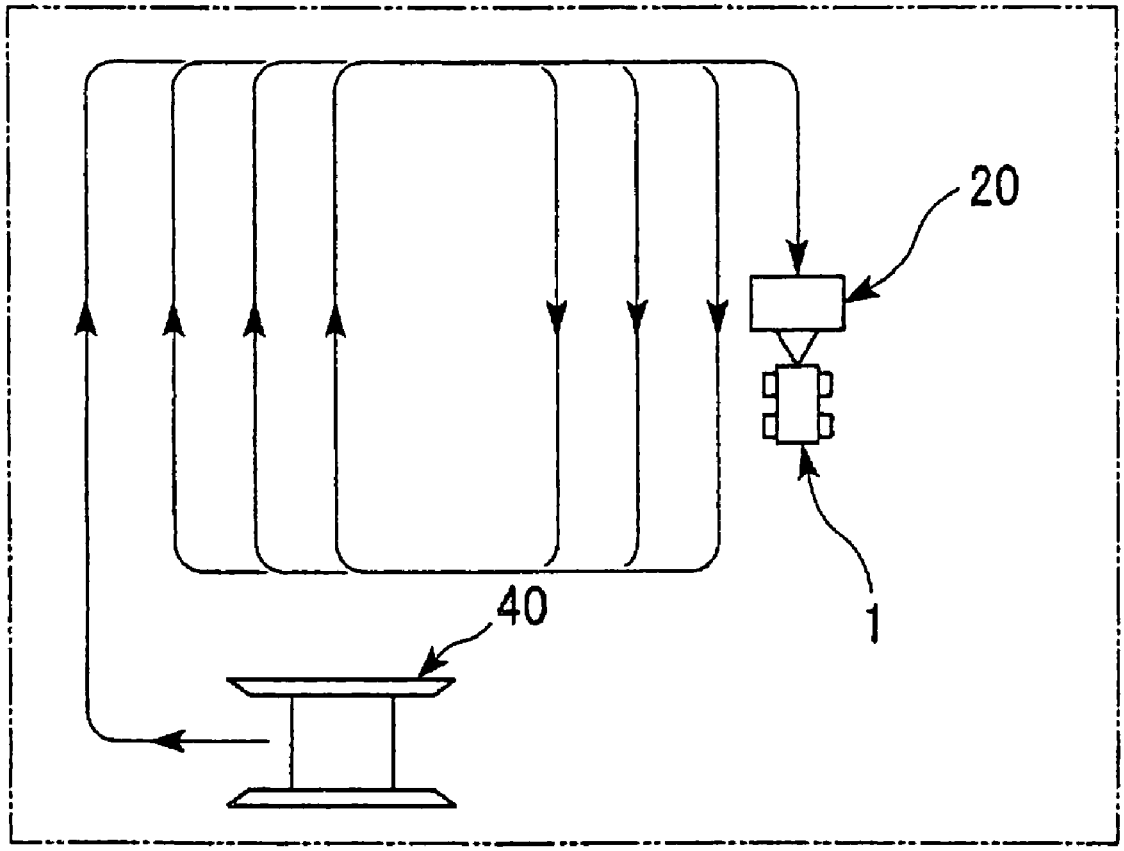
FIG. 24 is an explanatory diagram illustrating the running trajectory of a vehicle when the beach cleaners of the embodiment clean a sandy beach.

The first beach cleaner 20 is then unloaded from the trailer 13 and subjected to the settings based on the measurements of the hardness of the sandy beach. The first beach 20 is towed by the vehicle 1 to run on the sandy beach at a constant speed, thereby collecting relatively large waste on the sandy beach. In this case, as shown in FIG. 24, the running trajectory is obtained by the vehicle 1 and the first beach cleaner 20 which turn along almost-squares, shifting their turning position in the predetermined area on a sand area, thereby making it possible to sweep the predetermined area surely and evenly, The first beach cleaner 20 collects relatively large waste on the sandy beach while digging the sand pins 23 in the sand, being subjected to relatively large travel resistance. Thus, the traveling speed is set at as low as about 5 to 10 km/h.

When the first beach cleaner 20 runs on the sandy beach as described above to collect a predetermined amount of waste under the frame 22, it once returns to the waste recovery station 40, where the waste collected is recovered. In this case, the vehicle 1 passes between the left and right side structures 41 of the waste recovery station 40 and then the first beach cleaner 20 enters between the left and right side structures 41. At this time, the left and right lift arms 39 ride on the left and right side structures 41, respectively, whereby the first beach cleaner 20 is lifted up at a predetermined amount (see FIG. 13). In the state where the vehicle 1 and the first beach cleaner 20 are stopped, the waste is allowed to drop on the sand area for recovery work. Thereafter, the vehicle 1 and the first beach cleaner 20 are made to run again to repeat the waste collecting work described earlier.

In the second embodiment, the left and right side portions of the frame 22 ride on the left and right side structures 41L and 41R, respectively, whereby the first beach cleaner 20 is lifted up at a predetermined amount (see FIG. 13(*a*)). In the state where the first beach cleaner 20 rides on the upper side sections 44*c* of the guide members 44 of the left and right side structures 41L, 41R, the vehicle 1 and the first beach cleaner 20 are stopped and the waste is allowed to drop on the sand area for recovery work. Thereafter, the vehicle 1 and the first beach cleaner 20 are made to run again to repeat the waste collecting work described earlier.

After the first beach cleaner 20 cleans the predetermined area, the second beach cleaner 50 is towed to run on the same area to collect relatively small waste on the sandy beach. In this way, the second beach cleaner 50 is used after the first beach cleaner 20 is used. Therefore, the keels 54, the scrapers 55, the net 56 and the like which deal with small waste can be prevented from being damaged. The running trajectory of the second beach cleaner 50 is the same as that of the first beach cleaner 20. When the second beach cleaner 50 runs on a sandy beach, the sandy beach is soft because it has been broken up by the action of the first beach cleaner 20, In addition, it is necessary for the keels 54 and the scrapers 55 to scrape out sand and waste. Thus, the traveling speed of the second beach cleaner 50 is set to about 15 to 25 km/h, which is slightly faster than that of the first beach cleaner 20.

While the second beach cleaner 50 runs on the sandy beach, the keels 54 and the scrapers 55 scrape out relatively small waste together with sand, which is collected in the net 56 at the rear portion of the frame 53. The net 56 on the bottom wall section 92 is set such that the wire meshes are smaller in mesh size in the order from the front side. Thus, the waste collected is unlikely to drop and the wire meshes can be prevented from clogging.

After the second beach cleaner 50 runs on the sandy beach to collect a predetermined amount of waste in the net 56 as described above, it once returns to the waste recovery station 40, in which the waste collected is recovered from the second beach cleaner 50. In this recovery work, when the vehicle 1 passes between the left and right side structures 41 of the waste recovery station 40 and then the second beach cleaner 50 enters between the left and right side structures 41, the front and rear, left and right lift arms 81*a*, 81*b* ride on the left and right side structures 41 to lift up the second beach cleaner 50 a predetermined amount. In this state, the vehicle 1 and the second beach cleaner 50 are stopped and the net 56 is turned to recover the collected waste. Thereafter, the vehicle 1 and the second beach cleaner 50 are made to run again to repeat the waste collecting work described earlier.

As described above, the waste recovery station 40 in the embodiment described above includes a pair of left and right grounded members 43, guide members 44 formed like a mountain as viewed from the side and attached to the grounded members 43, and bar-like connecting members 42 integrally connecting the grounded members 43. In addition, the waste recovery station 40 can recover the waste collected by the beach cleaners 20, 50 towed by the towing vehicle 1 to run on the sand area by allowing the beach cleaners 20, 50 to ride on the waste recovery station 40. In this structure, the waste recovery station 40 includes a connecting pipe 46 which removably connect an end of the connecting member 42 to the grounded member 43.

With this configuration, the side structure 41 mainly including the grounded member 43 and the guide member 44, and the connecting member 42 are made dividable, whereby each of these divided bodies is planar.

Since each of the divided bodies after being divided is less liable to be bulky, it is easy to carry the divided bodies, to load and unload them on and from the trailer 13, and to assemble them, thereby facilitating installing work.

In the waste recovery station 40, the connecting pipe 46 is cylindrical so as to receive the end of the connecting member 42 insertable thereinto. While the connecting member 42 is inserted into the connecting pipe 46, the retaining pin 47 to be passed through the connecting member 42 and the connecting pipe 46 is inserted thereinto and is dug into the sand. Thus, while the retaining pin 47 detachably connects the connecting member 42 to the connecting pipe 46, the retaining pins 47 suppress movement of the waste recovery station 40 with respect to the sand area.

Figure 27:
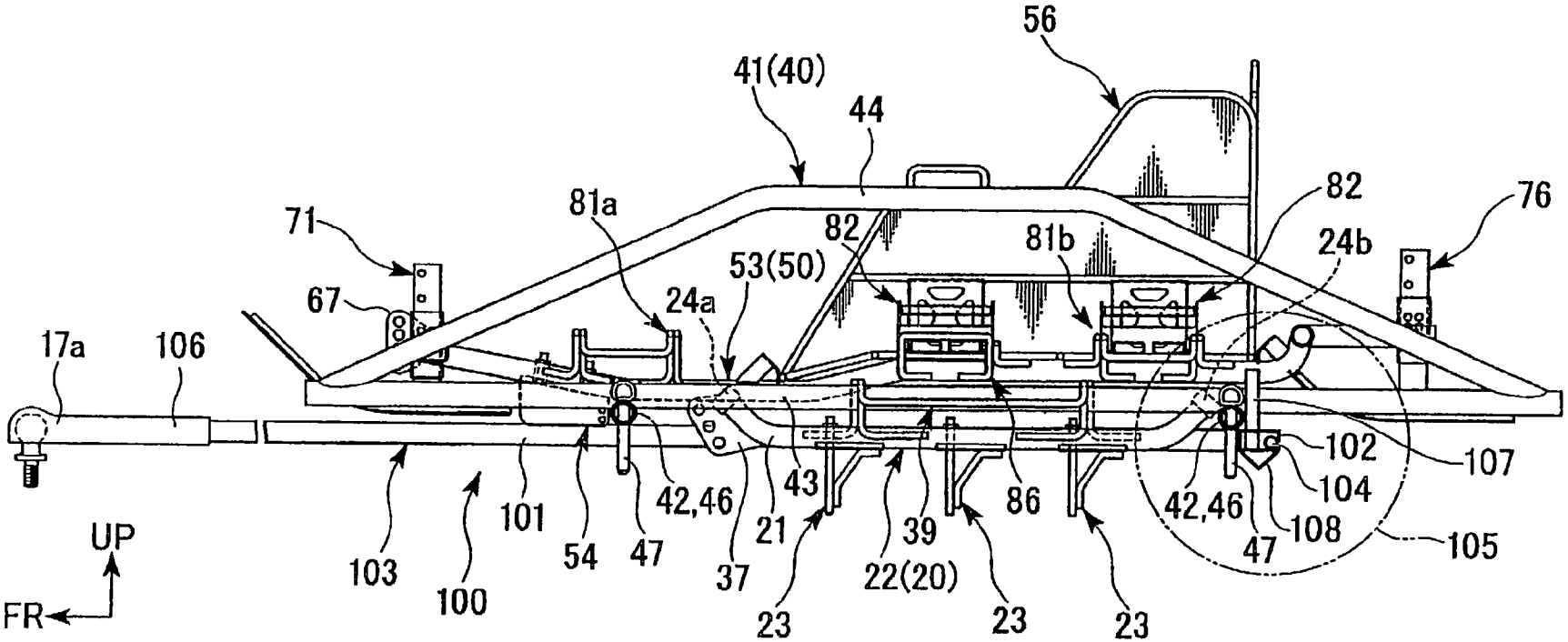
FIG. 27 is a side view of the third beach cleaner of the embodiment used as a trailer.
Figure 28:
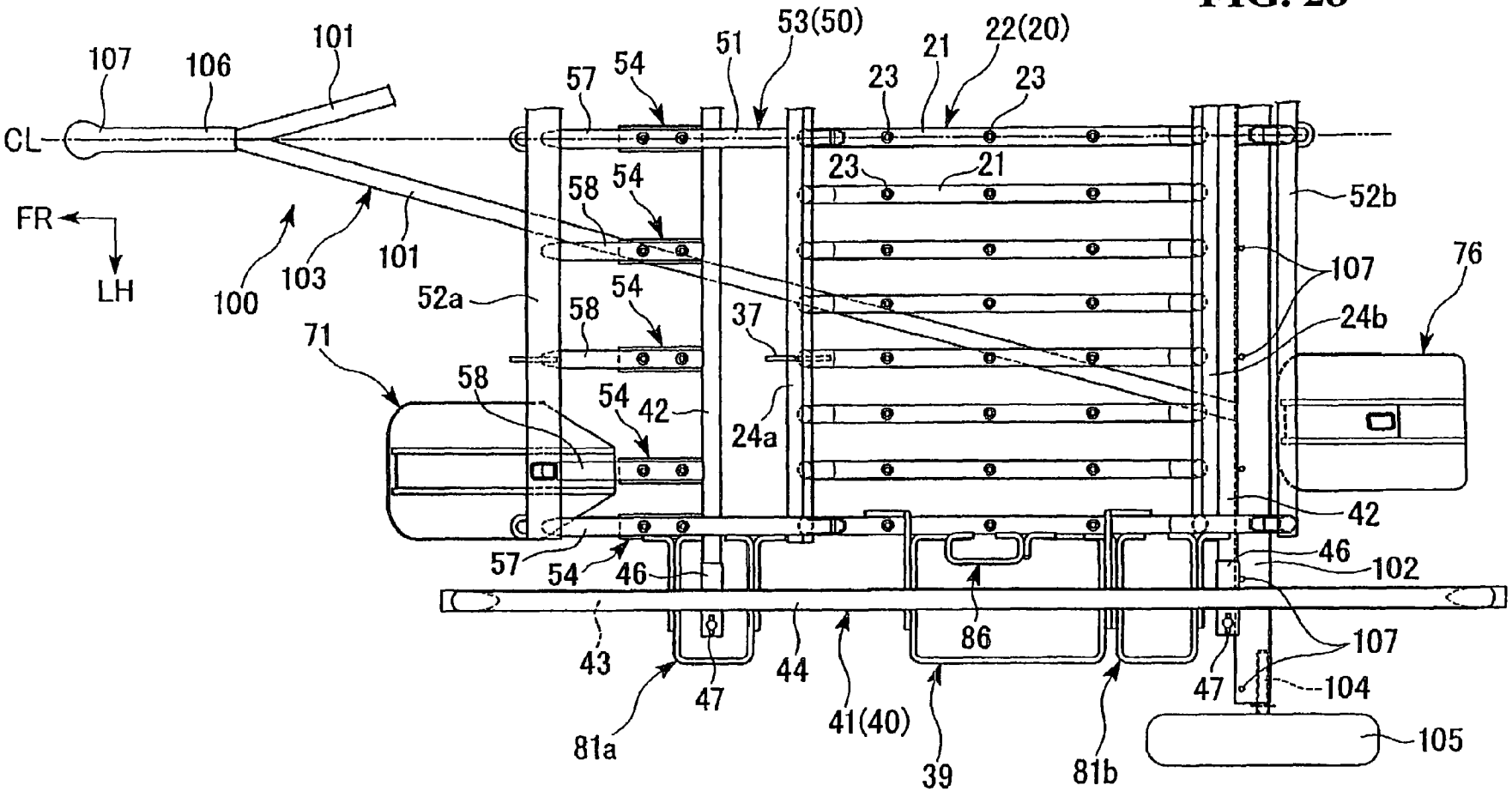
FIG. 28 is a plan view of FIG. 27.

Referring to FIGS. 27 and 28, the present embodiment includes a third beach cleaner 100 suitable to clean a relatively narrow site. The third beach cleaner 100 can be used as a trailer for carrying the first and second beach cleaners 20, 50 and the waste recovery station 40. FIGS. 27 and 28 illustrate a state where the first and second cleaners 20, 50 and the waste recovery station 40 are loaded on the third beach cleaner 100.

Figure 29:
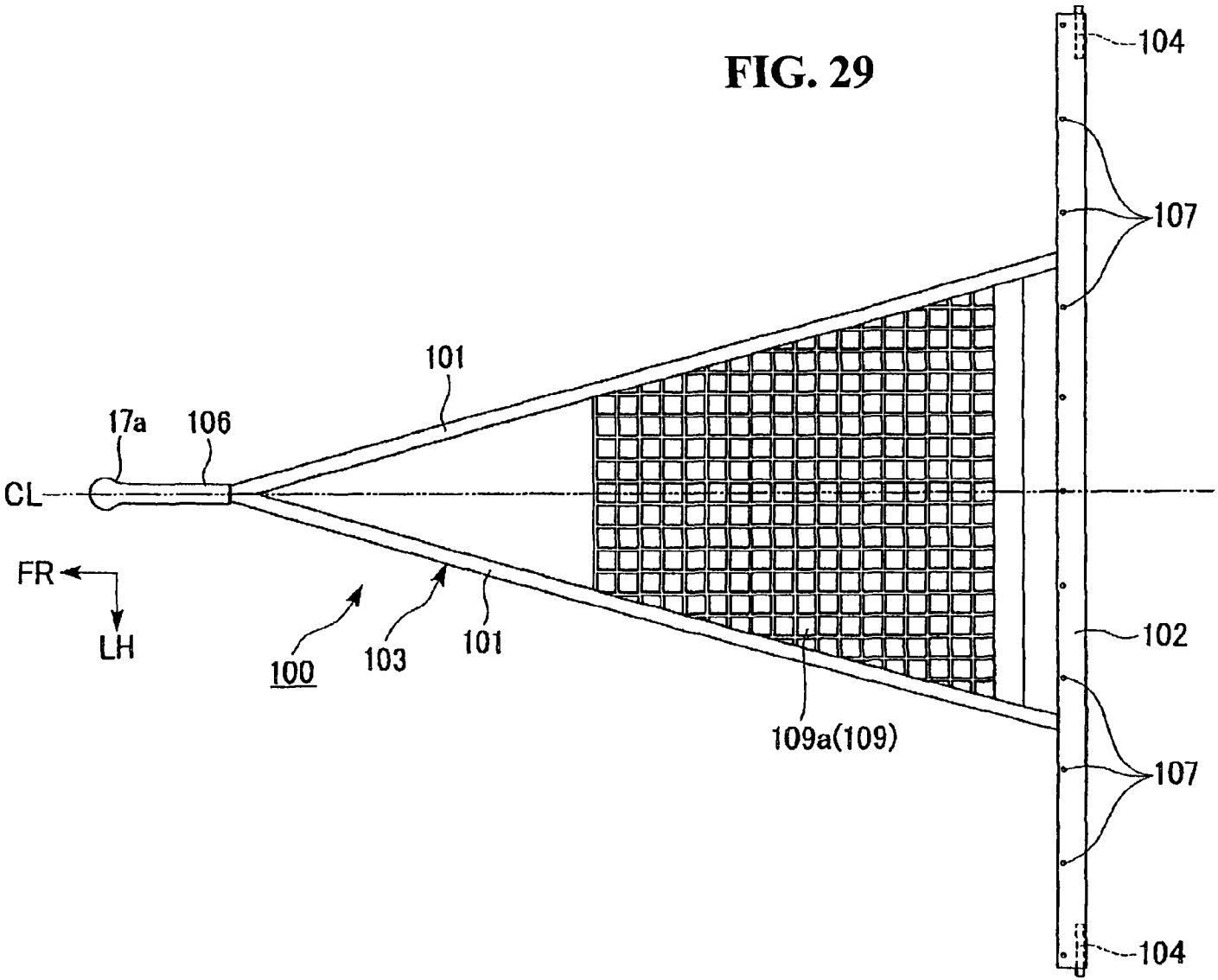
FIG. 29 is a plan view of the third beach cleaner.

Additionally referring to FIG. 29, the third beach cleaner 100 includes a pair of longitudinal members 101 and a lateral member 102, which form a frame 103 shaped in a triangle as viewed from above. The longitudinal members 101 extend in the traveling direction of the vehicle 1 (in detail, extend so as to be located more leftward and rightward outwardly as they go rearward). The lateral member 102 extends in the widthwise direction (leftward and the rightward direction) so as to be spanned between the ends of the longitudinal members 101. The longitudinal members 101 are abutted at their rear ends against the front face of the lateral member 102 for connection therewith.

Figure 30A:
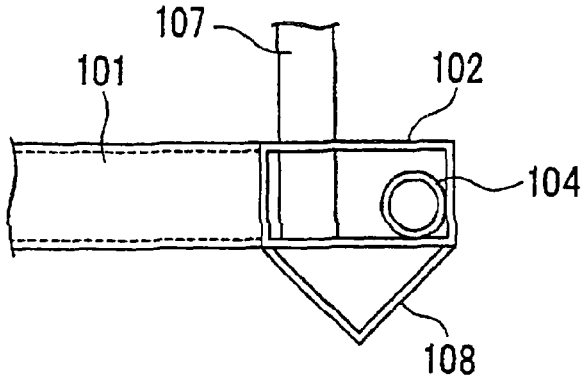
FIG. 30 includes partial enlarged views of the third beach cleaner, in which FIG. 30(*a*) is a side view and FIG. 30(*b*) is a plan view.
Figure 30B:
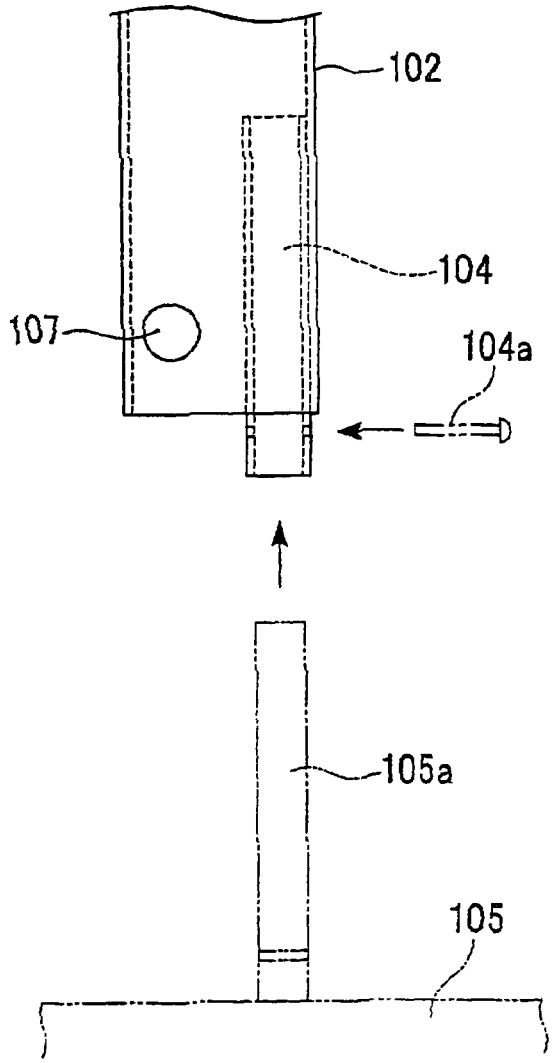
Figure 31:
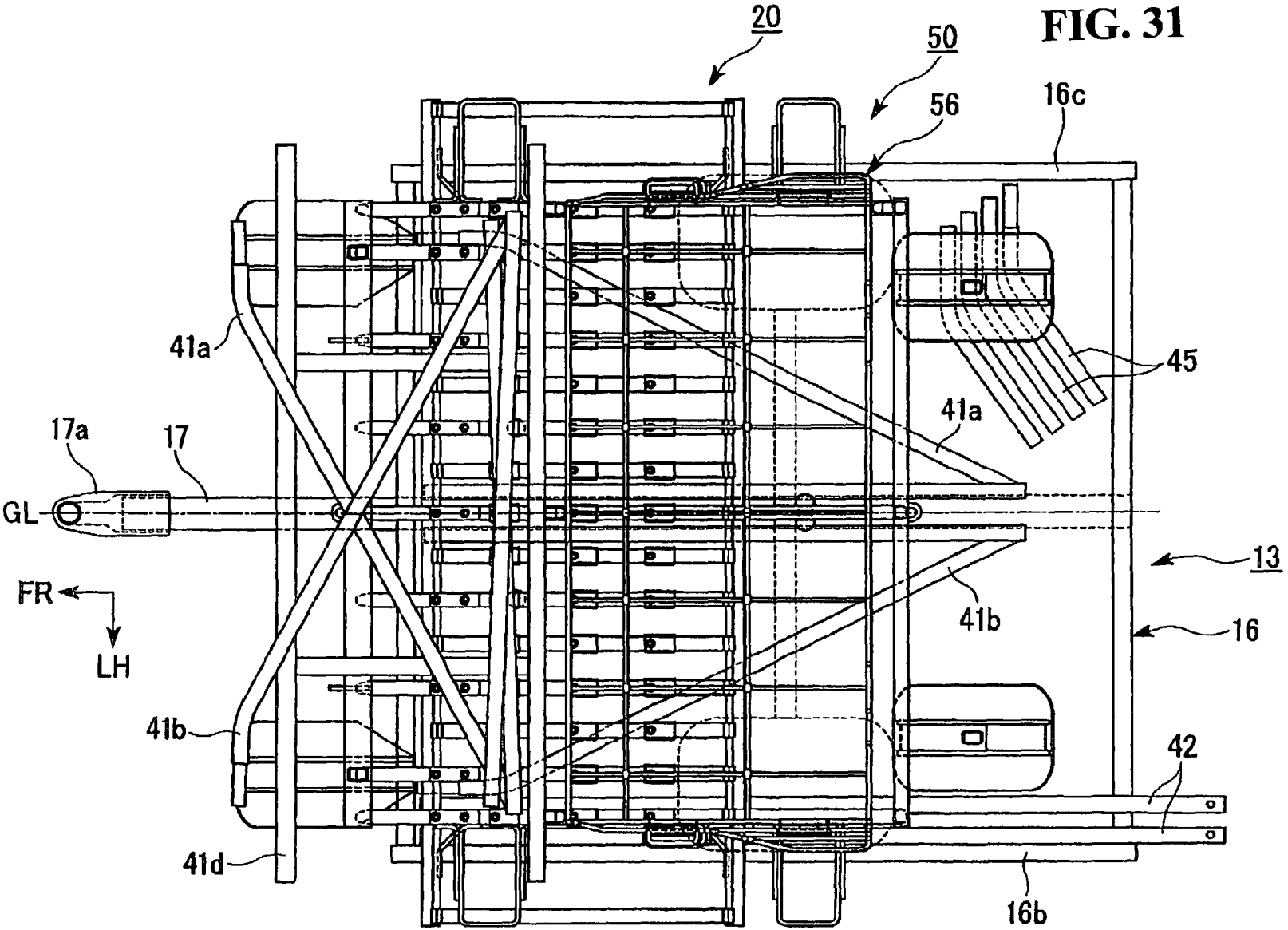
FIG. 31 is a plan view illustrating the loading state of the trailer of FIG. 1(*a*)

Additionally referring to FIG. 30, the lateral member 102 further extends leftward and rightward outwardly from the respective rear end positions of the longitudinal members 101 to form end portions. An axle support pipe 104 is integrally attached to the inside of each of the end portions. An axle 105*a* adapted to rotatably support the associated wheel 105 is insertable into the axle support pipe 104. In the state where the axle 105*a* is inserted into the axle support pipe 104, a locking device is provided, that is, a desired retaining pin 104*a* is inserted into the axle support pipe 104 and the axle 105*a*. Thus, the left and right wheels 105 are rotatably supported by both ends of the lateral members 102. If the locking devices are released, the left and right wheels 105 can be removed from the lateral member 102. Incidentally, the left-right width (the entire length) of the lateral member 102 is greater than that between the left and right side structures 41 of the waste recovery station 40.

The front ends of the longitudinal members 101 merge into each other at a left-right center of the frame 103 to form a merging portion. A towing arm 106 extends forward from the merging portion. The towing arm 106 is provided at its front end with the hitch coupler 17*a* associated with the trailer hitch 11 of the vehicle 1. The front end of the frame 103 can be coupled to the vehicle 1 via the hitch coupler 17*a*. In the state where the wheels 105 are attached to or detached from the lateral member 102, the third beach cleaner 100 is towed by the vehicle to run on the sandy beach.

A plurality of sand pins 107 are provided to extend upright on one side face of the lateral member 102 so as to be almost perpendicular to a flat portion 109 formed by the longitudinal and lateral members 101, 102. The sand pins 107 are spaced equally apart from each other in the longitudinal direction (leftward and rightward direction) of the lateral member 102. In the state where the sand pins 107 are made to face the downside and the wheels 105 are detached, when the third beach cleaner 100 is towed by the vehicle 1, the third beach cleaner 100 functions as a rake to collect waste scattered on the sandy beach.

After waste is collected, the third beach cleaner 100 enters the waste recovery station 40 so that both sides of the lateral member 102 ride on the side structures to be lifted up. Thus, the waste allowed to drop on the sand area can be collectively recovered. A channel member 108 is provided on the other side of the lateral member 102 so as to form a triangle in section together with the other side of the lateral member 102. When the third beach cleaner 100 is towed with the channel member 108 facing the downside, the sandy beach after the cleaning can be flattened. Since being shaped in a triangle in section, the channel member 108 tends to be unfailingly buried in the sandy beach, whereby the land leveling performance of the third beach cleaner 100 can be enhanced.

On the other hand, in the state where the sand pins 107 are made to face the upside and the wheels 105 are attached to the lateral member 102, when being towed by the vehicle 1, the third beach cleaner 100 functions as a trailer. In this case, the rear connecting members 42 of the waste recovery station 40 loaded on the frame 103 are abutted against the sand pins 107 from a forward direction. Therefore, the waste recovery station 40 is restricted in rearward movement relative to the third beach cleaner 100. The rear ends of the keels 54 of the second beach cleaner 50 are abutted against the front connecting members 42 of the waste recovery station 40 from a forward direction. Therefore, the second beach cleaner 50 is restricted in rearward movement. The rear lateral members 24*b* of the first beach cleaner 20 is abutted against the rear connecting members 42 of the waste recovery station 40 from the forward direction. Therefore, the first beach cleaner 20 is restricted in rearward movement.

A net section 109*a* is provided at the rear portion of the flat portion 109 included in the frame 103 so as to be spanned among the longitudinal members 101 and the lateral member 102. The net section 109*a* is made of a grating-like wire mesh. When the third beach cleaner 100 is used as the trailer, the component parts such as foot members 45 of the waste recovery station 40 can be easily loaded on the frame 103 and also prevented from falling from the frame 103. In addition, sand or water can be prevented from collecting on the flat portion 109, which facilitates cleaning, maintenance and the like.

As described above, the structure of the third beach cleaner 100 in the embodiment includes the frame 103 composed of the longitudinal members 101 extending in the traveling direction and the lateral member 102 extending in the widthwise direction, a plurality of the sand pins 107 attached to the lateral member 102, and the hitch coupler 17*a* located at the front end of the frame 103. In addition, the third beach cleaner 100 is towed by the towing vehicle 1 to run on the sand area, collecting scattered waste. In the structure of the third beach cleaner 100, the wheels 105 are attachable to and detachable from both sides of the frame 103 and when the wheels 105 are attached, the third beach cleaner 100 functions as the trailer with the sand pins 107 attached to one side face of the frame 103 serving as positioning portions.

With this configuration, the wheels 105 are attached to both the sides of the frame 103 with the sand pins 107 facing the upside and the third beach cleaner 100 is towed by the towing vehicle 1 using the hitch coupler 17*a* located at the front end of the frame 103. Thus, the third beach cleaner 100 can be used as the trailer. This makes it possible to carry the other beach cleaners 20, 50 and the waste recovery station 40 without the necessity of the dedicated trailer 13. In this case, the component parts or goods loaded on the frame 103 can be positioned using the sand pins 107 facing the upside and the frame 103 can be provided so as to make its lower side planar, thereby making it easy to ensure the minimum ground height for the trailer.

In the beach cleaner structure described above, since the flat portion 109 is provided on the frame 103, loading the component parts or goods on the frame 103 can be facilitated when the third beach clear 100 is used as the trailer as described above.

In the beach cleaner structure described above, since the flat portion 109 is provided with the net section 109*a*, loading performance of the component parts on the frame 103 can be enhanced while sand or the like can be prevented from collecting on the flat portion 109, thereby enhancing maintenance performance.

Figure 34:
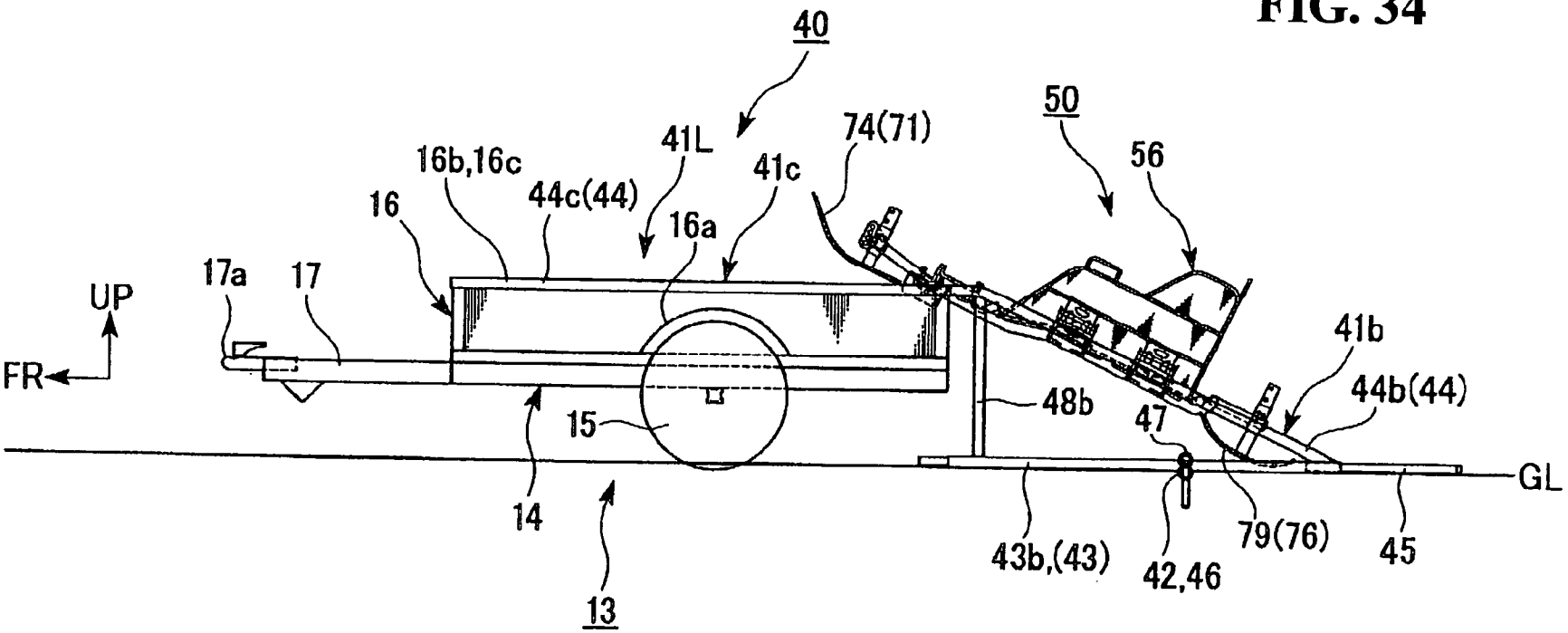
FIG. 34 is a side view illustrating loading and unloading the second beach cleaner on and from the trailer.
Figure 35:
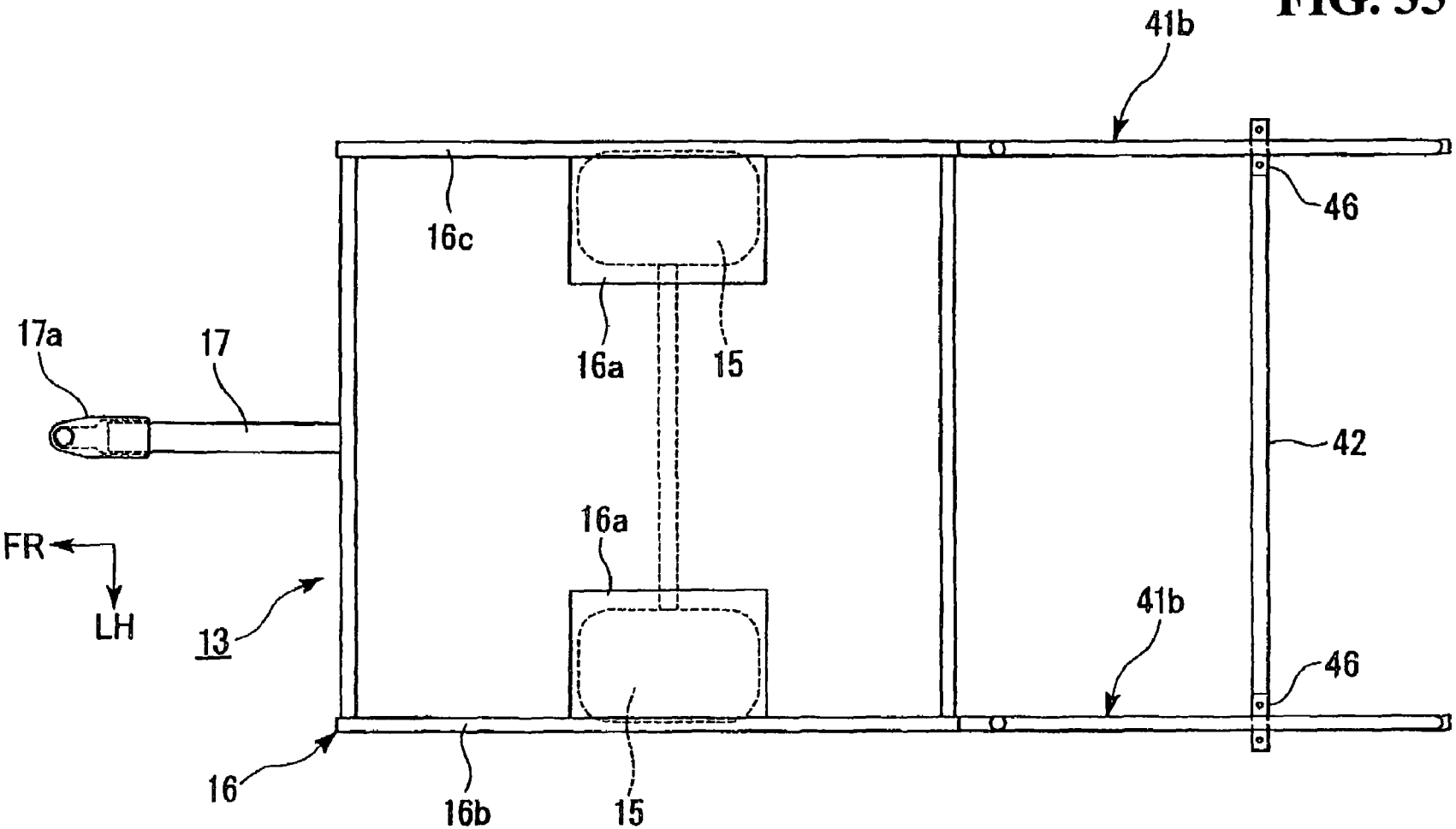
FIG. 35 is a plan view of FIG. 34.

In the second embodiment, when the vehicle 1 passes between the left and right side structures 41L, 41R of the waste recovery station 40 and then the second beach cleaner 50 enters between the left and right side structures 41L, 41R, the front and rear, left and right lift arms 81*a*, 81*b* ride on the left and right side structures 41L, 41R to lift up the second beach cleaner 50 at a predetermined amount (see FIG. 34). In the state where the second beach cleaner 50 rides on the upper side sections 44*c* of the guide members 44 of the left and right side structures 41L, 41R, the vehicle 1 and the second beach cleaner 50 are stopped and the net 56 is turned to recover the collected waste. Thereafter, the vehicle 1 and the second beach cleaner 50 are made to run again to repeat the waste collecting work described earlier.

When recovered by turning the net 56, waste is directly thrown into the loading part 16 of the trailer 13 leftward adjacent to the waste recovery station 40 as shown in FIG. 11. The loading part 16 can be used as a waste recovery container. After the cleaning work, the waste recovered can be carried by the trailer 13 and the work for recovering waste, which has otherwise dropped on the ground area, can be eliminated. Thus, the man-hours of cleaning work can be reduced.

As described above, the structure of the waste recovery station 40 for beach cleaners in the embodiment can recover the waste collected by the beach cleaners 20, 50 towed by the towing vehicle 1 to run on the sand area by allowing the beach cleaners 20, 50 to ride on the waste recovery station 40. In this structure, the waste recovery station 40 includes the trapezoidal side structures 41R, 41L formed by providing, on the grounded members 43, the mountain-shaped guide members 44 on which the beach cleaners 20, 50 ride, and the loading part 16 of the trailer 13 in the towed state constitutes at least one of the upper side sections of the side structures 41R, 41L.

With this configuration, when the beach cleaners 20, 50 and the waste recovery station 40 loaded on the loading part 16 of the trailer 13 in the towed state are unloaded on the ground, the waste recovery station 40 including the loading part 16 is first brought into an installed state by assembling it at a desired position, and then, the beach cleaners 20, 50 on the loading part 16 can be then unloaded on the ground along the guide members 44 of the waste recovery station 40. When the beach cleaners 20, 50 and the waste recovery station 40 are loaded on the loading part 16, the beach cleaners 20, 50 are lifted up along the guide members 44 of the waste recovery station 40 and loaded on the loading part 16, Thereafter, the waste recovery station 40 is disassembled and loaded on the loading part 16.

As described above, the loading part 16 of the trailer 13 in the towed state constitutes a portion of the guide member 44 of the waste recovery station 40. Loading and unloading of the beach cleaners 20, 50 and the waste recovery station 40 on and from the trailer 13 can be facilitated, thereby reducing the number of man-hours.

In the waste recovery station structure, the side structures 41R, 41L are each composed of a plurality of divided bodies attachable to and detachable from each other and the trailer 13 in the towed state can constitute at least one of the divided bodies. Thus, the waste recovery station 40 can be disassembled into the plurality of divided bodies and loaded and unloaded on and from the trailer 13, which facilitate the loading and unloading work.

In the waste recovery station structure, the waste recovery station 40 includes a pair of the left and right side structures 41L, 41R. In addition, the loading part 16 of the trailer 13 in the towed state constitutes at least the upper side section 44*c* of the right side structure of the left and right side structures 41L, 41R. Thus, the waste recovery station 40 can be installed with the trailer 13 located adjacently to the side of the right side structure 41R, thereby facilitating the installation work.

In the waste recovery station structure, the second beach cleaner 50 includes the net 56 adapted to capture waste. The net 56 is turnably provided and the pivotal shaft (hinge shaft 82*a*) of the net 56 is located on the side of the right side structure 41R when the second beach cleaner 50 rides on the waste recovery station 40. The waste recovery station 40 is installed so that the trailer 13 is adjacent to the right side structure 41R close to the pivotal shaft. Thus, the waste collected can be discharged by turning the net 56. The waste discharge work is carried out by lifting up the second beach cleaner 50 by the waste recovery station 40. Thus, the waste can be directly thrown into the loading part 16 of the trailer 13 adjacent to the right side structure 41R close to the pivotal shaft, so that the loading part 16 can be used as a waste recovery container and work for recovering waste from the sand area, thereby facilitating the waste recovery work.

In addition, in the waste recovery station structure, the waste recovery station 40 includes the connecting members 42 adapted to connect the pair of left and right side structures 41L, 41R. The connecting members 42 are provided to be spanned between the divided bodies of the side structures 41R, 41L except the portions corresponding to the trailer 13. Thus, the pair of left and right side structures 41L, 41R can be connected by the connecting members 42 while avoiding portions constituting the trailer 13, thereby enhancing the rigidity of the waste recovery station 40.

The present invention is not limited to the embodiment described above. For example, the left and right side portion 16*b*, 16*c* of the loading part 16 may constitute the respective upper side sections 44*c* of the left and right side structures 41L, 41R. In this case, after the front and rear divided bodies 41*a*, 41*b* are connected to the left and right side portions 16*b*, 16*c* of the loading part 16, the trailer 13 may be made movable while leaving the left and right side portions 16*b*, 16*c*.

The loading part 16 may constitute one of or both of the left and right entire side structures 41L, 41R. The front and rear slant sections 44*a*, 44*b* and upper side section 44*c* of each of the left and right guide members 44 may be configured to bend appropriately.

The respective configurations of the left and right side structures 41L, 41R may be reversed in the waste recovery station 40 and the trailer 13 may be located adjacently to and on the right side of the right side structure 41R. In addition, the hinge 82 of the net 56 of the second beach cleaner 50 may be provided on the right side. The trailer 13 is turned rightward or leftward so as to be adjacent to the waste recovery station 40 so that the rear wall upper edge portion of the loading part 16 constitutes the upper side section 44*c*.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A waste recovery station structure for a beach cleaner, in which the beach cleaner which runs on a sand area to collect waste while being towed by a towing vehicle is allowed to ride on the waste recovery station for enabling recovery of the waste, said waste recovery station comprising:

a first trapezoid structure formed by providing, on a grounded member, a guide member on which the beach cleaner rides when waste is to be recovered, and a portion of a trailer constitutes at least an upper side section of the first trapezoid structure when the waste recovery station is set-up for use;

wherein the beach cleaner and the waste recovery station are loaded onto the trailer for transport; and wherein the guide member extends at an angle with respect to the grounded member.

2. The waste recovery station structure for the beach cleaner according to claim 1, wherein the first trapezoid structure is composed of a plurality of divided bodies attachable to and detachable from each other, and said portion of the trailer constitutes at least one of the divided bodies.

3. The waste recovery station structure for the beach cleaner according to claim 1, wherein the waste recovery station includes a second trapezoid structure and said portion of the trailer constitutes at least an upper side section of only the first trapezoid structure.

4. The waste recovery station structure for the beach cleaner according to claim 2, wherein the waste recovery station includes a second trapezoid structure and said portion of the trailer constitutes at least an upper side section of only the first trapezoid structure.

5. The waste recovery station structure for the beach cleaner according to claim 3, wherein the beach cleaner includes a net adapted to capture waste and wherein the net is turnable such that waste collected can be thrown into a loading part of the trailer when the beach cleaner rides on the waste recovery station.

6. The waste recovery station structure for the beach cleaner according to claim 4, wherein the beach cleaner includes a net adapted to capture waste and wherein the net is turnable such that waste collected can be thrown into a loading part of the trailer when the beach cleaner rides on the waste recovery station.

7. The waste recovery station structure for the beach cleaner according to claim 3, wherein the waste recovery station includes connecting members adapted to connect the first and second trapezoid structures, the second trapezoid structure is composed of a plurality of divided bodies attachable to and detachable from each other, and the connecting members are provided to be spanned between at least two corresponding divided bodies of the first and second trapezoid structures except a portion corresponding to the trailer.

8. The waste recovery station structure for the beach cleaner according to claim 4, wherein the waste recovery station includes connecting members adapted to connect the first and second trapezoid structures, the second trapezoid structure is composed of a plurality of divided bodies attachable to and detachable from each other, and the connecting members are provided to be spanned between at least two corresponding divided bodies of the first and second trapezoid structures except a portion corresponding to the trailer.

9. The waste recovery station structure for the beach cleaner according to claim 5, wherein the waste recovery station includes connecting members adapted to connect the first and second trapezoid structures, the second trapezoid structure is composed of a plurality of divided bodies attachable to and detachable from each other, and the connecting members are provided to be spanned between at least two corresponding divided bodies of the first and second trapezoid structures except said portion corresponding to the trailer.

10. The waste recovery station structure for the beach cleaner according to claim 6, wherein the waste recovery station includes connecting members adapted to connect the first and second trapezoid structures, the second trapezoid structure is composed of a plurality of divided bodies attachable to and detachable from each other, and the connecting members are provided to be spanned between at least two corresponding divided bodies of the first and second trapezoid structures except said portion corresponding to the trailer.

* * * * *